US006574445B2

(12) United States Patent
Higeta et al.

(10) Patent No.: US 6,574,445 B2
(45) Date of Patent: Jun. 3, 2003

(54) METHOD OF REMANUFACTURING PROCESS CARTRIDGE INCLUDING ADDITIONAL SEAL MOUNTING STEP

(75) Inventors: Akira Higeta, Funabashi (JP); Satoshi Yasuda, Tokyo (JP); Yoshiyuki Kakumi, Tuchiura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/795,187

(22) Filed: Mar. 1, 2001

(65) Prior Publication Data

US 2001/0041080 A1 Nov. 15, 2001

(30) Foreign Application Priority Data

Mar. 7, 2000 (JP) ..... 2000-062445

(51) Int. Cl.[7] ..... G03G 15/00; G03G 15/08
(52) U.S. Cl. ..... 399/103; 399/109
(58) Field of Search ..... 399/103, 109

(56) References Cited

U.S. PATENT DOCUMENTS

| | | | | |
|---|---|---|---|---|
| 5,331,373 A | | 7/1994 | Nomura et al. | 355/200 |
| 5,389,732 A | * | 2/1995 | Sekino | 399/103 |
| 5,452,056 A | | 9/1995 | Nomura et al. | 355/200 |
| 5,485,249 A | | 1/1996 | Higeta et al. | 355/210 |
| 5,525,183 A | * | 6/1996 | Baley | 399/109 X |
| 5,585,889 A | | 12/1996 | Shishido et al. | 355/200 |
| 5,740,499 A | | 4/1998 | Higeta et al. | 399/105 |
| 5,809,374 A | | 9/1998 | Tsuda et al. | 399/111 |
| 5,870,654 A | * | 2/1999 | Sato et al. | 399/109 |
| 5,937,236 A | * | 8/1999 | Kim | 399/103 |
| 5,966,566 A | * | 10/1999 | Odagawa et al. | 399/109 |
| 6,101,348 A | | 8/2000 | Nonaka et al. | 399/103 |
| 6,181,897 B1 | * | 1/2001 | Kawai | 399/103 |
| 6,185,390 B1 | | 2/2001 | Higeta et al. | 399/90 |

FOREIGN PATENT DOCUMENTS

| | | |
|---|---|---|
| JP | 6-130740 | 5/1994 |
| JP | 7-72719 | 3/1995 |
| JP | 7-181857 | 7/1995 |
| JP | 7-295376 | 11/1995 |
| JP | 8-305258 | 11/1996 |

* cited by examiner

*Primary Examiner*—Fred L Braun
(74) *Attorney, Agent, or Firm*—Fitzpatrick, Cella, Harper & Scinto

(57) ABSTRACT

A remanufacturing method for a process cartridge includes (a) a step of separating a first unit and a second unit from each other; (b) a step of dismounting a developing roller mounted to the second unit which has been separated by the separation step; (c) a step of mounting an addition seal along an original seal having been mounted to a developing frame along a longitudinal direction of a developing roller frame to prevent leakage of developer through between the developing roller and the developing roller frame; (d) a step of refilling the developer into a developer accommodating portion of the second unit which has been separated by the separation step; (e) a step of remounting the developing roller to the second unit which has been separated by the separation step; and (f) a unit re-coupling step of recoupling the first unit and the second unit with each other.

18 Claims, 36 Drawing Sheets

METHOD OF REMANUFACTURING PROCESS CARTRIDGE INCLUDING ADDITIONAL SEAL MOUNTING STEP

FIELD OF THE INVENTION AND RELATED ART

The present invention relates to a manufacturing method of a process cartridge.

Here, the process cartridge is a cartridge containing charging means, developing means, cleaning means and an electrophotographic photosensitive member as a unit, the cartridge being detachably mountable to a main assembly of an electrophotographic image forming apparatus.

The process cartridge may be a cartridge containing an electrophotographic photosensitive member and at least one of charging means, developing means and cleaning means as a unit, the cartridge being detachably mountable to a main assembly of an electrophotographic image forming apparatus.

The process cartridge may be a cartridge containing an electrophotographic photosensitive member and at least developing means as a unit, the cartridge being detachably mountable to a main assembly of an electrophotographic image forming apparatus. The image forming apparatus includes an electrophotographic copying machine, electrophotographic printer (an LED printer, a laser beam printer) and so on.

In an electrophotographic image forming apparatus using an electrophotographic image forming process, a process cartridge is used which integrally contains an electrophotographic photosensitive member and process means actable on the electrophotographic photosensitive member, the process cartridge being detachably mountable to the main assembly of the electrophotographic image forming apparatus.

With this process cartridge type, the maintenance of the apparatus can be carried out in effect without service people.

Therefore, the process cartridge type is widely used in the field of the electrophotographic image forming apparatus.

The process cartridge functions to form images on recording materials using a developer. The developer is consumed with the image forming operations. Therefore, at the time when the developer is consumed to such an extent that the quality of the images becomes unsatisfactory to the user, the commercial value of the process cartridge is lost.

An easy remanufacturing method for providing such a process cartridge with a commercial value, again has been desired.

SUMMARY OF THE INVENTION

Accordingly, it is a principal object of the present invention to provide an easy remanufacturing method of a process cartridge.

It is another object of the present invention to provide an easy remanufacturing method and a process cartridge wherein the developer is prevented from leaking out of the process cartridge when the process cartridge is transported.

It is a further object of the present invention to provide an easy remanufacturing method wherein a process cartridge having lost its commercial value is given a commercial value and a process cartridge having a regained commercial value.

According to an aspect of the present invention, there is provided a remanufacturing method for a process cartridge which is detachably mountable to a main assembly of an electrophotographic image forming apparatus, wherein said process cartridge includes a first unit supporting an electrophotographic photosensitive drum and a second unit, which includes a developing frame supporting a developing roller, a developer accommodating portion for accommodating a developer to be used for development by the developing roller and a developer frame provided with a developer supply opening for supplying to the developing roller the developer accommodated in the developer accommodating portion, said first unit and second unit being rotatably coupled with each other, said method comprising:

(a) a unit separating step of separating the first unit and the second unit from each other;

(b) a developing roller dismounting step of dismounting the developing roller mounted to the second unit which has been separated by said separation step;

an addition seal mounting step of mounting an addition seal along an original seal having been mounted to the developing frame along a longitudinal direction of the developing roller frame to prevent leakage of the developer through between the developing roller and the developing roller frame;

(d) a developer refilling step of refilling the developer into the developer accommodating portion of the second unit which has been separated by said separation step;

(e) a developing roller remounting step of remounting the developing roller to the second unit which has been separated by said separation step; and (f) a unit re-coupling step of recoupling the first unit and the second unit with each other, by which the process cartridge is remanufactured without remounting the toner seal to the developer supply opening having been unsealed by removing a toner seal upon start of used of the process cartridge.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First, the general structure of the image forming apparatus and process cartridge in the embodiments of the present invention will be described, and then, the assembly method for the process cartridge will be described. Lastly, a process in which the process cartridge is overhauled, and the overhauled cartridge, will be described. Incidentally, the short direction, or "widthwise" direction of the process cartridge B means the direction in which the process cartridge B is inserted into or dismounted from the apparatus main assembly 14, and coincides with the direction in which recording medium is conveyed. The longitudinal direction of the process cartridge B means the direction which intersects with (approximately perpendicular to) the direction in which the process cartridge B is inserted into, or dismounted from, the apparatus main assembly 14. It intersects with (approximately perpendicular to) the direction in which recording medium is conveyed, and is parallel to the surface of the recording medium.

Figure 1:
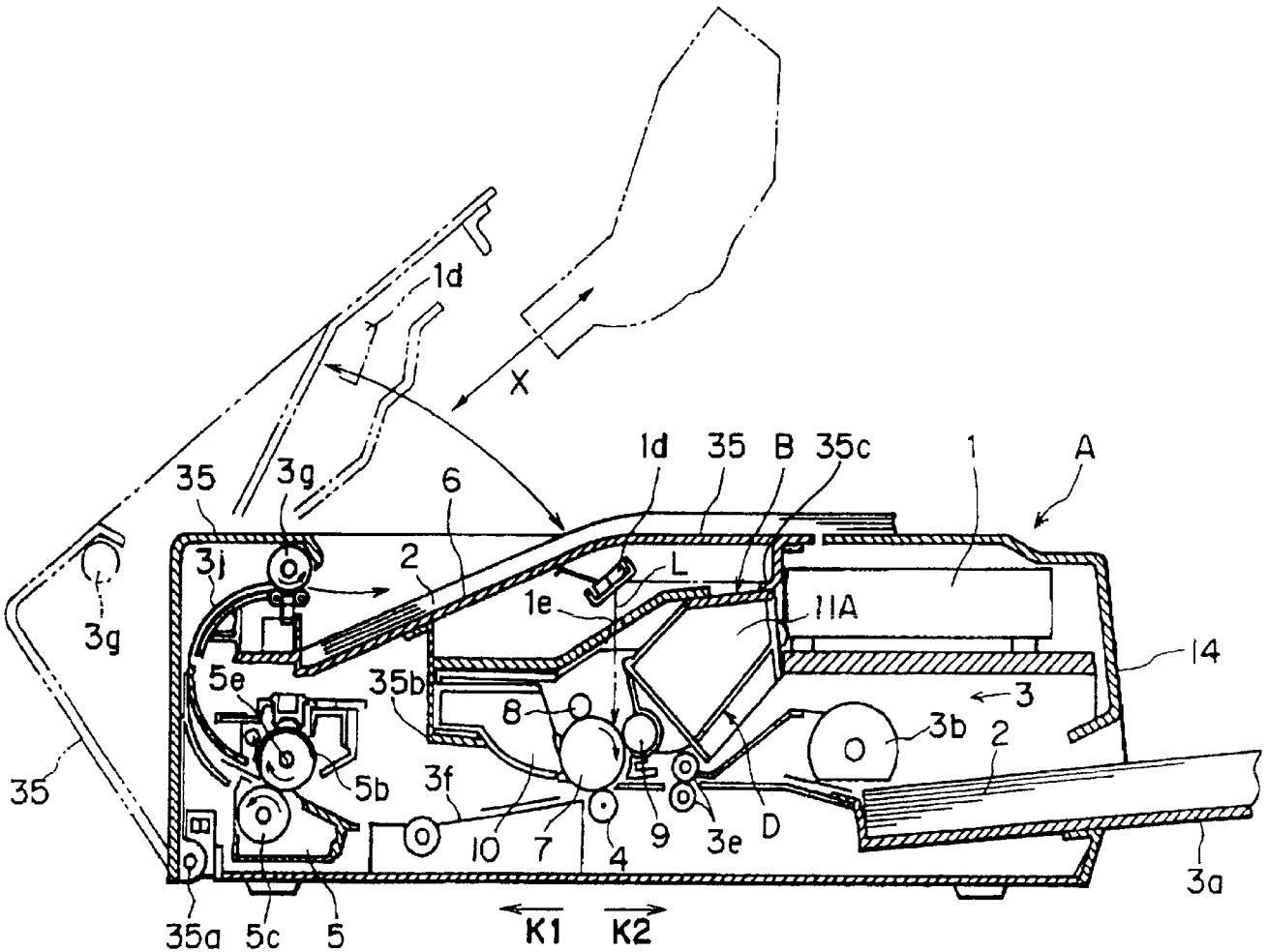
FIG. 1 is a vertical sectional view of an electrophotographic image forming apparatus.
Figure 2:
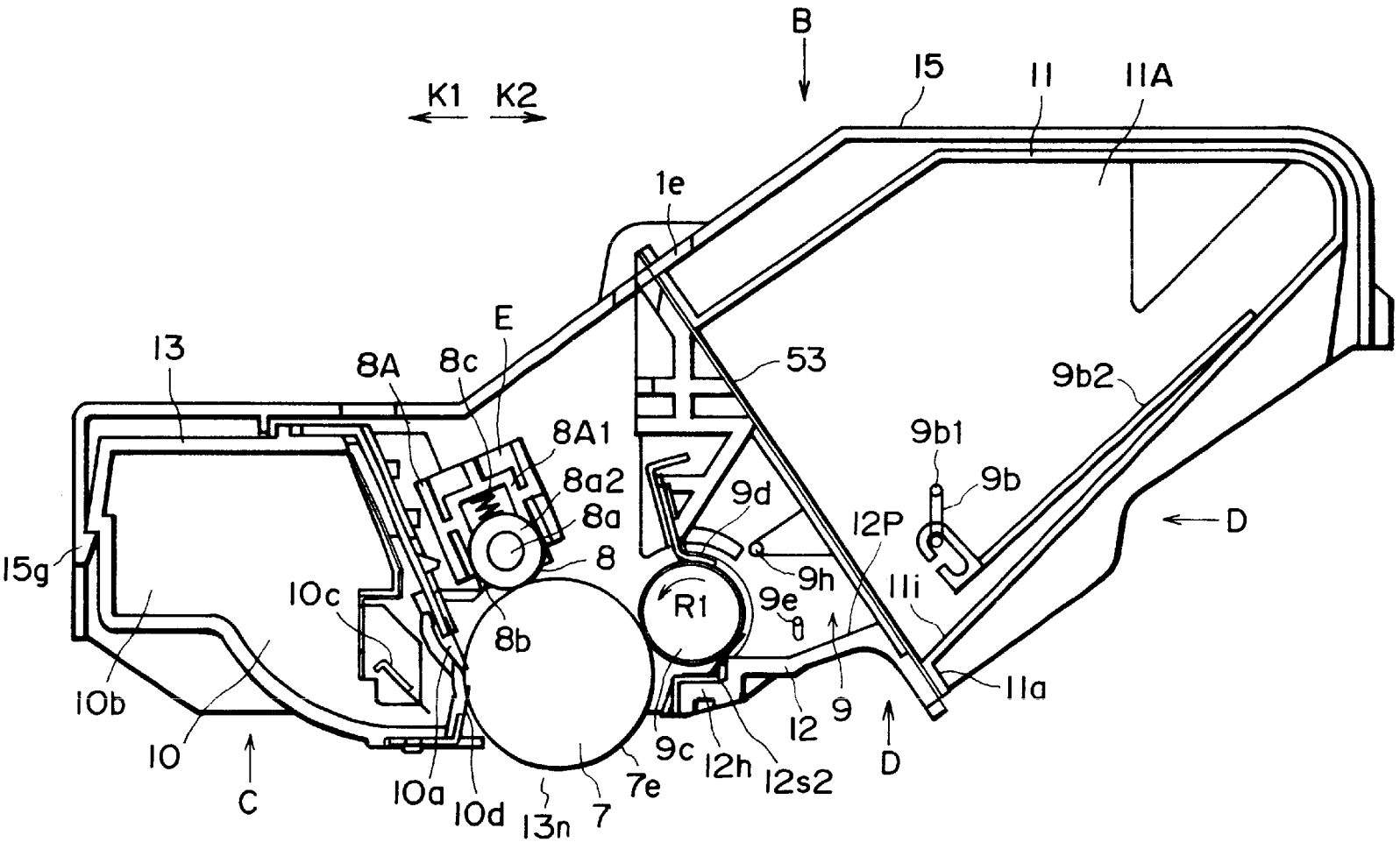
FIG. 2 is a vertical sectional view of a process cartridge.
Figure 3:
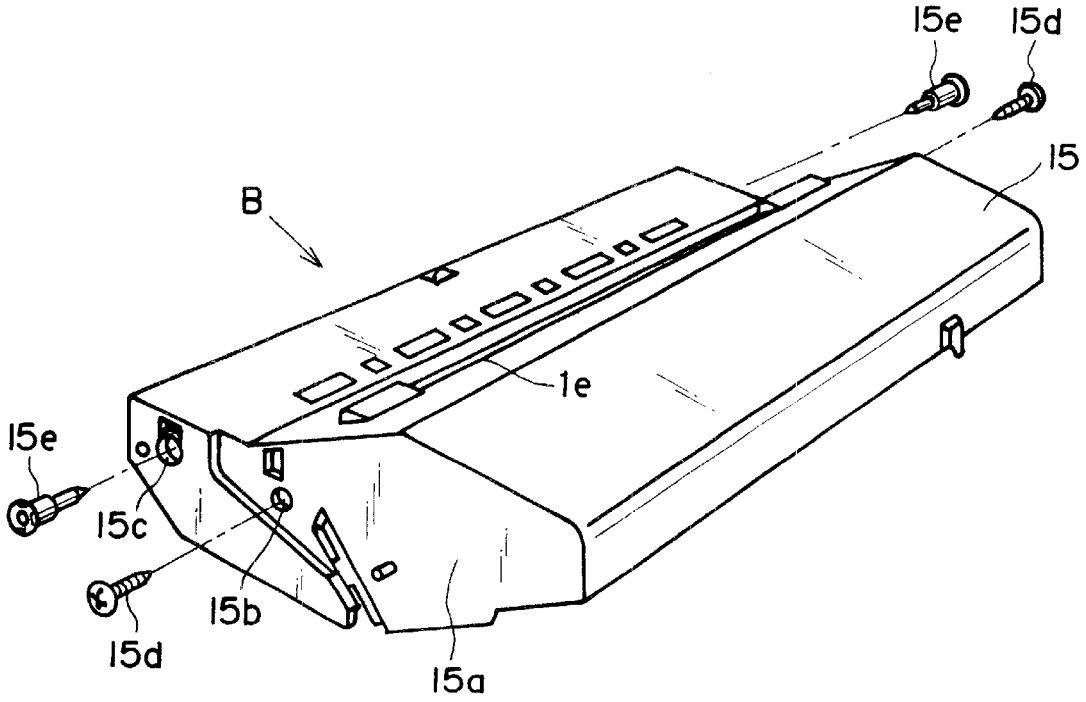
FIG. 3 is a perspective view of a process cartridge, which is for showing a disassembly or assembly process of the process cartridge.
Figure 4:
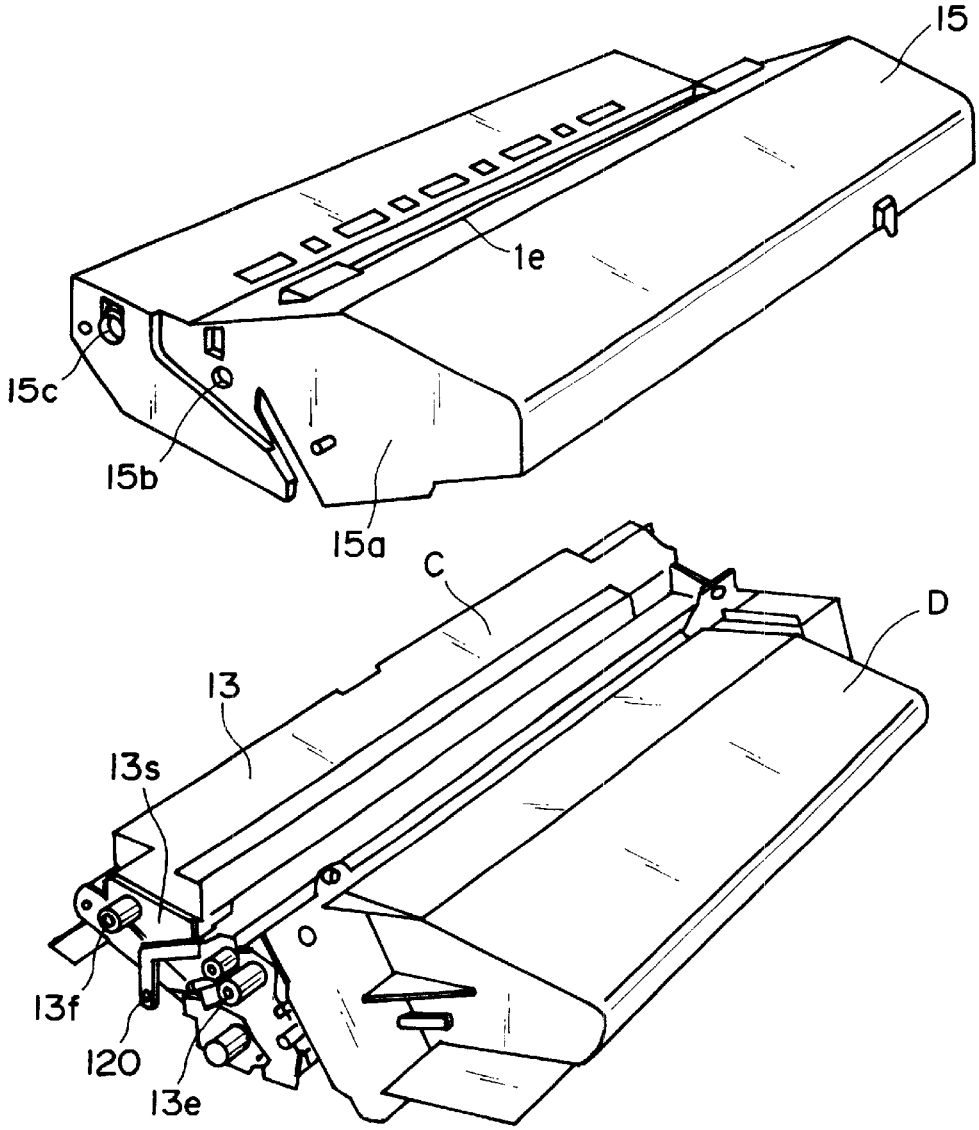
FIG. 4 is a perspective view of a process cartridge, which is for showing a disassembly or assembly process of the process cartridge.
Figure 5:
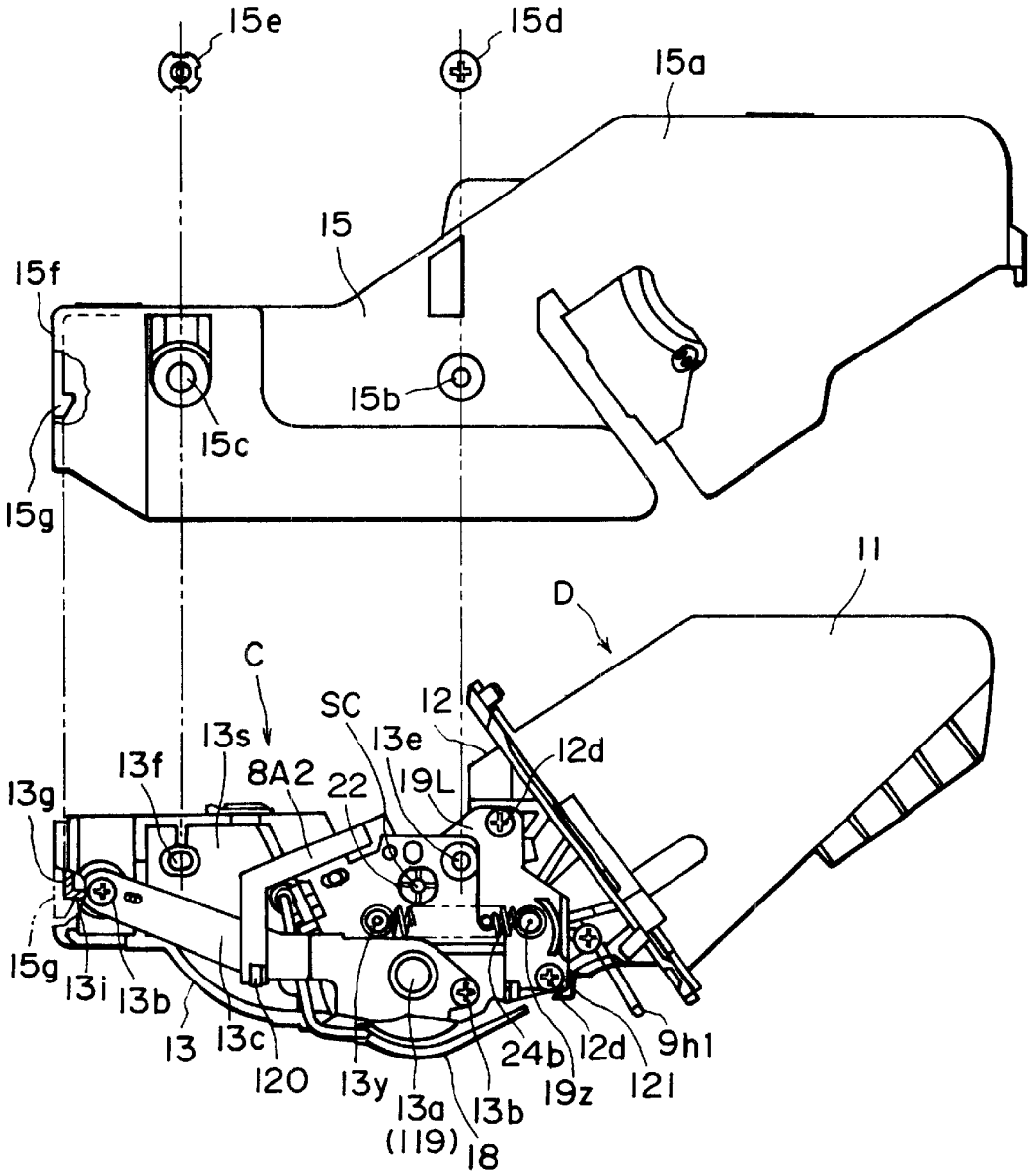
FIG. 5 is the left side view of a process cartridge, for showing a disassembly or assembly process of the process cartridge.
Figure 6:
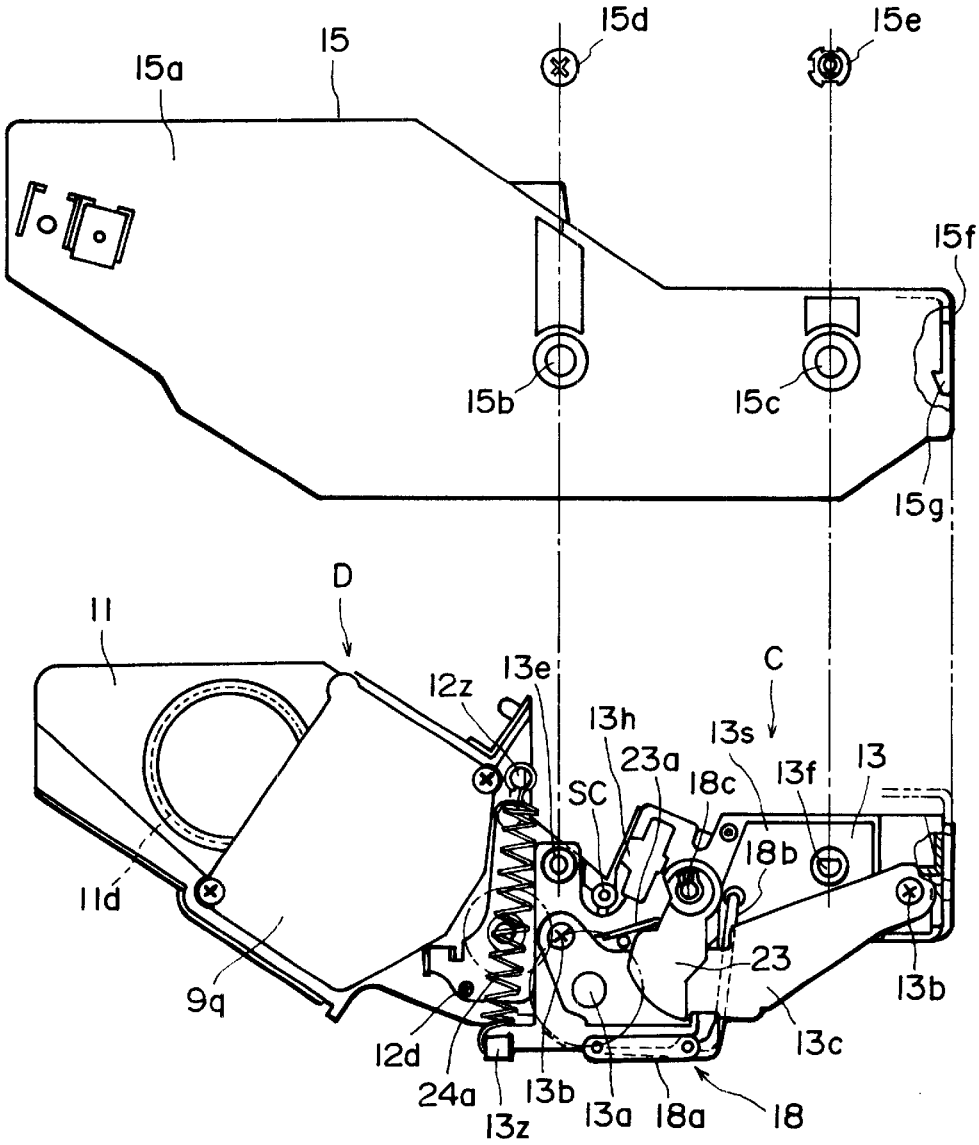
FIG. 6 is the right side view of the process cartridge, for showing a disassembly or assembly process of the process cartridge.
Figure 7:
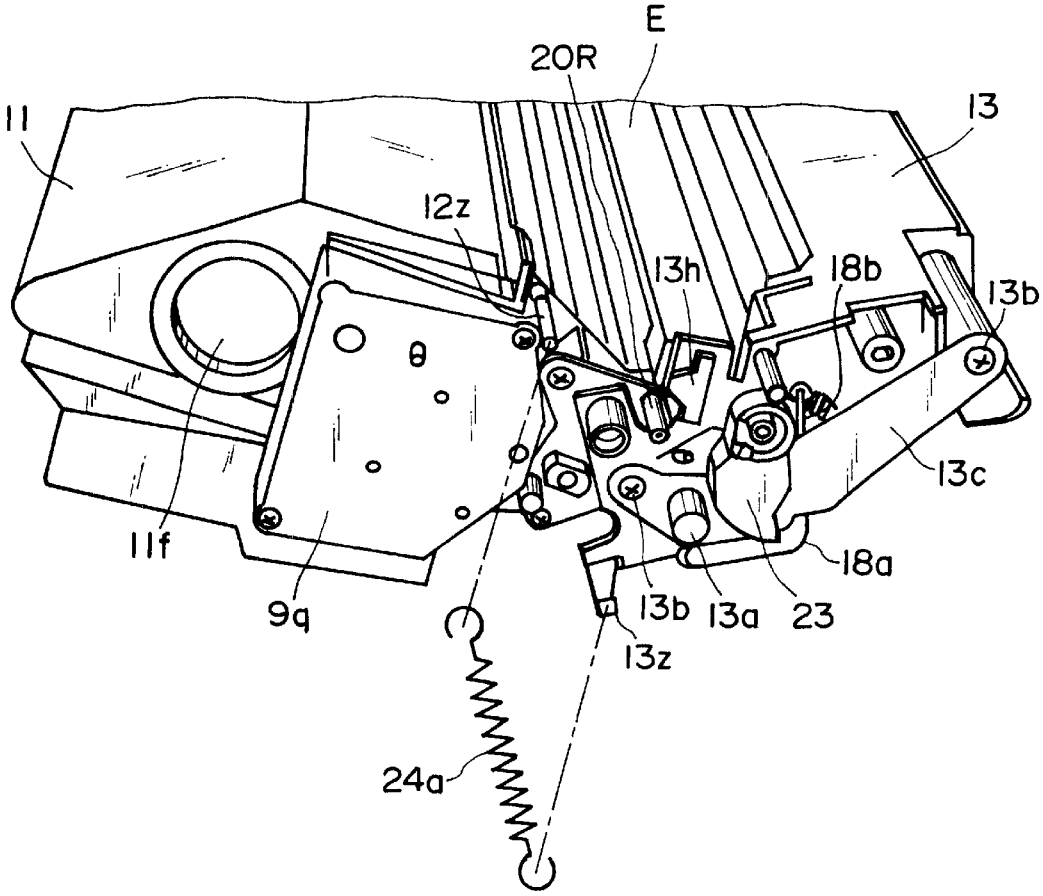
FIG. 7 is a perspective view of a unit formed by joining the cleaning and development units of the process cartridge.

FIG. 1 is a drawing for describing the structure of an electrophotographic image forming apparatus (laser beam printer in accordance with the present invention. FIGS. 2–6 are drawings related to the process cartridge in accordance with the present invention. FIG. 2 is a vertical sectional view of the process cartridge at a plane perpendicular to the longitudinal direction of the process cartridge, and FIG. 3 is a perspective view of the process cartridge. FIG. 4 is a perspective view of the process cartridge in a partially disassembled condition, and FIG. 5 is the left side view of the process cartridge in a partially disassembled condition. FIG. 6 is a right side view of the process cartridge in a partially disassembled condition. The top surface of the process cartridge B means such a surface of the process cartridge B that will be on the top side and face upward after the proper mounting of the process cartridge B into the apparatus main assembly 14, and the bottom surface of the process cartridge B means such a surface of the process cartridge B that will be on the bottom side and faces downward after the proper mounting of the process cartridge B into the apparatus main assembly 14. The left or right side of the process cartridge B means the left or right side of the process cartridge B as seen from diagonally above the trailing side of the process cartridge B in terms of the direction in which the process cartridge B is mounted into the apparatus main assembly 14.

First, referring to FIG. 1, a laser beam printer A as an example of an electrophotographic image forming apparatus in accordance with the present invention will be described. FIG. 2 is a vertical sectional view of the process cartridge at a plane perpendicular to the longitudinal direction of the process cartridge B. As shown in FIG. 1, this laser beam printer A is an apparatus which forms an image on a piece of recording medium (for example, recording sheet, OHP sheet, fabric, or the like) with the use of an electrophotographic image formation process. It forms a visible image (hereinafter, "toner image") on an electrophotographic photosensitive member (hereinafter, "photosensitive drum") with the use of developer (hereinafter, "toner"). More specifically, the photosensitive drum is charged by the charging means, and a latent image is formed on this charged photosensitive drum by projecting a laser beam modulated with image formation data, from an optical means, onto the charged photosensitive drum. This latent image is developed into a toner image by the developing means. In synchronism with the formation of the toner image, the recording medium 2 stored in a sheet feeder cassette 3*a* is picked out and conveyed by a pickup roller 3*b*, and a pair of registration rollers 3*e*. Next, the toner image formed on the photosensitive drum 7 of the process cartridge B is transferred onto the recording medium 2 by applying voltage to the transfer roller 4 as a toner image transferring means. After the transfer of the toner image, the recording medium 2 is conveyed to a fixing means 5 by a conveyance guide 3*f*. The fixing means 5 comprises a driving roller 5*c*, and a fixing roller 5*b* which contains a heater 5*a*. As the recording medium 2 passes through the fixing means 5, the fixing means 5 fixes the toner image to the recording medium 2 by the application of heat and pressure. Thereafter, the recording medium 2 is conveyed through a reversal path 3*j*, and is discharged into a delivery tray 6, by a pair of discharging rollers 3*g*. The delivery tray 6 is located on the top side of a lid 35 for exposing or covering an opening through which the process cartridge B is mounted into, or dismounted from, the main assembly 14 of the image forming apparatus A. In this embodiment, a combination of the pickup roller 3*b*, registration roller pair 3*c*, conveyance guide 3*f*, and discharge roller pair 3*g* constitutes a conveying means 3.

In comparison, referring to FIG. 2, in process cartridge B, the photosensitive member which has a photosensitive layer 7*e* as a peripheral layer is rotated, and as the photosensitive member is rotated, its peripheral surface is uniformly charged by the application of voltage to a charge roller 8 as a charging means. Then, a latent image is formed on the peripheral surface of the photosensitive drum 7 by a laser beam L projected, while being modulated with image date, upon the photosensitive drum 7 from an optical system 1 through an exposure opening 1*e*. This latent image is developed (visualized) by a developing means 9 which uses toner. More specifically, the charge roller 8 is disposed in contact with the photosensitive drum 7, and charges the photosensitive drum 7. The charge roller 8 is rotated by the rotation of the photosensitive drum 7. The developing means 9 develops the latent image formed on the photosensitive drum 7, by supplying the photosensitive drum 7 with toner, across the region in the development station. The optical system 1 comprises an unillustrated laser diode, a polygon mirror, a lens, and a reflection mirror 1*d*.

In the developing means 9, the toner within the toner container 11A is sent to a development roller 9*c* by the rotation of a toner conveying member 9*b*. As the development roller 9*c*, which contains a stationary magnet, is rotated, a layer of toner particles triboelectrically charged by a development blade 9*d* is formed on the peripheral surface of the development roller 9*c*, by the development blade 9*d*. Toner particles are supplied to the photosensitive drum 7, across the area within the development station from this layer of toner particles; more specifically, toner particles are transferred onto the photosensitive drum 7 in accordance with the pattern of the latent image, and as a result, a toner image, that is, a visual image, is formed. The development blade 9*d* is a member for regulating the amount by which toner is coated on the peripheral surface of the development roller 9*c*. Adjacent to the development roller 9*c*, a toner stirring member 9*e* for circulating the toner within the development chamber is rotationally mounted.

The toner image formed on the photosensitive drum 7 is transferred onto the recording medium 2 by applying voltage, which is reverse in polarity compared to the toner, to the transfer roller 4. Then, the toner particles remaining on the photosensitive drum 7 are removed by a cleaning means 10. More specifically, the toner particles remaining on the photosensitive drum 7 are scraped away and are collected into a waste toner bin 10*b*, by an elastic cleaning blade 10*a* of the cleaning means 10, which is placed in contact with the photosensitive drum 7. A toner gathering member 10*c* is a member for conveying the waste toner, that is, the toner scraped down from the photosensitive drum 7 by the cleaning blade 10*a*, inward of the waste toner bin 10*b*.

The process cartridge B is a combination of a toner holding frame portion 11, which has a toner container 11A (toner storing portion) for holding toner, a developing means holding frame portion 12 which holds developing means 9 such as the development roller 9*c*, and a cleaning means holding frame 13 in which the photosensitive drum 7, cleaning means 10 such as the cleaning blade 10*a*, and charge roller 8, are mounted. In assembling the process cartridge B, the toner holding frame portion 11 and developing means holding frame portion 12 are first joined together, and the cleaning means holding frame portion 13 is attached to the combination of the frame portions 11 and 12. The combination of the three frame portions 11, 12 and 13 is covered with a cartridge cover 15. The process cartridge B is removably mountable in the apparatus main assembly 14 by an operator.

The process cartridge B is provided with the exposure opening 1*e*, through which a beam of light in accordance with the image formation information is projected onto the photosensitive drum 7, and a transfer opening 13*n*, which allows the peripheral surface of the photosensitive drum 7 to be squarely placed against the recovering medium 2. More precisely, the exposure opening 1*e* is provided on the cartridge cover 15 side, whereas the transfer opening 13*n* is formed between the developing means holding frame portion 12 and cleaning means holding frame portion 13.

Next, the structure of the housing of the process cartridge B in accordance with the present invention will be described. The process cartridge B in accordance with the present invention comprises a housing, and the aforementioned photosensitive drum 7, charge roller 8, developing means 9, cleaning means 10, and the like, which are mounted in the housing. The housing is a combination of the toner holding frame portion 11, developing means holding frame portion 12, and cleaning means holding frame portion 13. In production, the toner holding frame portion 11 and developing means holding frame portion 12 are joined to each other, and the cleaning means holding frame portion 13 is pivotally attached. Then, the combination of the three frame portions 11, 12 and 13 is covered with the cartridge cover 15. The process cartridge B is removably mounted in the cartridge mounting means provided within the apparatus main assembly 14.

{Housing Structure of Process Cartridge B}

As described above, the process cartridge B in accordance with the present invention comprises a housing mad up of a joined combination of toner holding frame portion 11, developing means holding frame portion 12, and cleaning means holding frame portion 13, and the cartridge cover 15 which covers the joined combination. Next, the structure of this housing will be described.

Referring to FIG. 2, to the toner holding frame portion 11, the toner conveying member 9*b* is rotationally attached. The toner conveying member 9*b* comprises a crank 9*b*1, and a slider 9*b*2 engaged with the pin portion of the crank 9*b*1. To the developing means holding frame portion 12, the development roller 9*c*, development blade 9*d*, and toner stirring member 9*c* are attached; the toner stirring member 9*c* is rotationally mounted adjacent to the development roller 9*c* to circulate the toner within the development chamber. Also attached to the developing means holding frame portion 12 is a rod antenna 9*h* which is positioned approximately in parallel to the longitudinal direction of the development roller 9*c*. After the placement of these components, the toner holding frame portion 11 and developing means holding frame portion 12 are welded to each other, with the interposition of a cover film plate 53, forming a monolithic second portion, or the development unit D, of the process cartridge B.

To the cleaning means holding frame portion 13, photosensitive drum 7, charge roller 8, and various components of the cleaning member 10, are attached. Also attached to the cleaning means holding frame portion 13 is a drum shutter 18, which covers the photosensitive drum 7 to prevent the photosensitive drum 7 from being exposed to light for an extended period of time, and from coming into contact with foreign substances, forming together a first portion, or the cleaning unit C (FIG. 5), of the process cartridge B.

Figure 11:
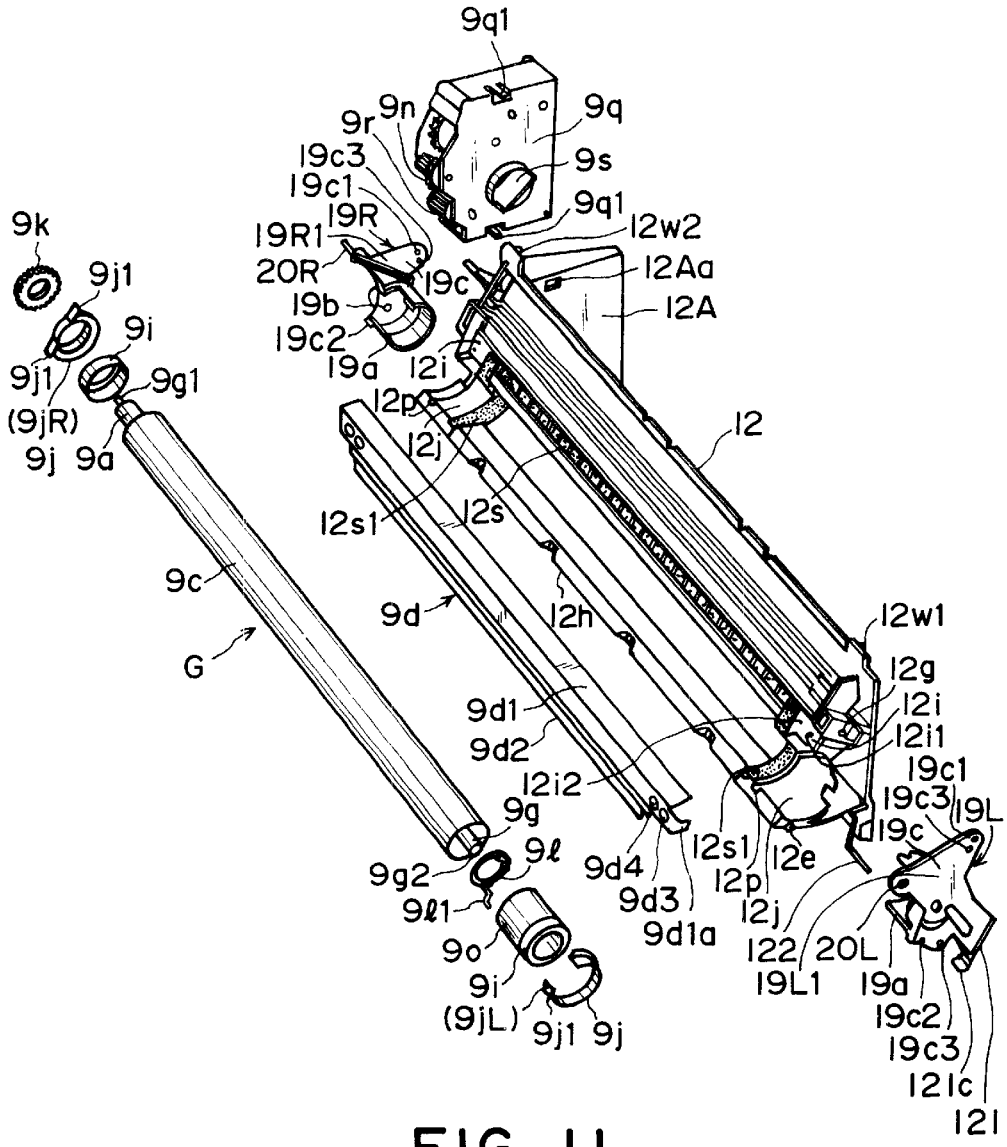
FIG. 11 is an exploded perspective view of the partially disassembled development unit.

The development unit D and cleaning unit C are connected to each other in such a manner that they are allowed to pivot relative to each other about a pivotal axis SC (FIGS. 5 and 6), constituting the essential portion of the process cartridge B. More specifically, referring to FIG. 8, the developing means holding frame portion 12 is provided with arms 19R and 19L, which are attached to the longitudinal (axial direction of development roller 9*c*) ends of the developing means holding frame portion 12 one for one. The end portions 19R1 and 19L1 of the arms 19R and 19L are provided with a rotational shaft 20R and a hole 20L, respectively (FIG. 11). These arms 19R and 19L are placed between the mutually facing side plates 13*s* of the cleaning means holding frame portion 13. One of the longitudinal ends of the cleaning means holding frame portion 13 is provided with a U-shaped slot 21R, in which the aforementioned rotational shaft 20R is fitted to be accurately positioned (see the intersectional point between the axial line of the rotational shaft and the side plate 13*e*).

The hole 21L is positioned so that its axial line coincides with the line which is parallel to the photosensitive drum 7 and runs through the center of the arc, that is, the shape of the bottom portion of the U-shaped slot 21R. It should be noted here that the slot 21R and hole 21L are provided in the right and left side plates 13*s* of the cleaning means holding frame portion 13, respectively. The aforementioned rotational shaft 20R is fitted in the slot 21R, and a connecting pin 22 (FIG. 5) is pressed into the hole 20L located at the end portion 19L1 of the arm 19L through the hole 21L of the side plate 13*e* of the cleaning means holding frame portion 13. As a result, the development unit D are cleaning unit C are connected to each other, being allowed to pivot relative to each other about the pivotal axis SC. Between the two units, a pair of tensional coil springs 24*a* and 24*b* (see FIG. 5 for 24*b*) are placed to keep the two units pulled toward each other to assure that the development roller 9*c* and photosensitive drum 7 are kept pressed toward each other. Thus, with the provision of spacer rings 9*i* (FIG. 11), which are larger in diameter than the development roller 9*c* and fitted around the longitudinal end portions of the development roller 9*c*, the spacer rings 9*i* are kept pressed upon the photosensitive drum 7, maintaining a predetermined gap (approximately 300 $\mu$m) between the photosensitive drum 7 and development roller 9*c*. With the provision of the above described structural arrangement, the development unit D and cleaning unit C are pivotable about the rotational shaft 20R and connecting pin 22, and in addition, the resilience of the tensional coil springs 24*a* and 24*b* makes it possible to maintain the predetermined positional relationship between the peripheral surfaces of the photosensitive drum 7 and development roller 9*c*. These tensional coil springs 24*a* and 24*b* are positioned so that they intersect with the line perpendicular connecting the interface between the photosensitive drum 7 and development roller 9*c*, and the pivotal axis SC about which the development unit D and cleaning unit C pivot relative to each other.

{Guiding Means Structure of Process Cartridge}

Next, the means for guiding the process cartridge B when the process cartridge B is mounted into, or dismounted from, the apparatus main assembly 14 will be described.

This guiding means is illustrated in FIGS. 5 and 6. FIGS. 5 and 6 are left and right side views of the process cartridge B as seen from the trailing side (indicated by an arrow mark X in FIG. 1; as seen from the development unit side) in terms of the process cartridge mounting direction.

Referring to FIGS. 5 and 6, the process cartridge B is provided with a pair of guiding means, which are attached to the cleaning means holding frame portion 13 to guide the process cartridge B when the process cartridge B is mounted into, or dismounted from, the apparatus main assembly 14. The guiding means are cylindrical guides 13*a* as guiding members.

Figure 9:
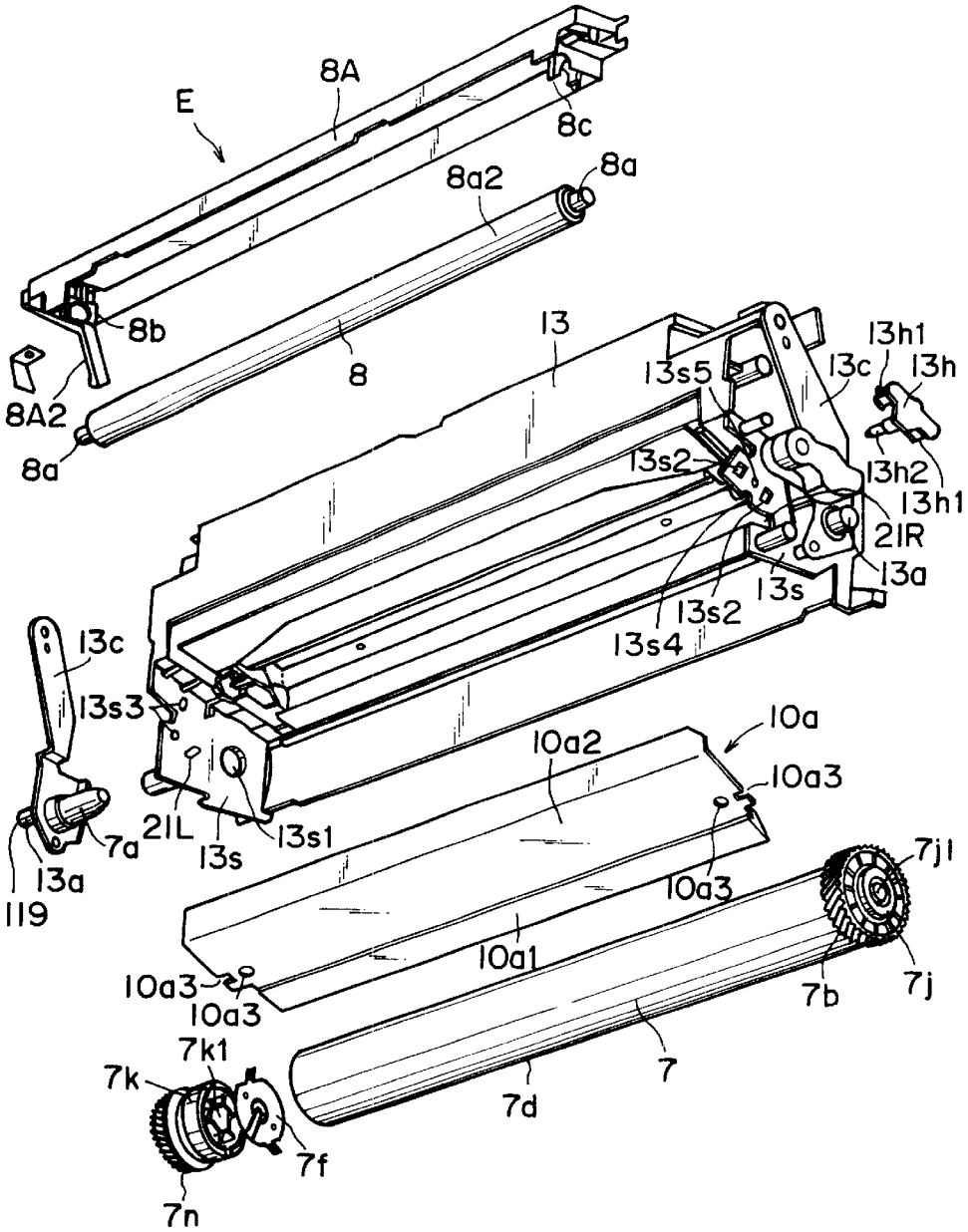
FIG. 9 is an exploded perspective view of the cleaning unit.

Each cylindrical guide 13*a*, or a cylindrical member, projects outward from the side plate of the cleaning means holding frame portion 13 so that its axial line coincides with that of the photosensitive drum 7. It doubles as a drum shaft 7*a* (its axial line coincides with that of photosensitive drum 7) which supports the photosensitive drum 7 at each longitudinal end of the photosensitive drum 7 (FIG. 9).

The cylindrical guide 13*a* is attached by crimping to a supporting plate 13*c* fixed to the side plate 13*s* of the cleaning means holding frame portion 13 with the use of small screws. The cylindrical guide 13*a* and supporting plate 13*c* are formed of metallic material. With the above structure arrangement, the photosensitive drum 7 is supported by the cleaning means holding frame portion 13, with the interposition of the supporting plate 13*c* and cylindrical guide 13*a* (doubling as drum shaft 7*a*). The drum shaft 7*a* is precisely positioned by being fitted into a hole 13*s*1 of the side plate 13*s* of the cleaning means holding frame portion 13 (FIG. 9).

The cartridge cover 15 covers the development unit D and cleaning unit C from above. It is provided with an opening 1*e*, which is located at the approximate center of the cartridge cover 15 in terms of the front to back direction (direction indicated by arrow marks K1 and K2 in FIG. 1), penetrating the cartridge cover 15 in the vertical direction. The cartridge cover 15 is a portion of the process cartridge B which not only externally protects the development unit D and cleaning unit C but also makes the process cartridge B easy to handle.

The development unit D means a unit formed by uniting the toner holding frame portion 11, which contains toner and the tone conveying member 9*b*, and the developing means holding frame portion 12 which contains the developing means 9. The cleaning unit C is a unit comprising the photosensitive drum 7, cleaning means, such as the cleaning blade, the charge roller 8, and the cleaning means holding frame portion 13 which supports the proceeding components.

The cartridge cover 15 is fixed to the cleaning means holding frame portion 13, covering the combination of the development unit D and cleaning unit C from above. Referring to FIGS. 4, 5 and 6, each of the side plates 13*s* of the cleaning means holding frame portion 13 is provided with a circular hole 13*e* and an elongated hole 13*f*. The major axis of the elongated hole 13*f* coincides with the line connecting the centers of the circular hole 13*c* and elongated hole 13*f*.

The cartridge cover 15 is provided with through holes 15*b* and 15*c*, which are in each of the side plats 15*a* located one for one at the longitudinal ends of the cartridge cover 15. The through holes 15*b* and 15*c* are positioned in such a manner that as the cartridge cover 15 is placed in a manner to cover the united combination of the development unit D and cleaning unit C, the through holes 15*b* and 15*c* align with the circular hole 13*e* and elongated hole 13*f* of the cleaning means holding frame portion 13, allowing a small screw 15*d* to be screwed into the circular hole 13*e* through the through hole 15*b*, and a pin 15*e* to be inserted into the elongated hole 13*f* after being pressed through the through hole 15*c*. In order to simplify process cartridge assembly, the cartridge cover 15 is provided with a hook 15*g* formed by cutting two slits upward from the bottom side of the front wall 15*f*, in terms of the direction in which the process cartridge B is mounted into the laser beam printer A, of the cartridge cover 15. When the cartridge cover 15 is placed over the united combination of the development unit D and cleaning unit C, this hook 15*g* engages, with its end portion flexing outward, in a groove 13*g* (FIG. 5), which is provided in the front wall of the cleaning means holding frame portion 13. As the hook 15*g* passes the groove 13*g*, the end portion of the hook 15*g* anchors itself to the bottom surface 13*i* of the front wall of the cleaning means holding frame portion 13, fixing the positional relation of the cartridge cover 15 relative to the cleaning unit C in terms of the longitudinal direction, front to back direction, and horizontal direction, and therefore, aligning the through holes 15*b* and 15*c* of the cartridge cover 15 with the circular hole 13*e* and elongated hole 13*f* of the cleaning means holding frame portion 13. As a result, process cartridge assembly is simplified.

The process cartridge B structured as described above is mounted in the laser beam printer A illustrated in FIG. 1. The laser beam printer A is provided with the lid 35 hinged to the apparatus main assembly 14, at a supporting point 35*a* located at the bottom end of the front side, in terms of the direction indicated by the arrow mark K1, of the apparatus main assembly 14. The lid 35 normally remains in the closed state (state represented by the solid line in the drawing), and is opened when the process cartridge B is exchanged, when it is necessary to take care of a jam of the recording medium 2, such as a piece of paper, that is, an object on which an image is formed, or in the like situations (state represented by the double dot chain line in the drawing). The process cartridge B is temporarily held by the open lid 35. More specifically, the lid 35 is provided with brackets 35*b* and 35*c*, which are located in the bottom portions of the lid 35, any by which the process cartridge B is supported.

As the lid 35 is closed, the cylindrical guides 13*a* of the process cartridge B, the axial lines of which coincide with that of the photosensitive drum 7, fit into positioning grooves (unillustrated) located at predetermined positions within the by the unillustrated stationary portions of the apparatus main assembly 14. As a result, the position and attitude of the process cartridge B becomes fixed. At the mounted the position and attitude of the process cartridge B becomes fixed, the lid has not been completely closed, and as the lid 35 is fully closed, the bottom portions of the brackets 35*b* and 35*c*, which are supporting the process cartridge B, move farther downward away from the process cartridge B. The reflection mirror 1*d* is fixed to the lid 35, and as the lid 35 is completely closed, it is enabled to reflect the laser beam L toward the image formation area of the photosensitive drum 7.

As the process cartridge B is inserted into the apparatus main assembly 14, a drum gear 7*b* (FIGS. 8 and 9) attached to one of the longitudinal ends of the photosensitive drum 7 meshes with an unillustrated driving gear provided on the apparatus main assembly side. As a result, it becomes possible for the process cartridge B to be driven from the apparatus main assembly side.

Referring to FIG. 2, a charge unit E comprises the charge roller 8. The charge roller 8 comprises a shaft 8*a*, and an elastic member 8*a*2 solidly formed around the shaft 8*a*. It is kept pressed upon the photosensitive drum 7. More specifically, a charging means holding frame portion 8A is fixed to the cleaning means holding frame portion 13, and a pair of charge roller bearings 8*b* are slidably fitted in a pair of parallel guide grooves 8A1 of the charging means holding frame portion 8A, which is located one for one at the longitudinal ends of the charging means holding frame portion 8A. The shaft 8*a* of the charge roller 8 is rotationally supported by this pair of bearings 8*b*. Between the charge roller bearings 8*c* and charging means holding frame portion 8A, a pair of compression coil springs 8*c* are placed in the compressed state.

The positional relationship among the photosensitive drum 7, charge roller 8, and guide grooves 8A1 is such that the plane connecting the axial lines of the photosensitive drum 7 and charge roller 8 divides the guide grooves 8A1 into approximately symmetrical halves, and is parallel to the guide grooves 8A1.

Referring to FIG. 9, the charge unit E is attached to the cleaning means holding frame portion 13 in the following manner. First, the charging means holding frame portion 8A is placed between the two side plates 13*s* in the longitudinal direction of the process cartridge B, with an unillustrated joggle provided on one of the longitudinal ends of the charging means holding frame portion 8A being inserted into a hole 13*s*3 of one of the side plate 13*s* of the cleaning means holding frame portion 13. Then, the snap-fit claw 13*h*1 of a fastener 13*h* is inserted into the hole 13*s*2 of the other side plate 13*s* of the cleaning means holding frame portion 13. Then, an unillustrated pin is fitted in a hole in the same end of the charging means holding frame portion 8A, through a hole 13*s*5 of the same side plate 13*s* as the side plate 13*s* with the hole 13*s*2, and a pin 13*h*2 is engaged into the slot 13*s* of the side plate 13*s*4 in parallel to the aforementioned unillustrated pin.

The process cartridge B is provided with the drum shutter 18 (FIG. 16) which exposes or covers the transfer opening 13*n* by being moved by the movement of the process cartridge B during the mounting or dismounting of the process cartridge B, respectively. The drum shutter 18 is structured so that when the process cartridge B is out of the apparatus main assembly 14, the drum shutter 18 remains closed to protect the image transfer area of the photosensitive drum 7. Referring to FIG. 6, the drum shutter 18 is attached to the end portion of an arm 18*a*, and the end portion of a linking member 18*b*, and the arm 18*a* and linking member 18*b* are rotationally supported by the cleaning means holding frame portion 13. The arm 18*a*, linking member 18*b*, drum shutter 18, and cleaning means holding frame portion 13 constitute together a quadri-joint mechanism. The drum shutter 18 opens as the process cartridge B is inserted further into the apparatus main assembly 14, in the downward direction (direction in which lid 35 is closed), in FIG. 5, after the lever 23, the base portion of which is fixed to the supporting point 18*c* at which the arm 18*a* is supported by the cleaning means holding frame portion 13, comes into contact with a stationary stopper (unillustrated) with which the apparatus main assembly 14 is provided. The drum shutter 18 is closed by the resiliency of a torsional coil spring 23*a*, as the process cartridge B is taken out of the apparatus main assembly 14. The torsional coil spring 23*a* is anchored to the supporting point 18*c* to keep the shutter arm 18*a* pressed in the clockwise direction (direction in which shutter 18 is closed).

Next, a case in which the process cartridge B is taken out of the apparatus main assembly 14 will be described.

As the lid 35 is rotated upward about the supporting point 35*a*, the brackets 35*b* and 35*c* come into contact with the cleaning means holding frame portion 13 and a portion of the cartridge cover 15. Then, as the lid 35 is rotated further, the cylindrical guide 13*a* comes out of the positioning guide groove (unillustrated) of the apparatus main assembly 14, and at the same time, the portion of the cartridge cover 15, which has been supported by the apparatus main assembly 14, separates upward from the unillustrated stationary process cartridge supporting portion of the apparatus main assembly 14. Then, after the lid 35 is fully opened, the process cartridge B is pulled diagonally upward in the rightward direction of FIG. 1. As the process cartridge B is pulled in the above described direction, the process cartridge B comes out of the apparatus main assembly 14. As for the shutter 18, it is rotationally moved by the resiliency of the torsional coil spring 23*a* to cover the transfer opening 13*n*, as the process cartridge B is moved upward in the apparatus main assembly 14.

Figure 8:
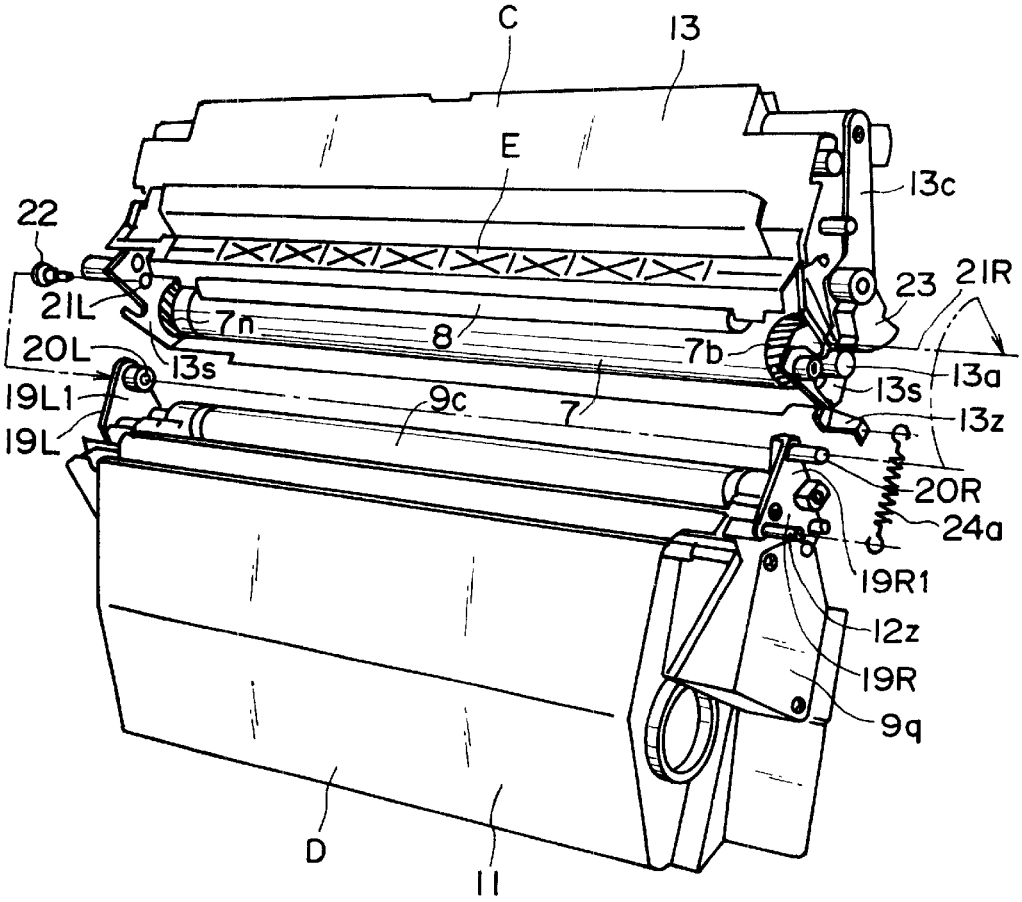
FIG. 8 is a perspective view of a unit formed by joining the cleaning and development units of the process cartridge.

Referring to FIG. 8, the longitudinal end of the photosensitive drum 7, which is not the longitudinal end with the helical drum gear 7*b*, is provided with a helical gear 7*n*, which transmits driving force to the transfer roller 4 from the process cartridge B. As the process cartridge B is inserted into the apparatus main assembly 14, the helical gear 7*n* meshes with a gear (unillustrated) provided on the apparatus main assembly side. The helical gear 7*n* and the unillustrated gear on the apparatus main assembly side share the same rotational axle. The drum gear 7*b* and helical gear 7*n* are opposite in the helix direction. Therefore, the thrusts which apply to the gears 7*b* and 7*n* are the same in direction with respect to the photosensitive drum 7. A referential code 9*k* in FIG. 1 designates a helical gear attached to one of the longitudinal ends of the development roller 9*c*. The helical gear 9*k* meshes with the aforementioned helical drum gear 7*b*, so that the force for rotating the development roller 9*c* is transmitted to the helical gear 9*k* from the helical drum gear 7*b*.

{Toner Holding Frame Portion}

Figure 10:
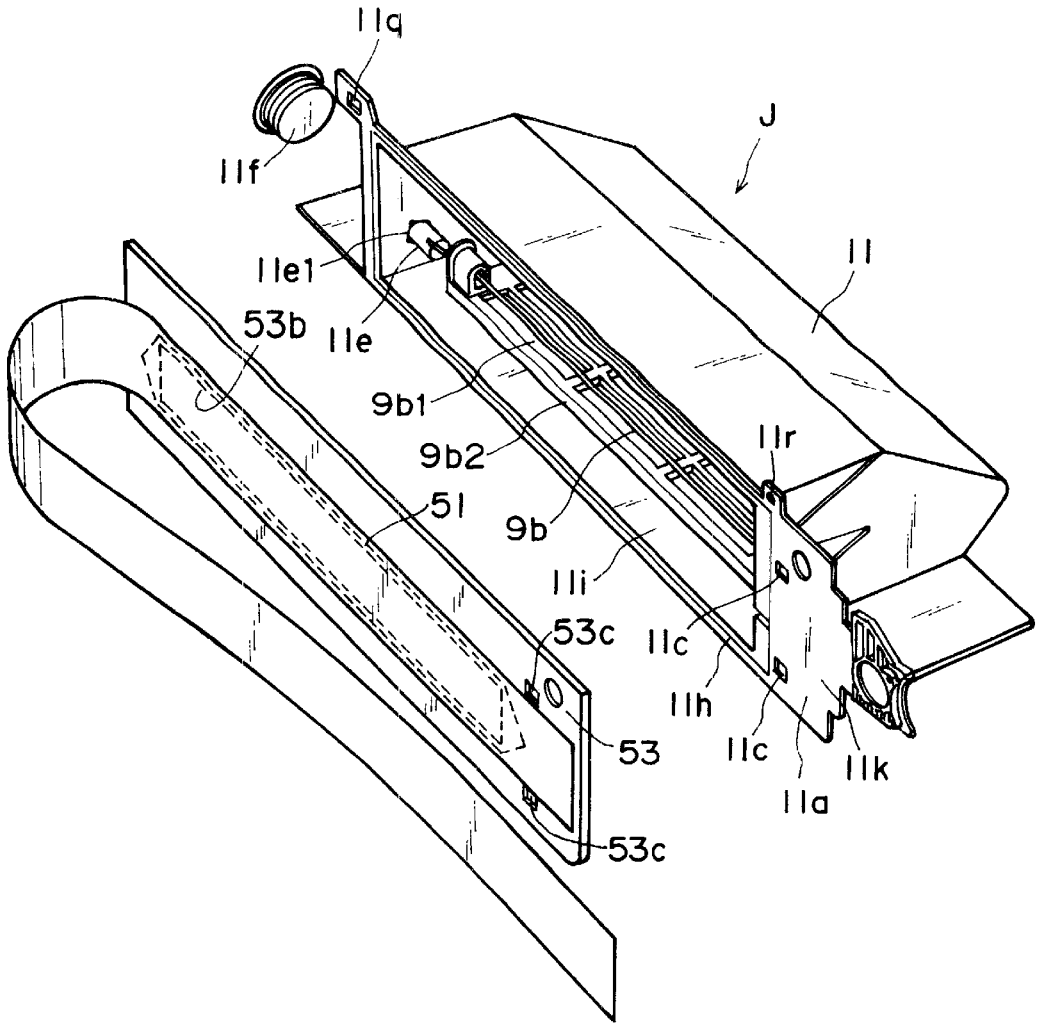
FIG. 10 is an exploded perspective view of the toner container side of the development unit.

Next, referring to FIG. 10, the toner holding frame portion 11 with be described in detail.

The toner holding frame portion is a single piece component. Prior to the welding of the cover film plate 53, to which a sealing film 51 has been pasted, to the toner holding frame portion 11, the toner conveying member 9*b* is assembled into the toner holding frame portion 11, and a coupling 11*e* is attached to the end portion of the toner conveying member 9*b* through a hole 11*e*1 from outward side of the hole 11*c*1 (state illustrated in FIG. 10). The hole 11*e*1 is in one of the side plates of the toner holding frame portion 11 at the longitudinal end. The side plate with the hole 11*e*1 is also provided with a circular hole 11*d* (FIG. 6) through which toner is filled; the hole 11*e*1 and toner filling hole 11*d* are next to each other. Further, the toner holding frame portion 11 is provided with a hole 11*i* through which toner is conveyed from the toner holding frame portion 11 to the developing means holding frame portion 12. The cover film plate 53 with a sealing film 51 is welded in a manner to block this hole 11*i*. Therefore, toner is filled through the toner filling hole 11*d*, and then, the toner filling hole 11*d* is plugged with a toner cap 11*f*, comprising a toner unit J. The toner cap 11*f* is formed of soft material such as polyethylene or polypropylene, and is pressed into the toner filling hole 11*d* of the toner holding frame portion 11 so that it does not become unplugged. The toner unit J is welded to the developing means holding frame portion 12, which will be described later, with the interposition of the cover film plates 53, by ultrasonic waves, forming the development unit D. Incidentally, selection of the method for joining them is not limited to ultrasonic welding;they may be joined by gluing, snap-fitting, or the like.

The toner conveying member 9*b* comprises the crank 9*b*1, which is formed of ferric rod or the like, approximately 3 mm in diameter, and the slider 9*b*2 which is reciprocally moved by the crank pin of the crank 9*b*1. One of the journal portions of the crank 9*b*1 of the toner conveying member 9*b* is fitted a hole in the inward side, that is, the side facing the opening 11*i*, of the end plate of the tone holding frame portion 11, and the other journal portion is fastened to the coupling 11*e*.

{Structure of Joint Portion Between Toner Holding Frame Portion and Developing Means Holding Frame Portion}

Referring to FIGS. 2 and 10, the portion of the toner holding frame portion 11, which is joined with the corresponding portion of the developing means holding frame portion 12, is provided with the opening 11*i* through which toner is sent from the toner holding frame portion 11 into the developing means holding frame portion 12. The opening 11*i* is surrounded with a flange 11*a* with a flat surface 11*k*. To this flat surface 11*k*, the cover film plate 53 is welded. Therefore, the surface 11*k* of the flange 11*a* is provided with a ridge 11*h* for welding the cover film plate 53 to the toner holding frame portion 11. The ridge 11*h* extends in a manner to surround the opening 11*i*.

Figure 13:
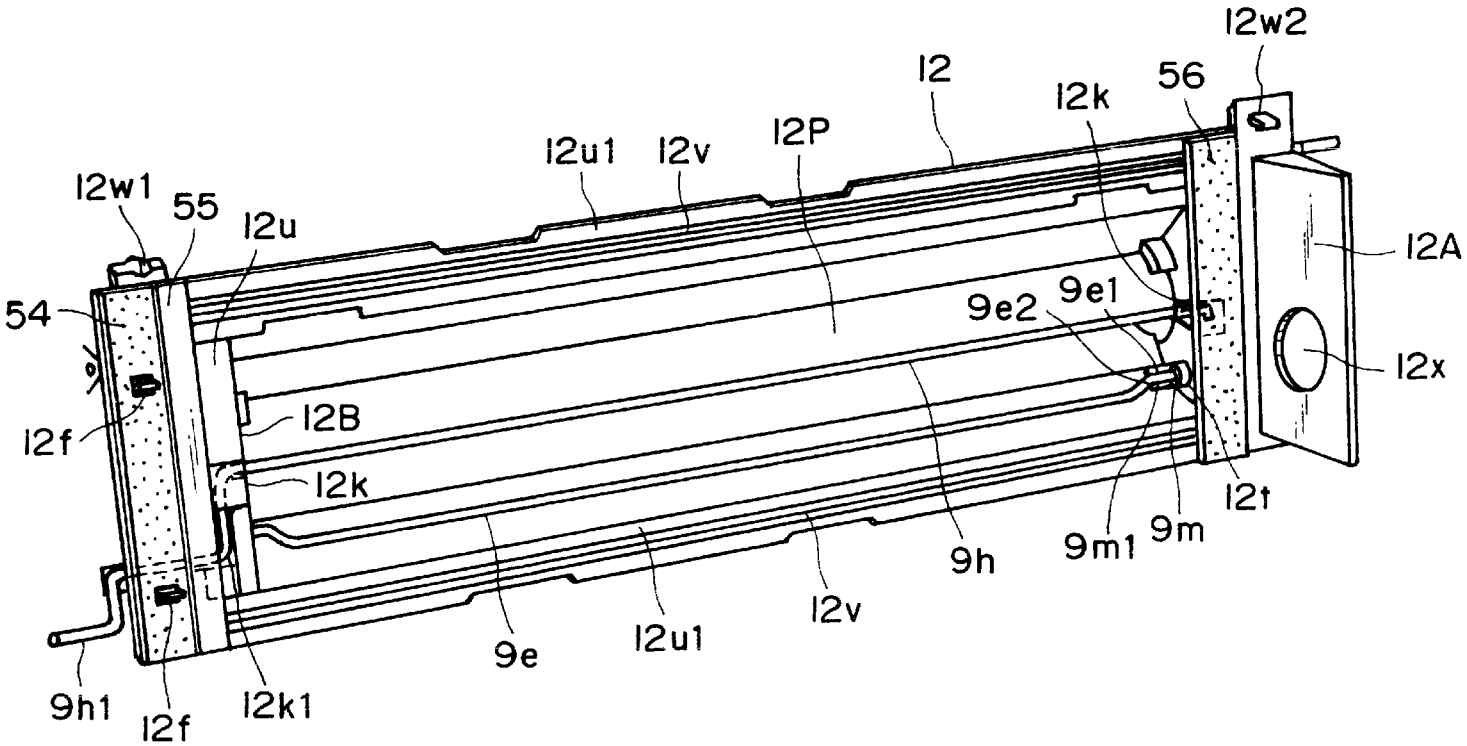
FIG. 13 is a perspective view of the developing means holding frame portion.

Referring to FIG. 13, the shutter of the developing means holding frame portion 12, which is joined with the corresponding surface of the toner holding frame portion 11, constitutes an approximately flat surface 12*u*, which is provided with a pair of triangular ridges 12*v* which extend along the longitudinal edges of the flat surface 12*u*. More specifically, the triangular ridges 12*v* are on the flat surface 12*u*1, which is slightly elevated from the mid section of the flat surface 12*u*. Thus, the toner holding frame portion 11 to which the cover film plate 53 has been welded, and the developing means holding frame portion 12, are welded by ultrasonic waves, along their longitudinal edges, with the ridges 12*v* of the developing means holding frame portion 12 kept pressed upon the cover film film plate 53.

Figure 12:
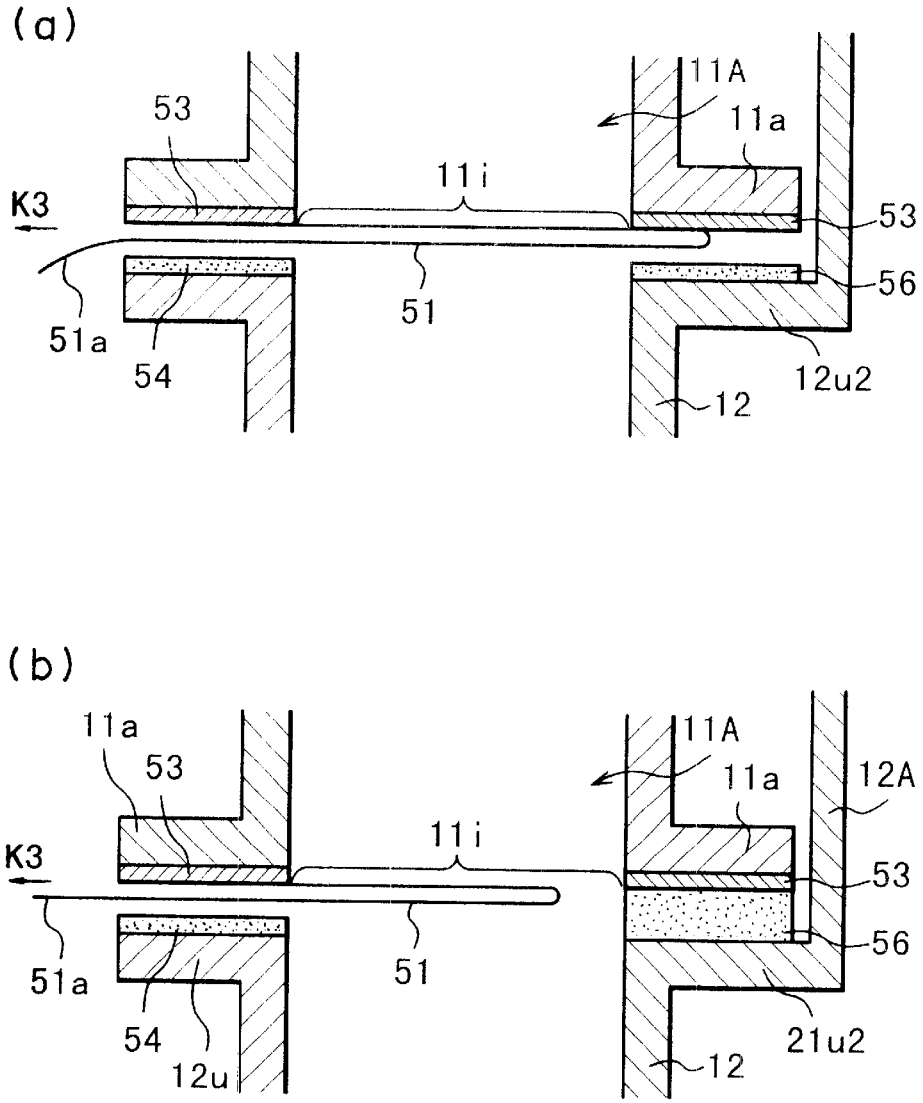
FIGS. 12(*a*) and 12(*b*) are horizontal sectional views of the toner release opening portion of the toner holding frame portion, which show how the toner releasing opening is hermetically sealed.

Referring to FIG. 10, the cover film plate 53 which is welded to the toner holding frame portion 11 is provided with two holes 53*c*, and the flange 11*a* of the toner holding frame portion 11 is provided with holes 11*c*. As the cover film plate 53 is pasted to the surface 11*k* of the flange 11*a*, the holes 53*c* of the cover film plate 53 align with the holes 11*c* of the flange 11*a*. Further, the cover film plate 53 is provided with a hole 53*b* (smaller than the aforementioned hole 11*i*) which corresponds to the hole 11*i*. This hole 53*b* is blocked by the sealing film pasted to the cover film plate 53. The sealing film is easy to tear in its longitudinal direction. More specifically, the sealing film is pasted to the cover film plate 53, along the surrounding four edges of the hole 53*b*. In order to make it easier to expose the opening 53*b*, a portion of the sealing film 51 is extended out of the process cartridge B; the sealing film 51 is rendered long enough to be pasted to the cover film plate 53 from one longitudinal end to the other to cover the hole 53*b*, doubled back to the starting end, and extended beyond the starting end to be exposed from the process cartridge B, through the interface between an elastic sealing member 54 (FIGS. 12 and 13) with which the developing means holding frame portion 12 is provided, and the cover film 53 (FIG. 12). The elastic member 54 is formed of felt or the like material and is pasted to the developing means holding frame portion 12, on the flat surface which is located at one of the longitudinal ends of the developing means holding frame portion 12. This flat surface is the counterpart of the cover film plate 53 fixed to the toner holding frame portion 11. Incidentally, in FIG. 12, in order to make it easier to understand the arrangement, gaps are shown between the sealing film 51 and cover film plate 53, and between the sealing film 51 and elastic sealing member 54. The elastic sealing member 54 keeps the sealing film 51 pressed upon the cover film plate 53. Referring to FIG. 13. pasted to the inward side of the surface of the elastic sealing member 54 is a tape 55 formed of synthetic resin film which is low in coefficient of friction. Further, an elastic sealing member 56 is pasted to a flat surface 12*u* located at the other longitudinal end of the cover film plate 53, that is, the longitudinal end opposite to where the elastic sealing member 54 is pasted (FIGS. 12 and 13).

In order to make it easier to align the toner holding frame portion 11 and developing means holding frame portion 12 when joining them, the flange 11*a* of the toner holding frame portion 11 is provided with a round hole 11*r* and a square hole 11*q*, into which a cylindrical joggle 12*w*1 and a square joggle 12*w*2 of the developing means holding frame portion 12, fit (FIG. 10). The joggle 12*w*1 tightly fits in the round hole 11*r*, whereas the joggle 12*w*2 loosely fits in the square hole 11*q*, being afforded a small amount of tolerance in the longitudinal direction. The sealing members 54 and 56 are adhered to the flat surface 12*u*, extending beyond the ridge 12*v* in terms of the widthwise direction of the process cartridge B. Further, the developing means holding frame portion 12 is provided with a pair of joggles 12*f*, which loosely fit in the aforementioned hole 53*c* of the cover film plate 53 and hole 11*c* of the toner holding frame portion 11. The sealing member 54 is penetrated by these joggles 12*f*.

The toner holding frame portion 11 and developing means holding frame portion 12 are assembled as independent units before they are joined. Thereafter, the cylindrical positioning joggle 12*w*1 and square positioning joggle 12*w*2 of the developing means holding frame portion 12 are fitted into the round positioning hole 11*r* and square positioning hole 11*q* of the toner holding frame portion 11, and the toner holding frame portion 11 and developing means holding frame portion 12 are pressed against each other, causing the sealing members 54 and 56 to be compressed. As the sealing members 54 and 56 are compressed, the pair of ridges 12*v*, which are integrally formed parts of the developing means holding frame portion 12 and extend on the flat surface 12*u* along the longitudinal edges of the developing means holding frame portion 12, one for one, are pressed upon the surface of cover film plate 53. It should be noted here that the aforementioned pair of joggles 12*f* are positioned across the path of the sealing film 51, being separated by a distance equal to the width of the sealing film 51, to regulate the sealing film 51 as the sealing film 51 is pulled through.

With the toner holding frame portion 11 and developing means holding frame portion 12 kept pressed against each other, ultrasonic wave vibrations are applied between the triangular ridge 12*v* and cover film plate 53. As a result, the triangular ridge 12*v* and cover film plate 53 are welded to each other at their interface by frictional heat. Consequently, the top and bottom edges of the developing means holding frame portion 12 become fastened to the corresponding portions of the cover film plate 53, creating a sealed space between the cover film 53 and the corresponding flat surface 12*u* of the developing means holding frame portion 12. The sealing film 51 fits in this space.

In order to release the toner stored in the toner holding frame portion 11 into the developing means holding frame portion 12, an operator must manually pull the end portion 51*a* (FIG. 12) of the sealing film 51 which extends outward from the process cartridge B. As the end portion 51*a* is pulled, the sealing film 51 is peeled away from the cover film plate 53, exposing the hole 53*b* (11*i*) to allow the toner to be sent from the toner holding frame portion 11 into the developing means holding frame portion 12.

Since the mutually facing surfaces of the toner holding frame portion 11 and developing means holding frame portion 12 are structured as described above, the sealing film 51 pasted to the surface of the cover film plate 53 can be smoothly pulled out from between the two frame portions 11 and 12, simply by applying force to the cover film 51 in a manner to pull it. Further, the path between the cover film plate 53 and developing means holding frame portion 12, through which the sealing film 51 is pulled out, is provided with the aforementioned pair of joggles 12*f*, which are positioned across the path, with the provision of a distance equal to the width of the sealing film 51. Therefore, the sealing film 51 can be pulled out in a straight line.

As for the material for the toner holding frame portion 11, developing means holding frame portion 12, and cover film plate 53, plastic, for example, polystyrene, ABS resin (acrylonitrile/butadiene/styrene copolymer), polycarbonate, polyethylene, polypropylene, polyphenylene oxide, or the like, is usable.

Next, the developing means holding frame portion will be described in detail.

{Developing Means Holding Frame Portion}

Referring to FIGS. 2, 11 and 13, the developing means holding frame portion 12 will be described. FIG. 11 is an exploded perspective view of the developing means holding frame portion 12, which shows how developing means components are assembled into the developing means holding frame portion 12. FIG. 13 is a perspective view of the portion of the developing means holding frame portion 12, which faces the toner holding frame portion 11.

Into the developing means holding frame portion 12, the development roller 9*c*, development blade 9*d*, toner stirring member 9*e*, and rod antenna 9*h* for detecting the remaining amount of toner, are assembled.

The development blade 9*d* comprises an approximately 1–2 mm thick metallic plate 9*d*1, and a piece of urethane rubber 9*d*2 fastened to the metallic plate 9*d*1 with the use of hot-melting, double-sided tape, or the like. It regulates the amount by which toner is coated on the peripheral surface of the development roller 9*c*.

The developing means holding frame portion 12 is provided with two blade anchoring flat surfaces 12*i*, as blade mounts. The flatness of these flat surfaces 12*i* are regulated to approximately 0.05 mm. Each flat surface 12*i* is provided with a joggle 12*i*1 and a hole 12*i*2 with female threads. The two flat surfaces 12*i* are located at the longitudinal ends of the developing means holding frame portion 12, one for one; the flat surface 12*i*, projection 12*i*1, and hole 12*i*2 with female threads, on the left side of the developing means holding frame portion 12, and the flat surface 12*i*, projection 12*i*1, and hole 12*i*2 with female threads, on the right side of the developing means holding frame portion 12, are symmetrically positioned relative to each other. When assembling the development unit D, first, the joggle 12*i*1 is fitted into the hole 9*d*3 of the metallic plate 9*d*1. Then, the metallic plate 9*d*1 is fastened to the flat surface 12*i* by putting an unillustrated small screw through the screw hole 9*d*4 of the metallic plate 9*d*1, and screwing the small screw into the aforementioned hole 12*i*2 with female threads. The developing means holding frame portion 12 is provided with an elastic seal 12*s* formed of MOLTOPREN, or the like. The elastic seal 12*s* is pasted to the developing means holding frame portion 12, along the longitudinal edge corresponding to the top edge of the metallic plate 9*d*1, to prevent toner invasion. It is kept compressed by the metallic plate 9*d*1. Also, the developing means holding frame portion 12 is provided with two elastic seals 12*s*1, each of which is pasted to the developing means holding frame portion 12 and extends in the widthwise direction of the developing means holding frame portion 12 from the corresponding longitudinal end of the elastic seal 12*s* to the cylindrical surface 12*j*, along which the development roller 9*c* fits. Pasted to the mandible-like portion 12*h* of the developing means holding frame portion 12 is a thin elastic seal 12*s*2, which remains in contact with the development roller 9*c* at the generatrix portion of the development roller 9*c* (FIG. 2).

Figure 14:
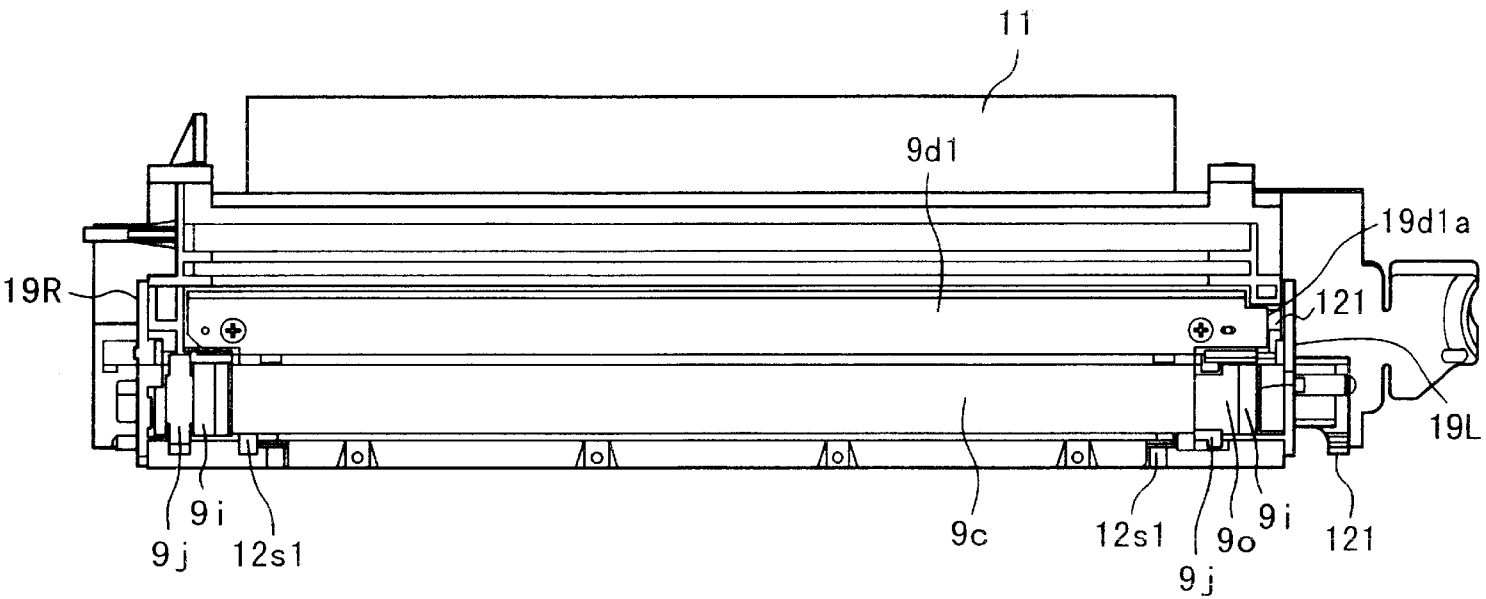
FIG. 14 is a front view of the development unit.

The metallic plate 9*d*1 of the development blade 9*d* is bent 90 deg. at one of the longitudinal ends, forming an end portion 9*d*1a This portion 9*d*1a equalizes the metallic plate 9*d*1 and development roller 9*c* in electrical potential, by contacting a development bias contact 121 (FIG. 14) supported by the aforementioned arm 19L. This arrangement is made for the following reason. That is, the toner amount is determined by detecting the change in the electrostatic capacity between the toner amount detection rod antenna 9*h* and development roller 9*c*, and therefore, this electrostatic capacity must be prevented from irregularly fluctuating due to the influence from the metallic plate 9*d*1.

Next, a development roller unit G will be described. The development roller unit G comprises: (1) the development roller 9*c* having a sleeve flange 9*a* attached to one of its longitudinal ends; (2) two spacer rings 9*i* for keeping constant the distance between the peripheral surfaces of the development roller 9*c* and photosensitive drum 7; (3) two development roller bearings 9*j* for precisely positioning the development roller 9*c* relative to the developing mean holding frame portion 12, one of the roller bearings 9*j* being fitted in a portion of the sleeve flange 9*a* smaller in diameter than the development roller 9*c*, and the other being fitted in the sleeve cap 9*o*; (4) a sleeve cap 9*o* which is an integrally formed part of one of the spacer rings 9*i*, or joined with one of the spacer rings 9*i*, and is fitted over one of the longitudinal ends of the development roller 9*c* to prevent the electrical leak which otherwise would occur between the cylindrical aluminum base A1 of the photosensitive drum 7 and the cylindrical aluminum portion of the development roller 9*c*; (5) the development roller gear 9 (helical gear) for rotating the development roller 9*c* by being driven by the helical drum gear 7*b* of the photosensitive drum 7; (6) an elastic development contact 91(e1) which is fixed to the internal surface of the end portion of the development roller 9*c*, and the actual contact portion 91(e1)1, or the arm portion, of which is in the for of a leaf spring and slides on the disc-shaped electrode (unillustrated) of the development bias contact 121; (7) a magnet 9*g* placed within the development roller 9*c* to adhere toner to the peripheral surface of the development roller 9*c*. This development roller unit G is attached to the development roller mount of the developing means holding frame portion 12. More specifically, each longitudinal end portion of the development roller unit G is fitted in the roughly semicylindrical portion 19*a* of the arm 19R (19L), with the rotation control projection 9*j*1 of each development roller bearing 9*j* aligned with the recess 12*p* of the corresponding longitudinal end portion of the developing means holding frame portion 12, and the arms 19R and 19L are attached to the developing means holding frame portion 12 with the use of screws 12*d* (FIGS. 5 and 6).

As described above, in this embodiment, when attaching the development roller 9*c* to the developing means holding frame portion 12, the development roller unit G is assembled first, and then, the assembled development roller unit G is attached to the developing means holding frame portion 12 with the interposition of the arms 19R and 19L. Using this assembly procedure improves assembly efficiency compared to an assembly procedure in which the development roller 9*c* in directly attached to the developing means holding frame portion 12.

To describe in more detail the process in which the development roller unit G is assembled, first, the magnet 9*g* is inserted into the development roller 9*c*, and the elastic development contact 91(e1) is fitted in the development roller 9*c*. Then, the sleeve cap 9*o* is fitted over one of the longitudinal ends of the development roller 9*c*, and the two spacer rings 9*i* are fitted one for one around the longitudinal ends of the development roller 9*c*. Next, the two development roller bearings 9*j* for supporting the development roller 9*c* are attached one for one to the longitudinal ends of the development roller 9*c*, and the development roller gear 9*k* is attached to one of the longitudinal ends of the development roller 9*c*, on the outward side of the bearing 9*j*. At this stage of assembly, a shaft portion 9*g*1 of the cylindrical magnet 9*g*, which is given a D-shaped cross section, is projecting from the longitudinal end of the development roller 9*c*, to which the development roller gear 9*k* has been attached, whereas the other shaft portion 9*g*2 of the cylindrical magnet 9*g* is projecting from the other longitudinal end of the development roller 9*c*. These shaft portions 9*g*1 and 9*g*2 with a D-shaped cross section are fitted in D-shaped holes 19*b* cut in the arms 19R and 19L (hole 19*b* of arm 19L is not illustrated).

Next, the rod antenna 9*h* for detecting the remaining amount of toner will be described. Referring to FIG. 13, the rod antenna 9*h* is bent at the end portion, assuming the shape of a crank. As the process cartridge B is mounted into the apparatus main assembly 14, the crank portion 9*h*1 comes into contact with a toner amount detection contact (unillustrated) attached to the apparatus main assembly 14, establishing electrical connection to the apparatus main assembly 14. The developing means holding frame portion 12 is provided with a groove 12*k* and a groove 12*k*1, which have a V-shaped cross section, and are in the side wall located at one of the longitudinal ends of the opening 12P. The grooves 12*k* and 12*k*1 are connected to each other, and the groove 12*k* is L-shaped and leads to the outward side of the developing means holding frame portion 12. The rod antenna 9*h* is fitted in these grooves 12*k* and 12*k*1, and an unillustrated plug is fitted in a groove 19*k* with a V-shaped cross section, with the addition of adhesive, to secure the rod antenna 9*h* in the grooves 12*k* and 12*k*1. As is evident from the above description, the rod antenna 9*h* is supported in the grooves 12*k* and 12*k*1 with a V-shaped cross section, being thereby accurately positioned.

Next, the toner stirring member 9*e* will be described. The toner stirring member 9*e* is in the form of a crank, and stirs toner by rotating. It is located in the toner path through which the toner stored in the toner container 11A is moved to the development roller 9*c*, as well as in the adjacencies of the development roller 9*c* and rod antenna 9*h*.

First, one of the end portions of the toner stirring member 9*e* is inserted into the developing means holding frame portion 12 through a through hole 12*t* provided in the side plate 12A of the developing means holding frame portion 12, located on the side opposite to the side from which the external contact point 9*h*1 of the aforementioned rod antenna 9*h* is extending outward from the developing means holding frame portion 12. The diameter of the through hole 12*t* is large enough for the crank portion of the toner stirring member 9*e* to be put through the side plate 12A. Next, the journal portion, or the end portion, of the inserted portion of the toner stirring member 9*e* is put through an unillustrated through hole provided in the side plate 12B of the developing means holding frame portion 12, located on the side opposite to the side where the side plate 12A of the developing means holding frame portion 12 is located. Thereafter, the unillustrated through hole of the side plate 12B is closed by melting the side plate 12B from the outward side of the side plate 13B, or by screwing a small screw into the hole. After the stirring member 9*e* is inserted into the developing means holding frame portion 12 as described above, a stirring gear 9*m* (FIG. 16) is fitted in the through hole 12*t*. During this fitting of the stirring gear 9*m*, the crank arm 9*e*2 of the toner stirring member 9*e* is fitted in the slit 9*m*1 of the gear 9*m*, which is located at the inward end of the gear 9*m* and extending in the axial direction of the gear 9*m*, as shown in FIG. 13. Further, the journal portion 9*c*1 of the toner stirring gear 9*e* is fitted in the center hole of the gear 9*m*, located at the inward end of the slit 9*m*1, to support the toner stirring member 9*e* by the developing means holding frame portion 12. The outward disengagement of the stirring gear 9*m* from the developing means holding frame portion 12 is prevented by placing the flat portion 19*c* of the arm 19R in a manner to overlap with the stirring gear 9*m* in terms of the longitudinal direction of the process cartridge B.

As the toner holding frame portion 11 and developing means holding frame portion 12 are joined, the side plate 12A of the developing means holding frame portion 12 on the side from which the aforementioned toner stirring member 9*e* is inserted, extends beyond the side plate of the toner holding frame portion 11, and covers the toner cap having been pressed into the toner holding frame portion 11. The side plate 12A is provided with a hole 12*x*, in which a toner conveyance gear 9*s*, that is, the output gear of a gear box 9*q* for transmitting driving force to the toner conveying member 9*b* and toner stirring member 9*e*, is fitted with the presence of a certain amount of play (FIG. 11). The toner conveyance gear 9*s* coupled with the coupling 11*e* (FIG. 10), which is attached to one of the longitudinal ends of the toner conveying member 9*b* and is rotationally supported by the toner holding frame portion 11, to transmit driving force to the toner conveying member 9*b*. This gear box 9*q* is attached to the side plate 12A of the developing means holding frame portion 12 by snap-fitting fitting arm 9*q*1 provided with a claw which extends toward the side plate 12A, into a hole 12Aa of the side plate 12A.

Next, the transmission of driving force will be described.

Referring to FIG. 11, rotationally supported by the gear box 9*q* is an input gear 9*n*, which meshes with the development roller gear 9*k* so that driving force is transmitted to the input gear 9*n* from the development roller 9*k*. The stirring gear 9*m* meshes with an output gear 9*r*, that is, the other gear of the gear box 9*q*. As the development roller gear 9*k* rotates by receiving driving force from the drum gear 7*b* meshed with the development roller gear 9*k*, the input gear 9*n* rotates, rotating thereby the toner conveying gear 9*s* connected to the input gear 9*n* through a gear train. As a result, driving force is transmitted to the toner conveying member 9*b*. Also, the output gear 9*r* rotates the toner stirring gear 9*m*, and as a result, the toner stirring member 9*e* rotates.

The downwardly facing surface of the mandible-like portion 12*h* of the developing means holding frame portion 12 doubles as a conveyance guide for the recording medium 2 such as a sheet of paper. Further, in order to increase the rigidity of the developing means holding frame portion 12, the developing means holding frame portion 12 is provided with a substantial number of ribs (unillustrated).

Referring to FIG. 13, a referential code 12P designates a hole, which extends in the longitudinal direction of the developing means holding frame portion 12. This hole 12P aligns with the hole 11*i* of the toner holding frame portion 11, and the hole 53*b* of the cover film plate 53, after the toner holding frame portion 11 and developing means holding frame portion 12 are joined with the interposition of the cover film plate 53. Thus, as the toner seal is removed, the toner stored in the toner holding frame portion 11 can be supplied to the development roller 9*c*. The aforementioned toner stirring member 9*e* and rod antenna 9*h* extend from one longitudinal end of the hole 12P to the other.

In this embodiment, the development roller mount, side plate 12A (gear box 9*q* mount), development blade mount (blade mounting flat surface 12*i*), antenna 9*h* mount, toner stirring member mount, and the like, of the developing means holding frame portion 12 are formed as integral parts of the developing means holding frame portion 12. The material for the developing means holding frame portion 12 is the same as the aforementioned material for the toner holding frame portion 11.

{Arms}

Next, the arms 19R and 19L will be described.

Referring to FIGS. 5, 6, 11 and 22, the arms of the process cartridge B will be described. FIG. 11 gives a perspective view of the inward side of the arm 19R which is to be attached to the developing means holding frame portion 12, on the side from which the process cartridge B is driven (hereinafter, "driven side"), as well as a perspective view of the outward side of the arm 19L which is to be attached to the developing means holding frame portion 12, on the side opposite to the driven side (hereinafter, "non-driven side").

First, the various components of the development roller unit G, which are in the state shown in FIG. 11, are assembled into the development roller unit G. Then, the arms 19R and 19L are attached to the developing means holding frame portion 12 in a manner to sandwich the assembled development roller unit G from the right and left longitudinal ends of the development roller unit G, completing the development unit D. More specifically, during this process of assembling the development unit D, first, the projection 9*j*1 of each bearing 9*j* is fitted in the recess 12*p* in such a manner that the peripheral surface of the development roller 9*c* is supported by two seals 12*s*1, and the roughly semicylindrical portions 19*a* of the arms 19R and 19L are fitted with the corresponding semicylindrical surfaces 12*j* of the developing means holding frame portion 12. As a result, the peripheral surface of each bearing 9*j* fits with the internal surface of the corresponding roughly semicylindrical portion 19*a*. As a result, the two bearings 9*j* are supported by the developing means holding frame portion 12 with the interposition of the arms 19R and 19L, one for one. The development bias contact 121 is attached to the arm 19L by snap-fitting. Each of the arms 19R and 19L is fastened to the developing means holding frame portion 12 by screwing the small screw 12*d* (FIG. 5), with the joggle 12*g* and projection 12*c* of the developing means holding frame portion 12 fitted in the hole 19*c*1 and slot 19*c*2 of the flat portion 19*c* of the corresponding arm.

The arm 19L is fitted with the development bias contact 121. More specifically, a joggle provided on the arm 19L, on the back side with respect to FIG. 11, is pressed into the slot of the contact 121.

When the process cartridge B has been properly mounted in the apparatus main assembly 14, the external contact point 121*c* of the development bias contact 121 is in contact with an unillustrated development contact of the apparatus main assembly 14, and receives from the apparatus main assembly 14 the development bias to be applied to the development roller 9*c*. After being received from the apparatus main assembly 14, the development bias is applied to the development roller 9*c* through the development bias contact 121 and elastic development contact 91(e1).

Also when the process cartridge B is properly mounted in the apparatus main assembly 14, a toner detection contact 122 and the external contact point 9*h*1 are electrically in contact with an unillustrated toner detection contact of the apparatus main assembly 14, and another unillustrated contact of the apparatus main assembly 14, respectively. Thus, electrical signals generated in accordance with the electrostatic capacity which changes in response to the change in the amount of the toner between the development roller 9*c* and rod antenna 9*h* are transmitted to an unillustrated contact of the apparatus main assembly 14 from the rod antenna 9*h*. As it is detected by the control section (unillustrated) that the value of the electrical signals has reached a predetermined one, it is displayed that the process cartridge B needs to be exchanged.

{Electrical Contact Structure}

Next, referring to FIGS. 5, 6 and 9, how the electrical contacts on the process cartridge side, and the electrical contacts on the apparatus main assembly side, which electrically connect the process cartridge B and apparatus main assembly 14, are placed in contact, and where they are positioned, will be described in more detail.

As shown in the drawings, the process cartridge B is provided with a plurality (four) of electrical contacts: (1) an electrically conductive ground contact 119 which is electrically connected to the photosensitive drum 7 to ground the photosensitive drum 7 through the apparatus main assembly 14 (one of the two cylindrical guides 13*a* doubles as the contact 119); (2) an electrically conductive charge bias contact 120 which is electrically connected to the charge roller shaft 8*a* to apply charge bias to the charge roller 8 from the apparatus main assembly 14; (3) an electrically conductive development bias contact 121 which is electrically connected to the development roller 9*c* to apply development bias to the development roller 9*c* from the apparatus main assembly 14; (4) the toner remainder amount detection contact 9*h*1, that is, the external contact portion 9*h*1 of the rod antenna 9*h*, for detecting the remaining amount of toner. These four contacts are positioned in a manner to be exposed from the side wall (left side) of the cartridge frame, holding proper distances among them to prevent electrical leakage among them. Also as described above, the ground contact 119 and charge bias contact 120 belong to the cleaning means holding frame portion 13, and the development bias contact 121 and toner remainder amount detection contact 9*h*1 belong to the development means holding frame portion 12 (more specifically, arm 19L). Further, the toner remainder amount detection contact 9*h*1 doubles as a process cartridge detection contact for enabling the apparatus main assembly 14 to detect whether or not the process cartridge B is in the apparatus main assembly 14.

The electrical conductivity of the ground contact 119 is realized by using an electrically conductive substance as the material for the drum shaft 7*a* of the photosensitive drum 7, or by inserting an electrically conductive member into the drum shaft 7*a*, with the use of insert-molding, during the formation of the drum shaft 7*a*. In this embodiment, the drum shaft 7*a* was formed of metallic material such as iron. The other contacts 120 and 121 are formed of approximately 0.1–0.3 mm thick plate of electrically conductive material (for example, stainless steel, phosphor bronze, and the like), and are intricately extended outward from the inward side of the process cartridge B. The charge bias contact 120 is positioned so that it is exposed from the side plate of the cleaning unit C, on the non-driven side, whereas the development bias contact 121 and toner remainder amount detection contact 9*h*1 are positioned so that they are exposed from the side plate of the development unit D, on the non-driven side.

The charge bias contact 120 is virtually horizontally arranged relative to the ground contact 119, and is attached to the end of the arm 8A2 which is integral with the charging means holding frame portion 8A which supports the charge roller 8 (FIG. 5). The charge bias contact 120 is electrically in contact with the charge roller 8 through an electrically conductive member which is in contact with the charge roller shaft 8*a*.

The rod antenna 9*h* is positioned so that it extends along the development roller 9*c* across the entirety of the development roller 9*c*, holding a predetermined distance from the development roller 9*c*. The electrostatic capacity between the rod antenna 9*h* and development roller 9*c* changes in response to the amount of the toner between the two components. Thus, the changes in this electrostatic capacity are detected as changes in electrical potential by the control portion (unillustrated) of the apparatus main assembly 14 to detect the amount of the toner remainder.

The toner remainder amount means the amount of toner which is between the development roller 9*c* and rod antenna 9*h* and generates a certain amount of electrostatic capacity. Thus, it can be detected by detecting the amount of the electrostatic capacity between the development roller 9*c* and rod antenna 9*h* that the toner remainder amount within the toner container 11A has reduced to a certain amount. More specifically, that the toner remainder amount within the toner container 11A has reduced to a predetermined amount is determined by the control portion of the apparatus main assembly 14 by detecting through the toner detection contact 120 that the amount of the electrostatic capacity has reached the first predetermined value. Detecting that the electrostatic capacity has reached the aforementioned first predetermined value, the apparatus main assembly 14 issues a process cartridge exchange warming (for example, turning on-and-off of a lamp, or sound generation by buzzer). Further, the control portion detects, by detecting the predetermined second value smaller than the aforementioned predetermined value representing the predetermined toner remainder amount, that the process cartridge B has been mounted into the apparatus main assembly 14. If the control portion does not detect that the process cartridge B has been mounted in the apparatus main assembly 14, it does not allow the apparatus main assembly 14 to start an image formation operation. Incidentally, the control portion may be configured so that it issues a no-carriage warming (for example, turning on-and-off of a lamp) in such a case.

{Housing Structure}

As described before, the housing of the process cartridge B in this embodiment comprises a joined combination of the toner holding frame portion 11, developing means holding frame portion 12, and cleaning means holding frame portion 13. Next, the structure of this housing will be described.

Referring to FIG. 2, the toner holding frame portion 11 includes the toner container 11A, and to the toner holding frame portion 11, the toner conveying member 9*b* is attached. To the developing means holding frame portion 12, development roller 9*c* and development blade 9*d* are attached. Also rotationally attached to the developing means holding frame portion 12 is the toner stirring member 9*e*, which is located adjacent to the development roller 9*c* to circulate the toner within the development chamber. The toner holding frame portion 11 and developing means holding frame portion 12 are welded to each other to form a monolithic frame portion for the development unit D (FIG. 8).

Attached to the cleaning means holding frame portion 13 are the photosensitive drum 7, the charge roller 8, and the various components of the cleaning means. Also attached to the cleaning means holding frame portion 13 is the drum shutter 18 (FIG. 5), which covers the photosensitive drum 7 to protect it when the process cartridge B is out of the apparatus main assembly 14. Together, they constitute the cleaning means unit C (FIG. 8).

The development unit D and cleaning unit C are joined to form the process cartridge B. As for the method for joining the two units, first, the rotational shaft 20R of the development unit D is fitted in the slot 21R of the cleaning unit C, while fitting the flat portions 19R1 and 19L1 of the arms 19R and 19L with the inward sides of the corresponding side plates 13*s* of the cleaning unit C. Then, the end portion of the connecting pin 22, which has been pressed into the hole 13*s*4 of the side plate 13*s*, is slid into the hole 20L of the arm 19L.

Next, referring to FIG. 5, the end portions of the tensional coil spring 24*b* are attached, one for one, to a spring anchor 13*y*, that is, an outward projection formed as an integral part of the cleaning means holding frame portion 13, and a spring anchor 19*z*, that is, an outward projection formed as an integral part of the arm 19L.

Next, referring to FIG. 6, the tensional coil spring 24*a* are anchored between a spring anchor 12*z*, that is, an outward projection formed as an integral part of the side plate 12A on the downstream side in terms of the process cartridge mounting direction, and a spring anchor 13*z* which projects in the longitudinal direction from the bottom wall of cleaning means holding frame portion 13. With the provision of the above described structural arrangement, the photosensitive drum 7 and the spacer rings 9*i* fitted around the longitudinal end portions of the development roller 9*c* are kept pressed upon each other, while being allowed to pivot relative to each other about the pivotal axis SC.

Attached to the ends of the photosensitive drum 7 and development roller 9*c* are the drum gear 7*b* and the helical gear 9*k* of the development roller 9*c*, respectively, which are meshed with each other. Thus, the development roller 9*c* is rotationally driven by the photosensitive drum 7. The rotational shaft 20R located at the joint portion is positioned so that the angle formed by the transverse line of action between the mutually meshed gears of the photosensitive drum 7 and development roller 9*c*, and the line connecting the pitch point between the two gears and pivotal axis SC, falls on the encroachment side. Therefore, rotational moment is effected upon the development unit D also by the rotating of the development roller 9*c*, and as a result, the spacer rings 9*i* fitted around the development roller 9*c* are pressed upon the photosensitive drum 7 by the development roller 9*c*.

In other words, in the case of the above described process cartridge B, the spacer rings 9*i* of the development roller 9*c* are kept pressed upon the photosensitive drum 7 by the self-weight of the development unit D, the resiliency of the tensional coil springs 24*a* and 24*b*, the rotational driving of the gears of the photosensitive drum 7 and development roller 9*c*, and therefore, the gap between the photosensitive drum 7 and development roller 9*c* is kept constant (in this embodiment, approximately 300 $\mu$m) to always assure good image quality.

{Overhauling of Process Cartridge}

As the toner within the toner container 11A of the process cartridge B becomes depleted, this process cartridge B is recovered and overhauled in the following manner. Thus, there is no sealing film 51 in the process cartridge B which constitutes a target of overhauling; the sealing film 51 has been removed.

{Disjoining of Cleaning Unit C and Development Unit D}

Before disjoining the cleaning unit C and development unit D from each other, the cartridge cover 15 is removed.

First, the process cartridge B to be overhauled is set in an air duct (unillustrated). Then, the toner particles and dust adhering to the surface of the process cartridge B are removed by blowing air upon the process cartridge B.

Next, as shown in FIGS. 3, 5 and 6, the small screws 15*d*, which were put through the holes 15*b* of the left and right side plates 15*a* of the cartridge cover 15 and screwed into the round holes 13*e* of the cleaning means holding frame portion 13, are removed with the use of a screwdriver, and the pins 15*e*, which were put through the holes 15*c* of the same side plats15*a* and inserted into the elongated holes 13*f*, are pulled out with the use of a pliers or the like. Next, the cartridge cover 15 is pulled upward while keeping the hook 15*g* disengaged outward from the cleaning means holding frame portion 13 with the use of a fingertip or the like. As the cartridge cover 15 is pulled upward as described above, it comes off from the joint combination of the cleaning unit C and development unit D. Incidentally, the head portion of each pin 15*e* is shaped like a flange with a central recess, and therefore, the pin 15*e* can be removed by pulling and twisting while holding this flange-like portion with the use of a radio pliers, for example. The pin 15*e* is formed of resin, and its end portion is provided with a catch. However, this catch, and the flange-like portion which is gripped by a radio pliers, are easy to break, and therefore, the old pins 15*e* are replaced with brand-new ones. Below, a process in which the process cartridge B is separated into the cleaning unit C and development unit D will be described.

First, the tensional coil spring 24*a* and 24*b* provided to cause the photosensitive drum 7 and development roller 9*c* to press against each other as shown in FIGS. 5 and 6 are removed. More specifically, the tensional coil spring 22*a* is disengaged from the spring anchors 12*z* and 13*z* of the developing means holding frame portion 12 and cleaning means holding frame portion 13, respectively. The tensional coil spring 22*b* is disengaged from the spring anchor 19*z* and 13*y* of the arm 19L and cleaning means holding frame portion 13, respectively. The removal tensional coil springs 24*a* and 24*b* are tested, and if they meet a predetermined standard, they are used for overhauling.

Next, the rotational shaft 20R which projects outward from the arm 19R is lifted out of the U-shaped slot 21R of cleaning unit C illustrated in FIGS. 8 and 9. Then, the development unit D is disengaged from the connecting pin 22 by moving the cleaning unit C and development unit D relative to each other in the longitudinal direction. It should be mentioned here that the cleaning unit C and development unit D may be separated by pulling out the connecting pin 22 with the use of a radio pliers or the like.

The steps described above complete the process for separating the first and second units of the process cartridge B removably mountable in the apparatus main assembly 14. As described before, the first unit is the cleaning unit C which supports the photosensitive drum 7, and the second unit is a combination of the developing means holding frame portion 12 which supports the development roller 9*c*, and the toner holding frame portion 11 having the toner container 11A as a developer holding portion for storing the toner as developer used for development by the development roller 9*c*. Further, the first and second units are connected in such a manner that they are allowed to pivot relative to each other.

{Development Unit Overhaul}

Before describing the overhauling of the development unit D, the general structure of the development unit D in the state prior to disassembly will be described with reference to FIGS. 10, 11 and 15. As described previously, the development roller 9*c* is rotationally supported by the development roller bearings 9*j*. More specifically, the sleeve flange 9*a* fitted in one end of the development roller 9*c* is rotationally supported by a developer roller bearing 9*j*R, that is, one of the two developer roller bearings 9*j*, and the sleeve cap 9*o* fitted over the other end of the development roller 9*c* is rotationally supported by the developer roller bearing 9*j*L, or the other of the two developer roller bearings 9*j*. The development blade 9*d* is attached to the developing means holding frame portion 12 along the upper edge of the hole 12P of the developing means holding frame portion 12. The arms 19R and 19L are fixed to the longitudinal ends of the developing means holding frame portion 12 with the use of the screws 12*d*, the end portions of the partly flattened cylindrical shafts 9*g*1 and 9*g*2 which project one for one from the ends of the magnet 9*g* placed within the development roller 9*c*, being fitted one for one in the holes 19*b* (FIG. 11), in the form of a partly flattened cylinder, of the arms 19R and 19L. Simply stated, the development roller 9*c* is rotationally supported by the development, roller bearings 9*j*R and 9*j*L, and the ends of the partly flattened cylindrical shafts 9*g*1 and 9*g*2 of the magnet 9*g* are supported by the arm 19R and 19L while being accurately positioned.

{Steps for Removing Development Roller and Development Blade}

In order to disengage the arms 19R and 19L, it is necessary to remove the small screws 12*d* which were screwed into the developing means holding frame portion 12. These screws 12*d* were put through the holes 19*c*3 (FIG. 11) of the arms 19R and 19L, after fitting the positioning joggle 12*g* and positioning projection 12*e* (FIG. 11) of the development means holding frame portion 12 into the positioning hole 19*c*1 and slot 12*c*2. After the removal of the small screws 12*d*, the arms 19R and 19L are separated from the side walls of the development unit D. As described before, the end portion of the actual arm portion 19R1 of the arm 19R is provided with the rotational shaft 20R, that is, an integrally molded part of the arm 19R, for joining the development means holding frame portion 12 and cleaning means holding frame portion 13. In order to separate the gear box 9*q* from the side plate 12A of the developing means holding frame portion 12, the arms 9*q*1, that is, snap-fitting claws, which are projecting through the hole 12A*a* of the side plate 12A, are flexed by inserting a ratio pliers or the like between the side plate 12A and toner holding frame portion 11, and then, the gear box 9*q* is separated from the side plate 12A by pulling the gear box 9*q* outward in the longitudinal direction of the process cartridge B.

As the arms 19R and 19L are separated from the developing means holding frame portion 12, the partly flattened cylindrical shafts 9*g*1 and 9*g*2 , that is, the longitudinal end portions of the magnet 9*g*, are freed from the arms 19R and 19L. Thereafter, the development roller unit G is moved out of the developing means holding frame portion 12 in the direction perpendicular to the axial direction of the development roller 9*c*. During this removal of the development roller unit G, the development roller bearings 9*j*R and 9*j*L are removed together with the development roller unit G. Next, the unillustrated screws which were put through the screw holes 9*d*4 of the development blade 9*d* and were firmly screwed in the holes 12*i*2 with female threads in the flat blade mount 12*i* of the developing means holding frame portion 12, are removed. Then, the development blade 9*d* is separated from the developing means holding frame portion 12 in the direction to disengage the left and right positioning joggles 12*i*1 provided on the flat blade mount 12*i* of the developing means holding frame portion 12, from the positioning holes 9*d*3 of the development blade 9*d*.

If the sealing film 51 is repaired during the overhauling of the recycled process cartridge B, the overhauled process cartridge B will be like a brand-new process cartridge. In this embodiment, however, the sealing film 51 is not repaired. It is unnecessary to replace the old sealing film 51 with a fresh one, because all that is necessary is to render the recycled process cartridge airtight enough to prevent toner from leaking out of the process cartridge.

Next, a method or making the development unit airtight enough to prevent toner from leaking from the development unit, without replacing the sealing film 51, will be described.

{Method for Airtightly Sealing Between Development Unit and Development Means Holding Frame Portion}

The toner holding frame portion 11 and developing means holding frame portion 12 are joined to each other with the interposition of the cover film plate 53. Thus, while the hole 11*i* of the toner holding frame portion 11 remains sealed with the sealing film 51, toner does not leak. Since the toner holding frame portion 11 and developing means holding frame portion 12 are left joined to each other during the overhauling, it is impossible to seal the hole 11*i* of the toner holding frame portion 11 with a new sealing film 51.

Thus, a method for airtightly sealing the development unit while overhauling the toner holding frame portion 11 and developing means holding frame portion 12 for reuse will be described. At this time, the sealing of the joint between the toner holding frame portion 11 and developing means holding frame portion 12 will be described.

Referring to FIG. 10, the flat surface 11*k* of the flange 11*a* of the toner holding frame portion 11 is provided with the ridge 11*h* which extends surrounding the hole 11*i*. Since this ridge 11*h* and cover film plate 53 were welded to each other, it does not occur that the toner leaks outward from between the toner holding frame portion 11 and cover film plate 53.

As for the interface between the cover film plate 53 and developing means holding frame portion 12, since the triangular ridge 12*v* of the developing means holding frame portion 12 (FIG. 13) and the cover film plate 53 were welded to each other, it does not occur that the toner leaks outward from between the top and bottom edges, that is, the longitudinal edges, of the cover film plate 53, and the top and bottom edges, that is, the longitudinal edges, of the developing means holding frame portion 12.

The longitudinal end portions of the cover film plate 53 are in contact with the elastic seals 54 and 56 pasted to the developing means holding frame portion 12 one for one. The elastic seals 54 and 56 are formed of elastic substance such as felt, and remain pressed upon the cover film plate 53. Therefore, toner does not leak while the process cartridge B is mounted into, or dismounted from, the apparatus main assembly 14. However, there is a possibility that if the process cartridge B is subjected to a certain type of impact during process cartridge shipment, toner could leak. Thus, this possibility has to be eliminated.

{Sealing of Joint between Right Ends of Toner Holding Frame Portion and Developing Means Holding Frame Portion}

The gear box 9*q* is attached to the right side walls of the toner holding frame portion 11 and developing means holding frame portion 12. If the gear box 9*q* is disengaged from the developing means holding frame portion 12, it is possible to seal the joint between the right ends of the toner holding frame portion 11 and developing means holding frame portion 12. This sealing operation is possible while the development roller unit G remains attached to the developing means holding frame portion 12. However, since adhesive sealant is used, it is better to carry out the operation after the removal of the development roller unit G and development blade 9*d*.

Figure 15:
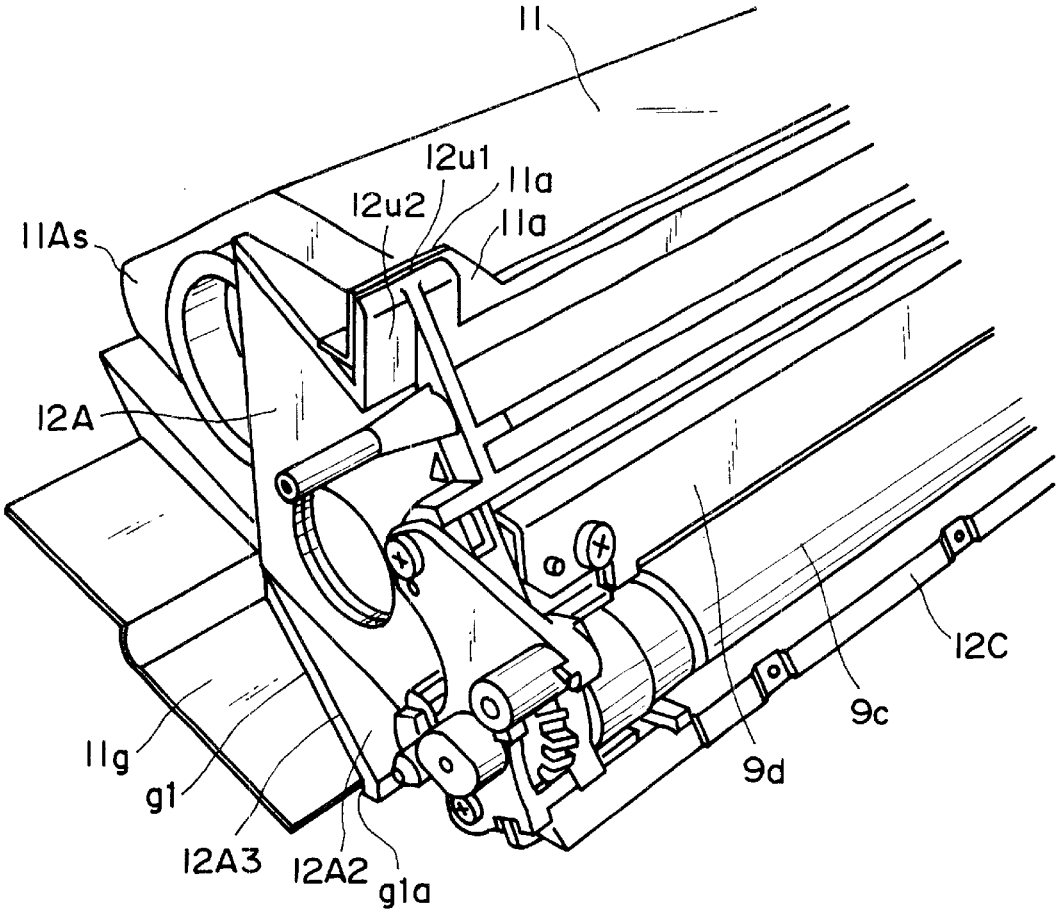
FIG. 15 is a perspective view of the front portion of the development unit prior to overhaul, as seen from diagonally above the right front.

Referring to FIG. 15, the bottom portion of the toner holding frame portion 11 is provided with a bottom flange 11*g*, which is an integrally molded part of the toner holding frame portion 11 and extends outward in the longitudinal direction of the toner holding frame portion 11. This bottom flange 11*g* is perpendicular to the flange 11*a*, that is, the flange on the front side, of the toner holding frame portion 11, and also to the side plate 11A*s* of the toner holding frame portion 11. This bottom flange 11*g* of the toner holding frame portion 11, and the triangular bottom flange 12A2, that is, an integral part of the bottom portion of the side plate 12A of the developing means holding frame portion 12, are parallel to each other, and there is a gap g1, or a first gap, between the two flanges 11*g* and 12A2, and opens outward from between the edge of the bottom flange 12A2 of the developing means holding frame portion 12, and the bottom flange 11*g* of the toner holding frame portion 11.

Figure 18:
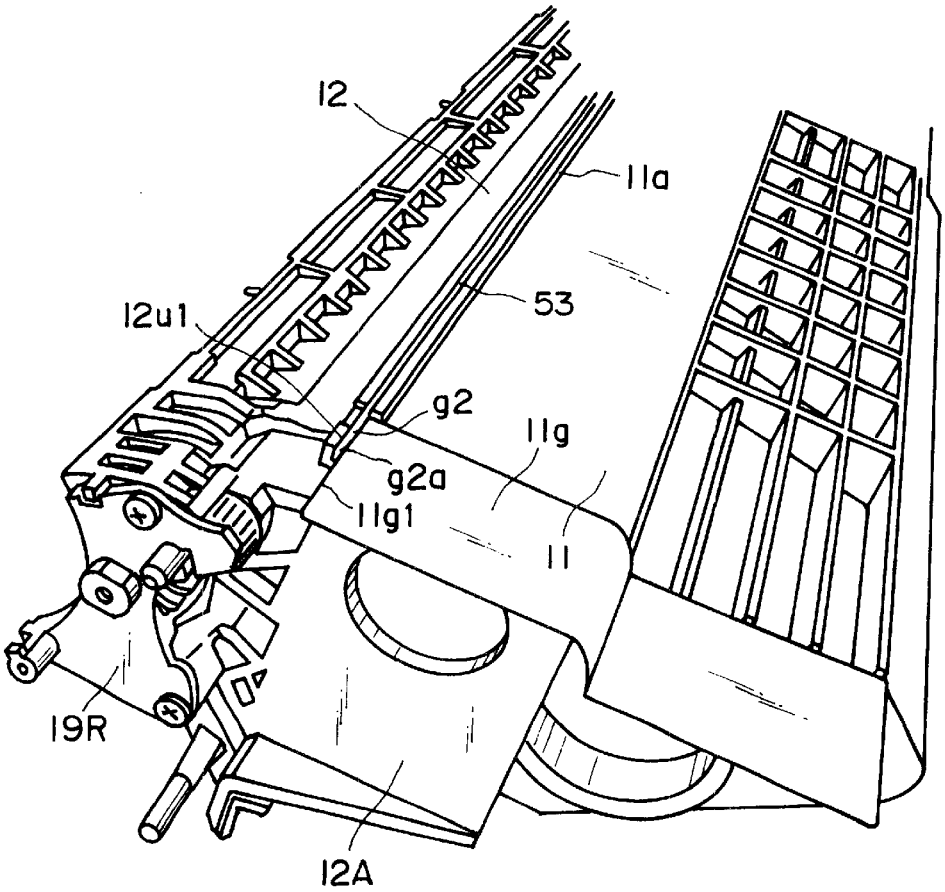
FIG. 18 is a perspective view of the rear portion (bottom side) of the development unit prior to overhaul as seen from below the left front.

Referring to FIG. 18, there is another gap g2, or the second gap, between the edge 11*g*1 of the bottom flange 11*g* of the toner holding frame portion 11, and the flat surface 12*u*1 of the developing means holding frame portion 12. The gap g1 and g2 are continuous; the portion of the gap g1 designated by a referential code g1*a* in FIG. 15 is connected to the portion of the gap g2 designated by a referential code g2*a* in FIG. 18. These gaps g1 and g2 are connected to a gap 3*g* (FIG. 19) located next to the outward surface of the bottom portion, to which the cover film is pasted, of the cover film plate 53.

Figure 16:
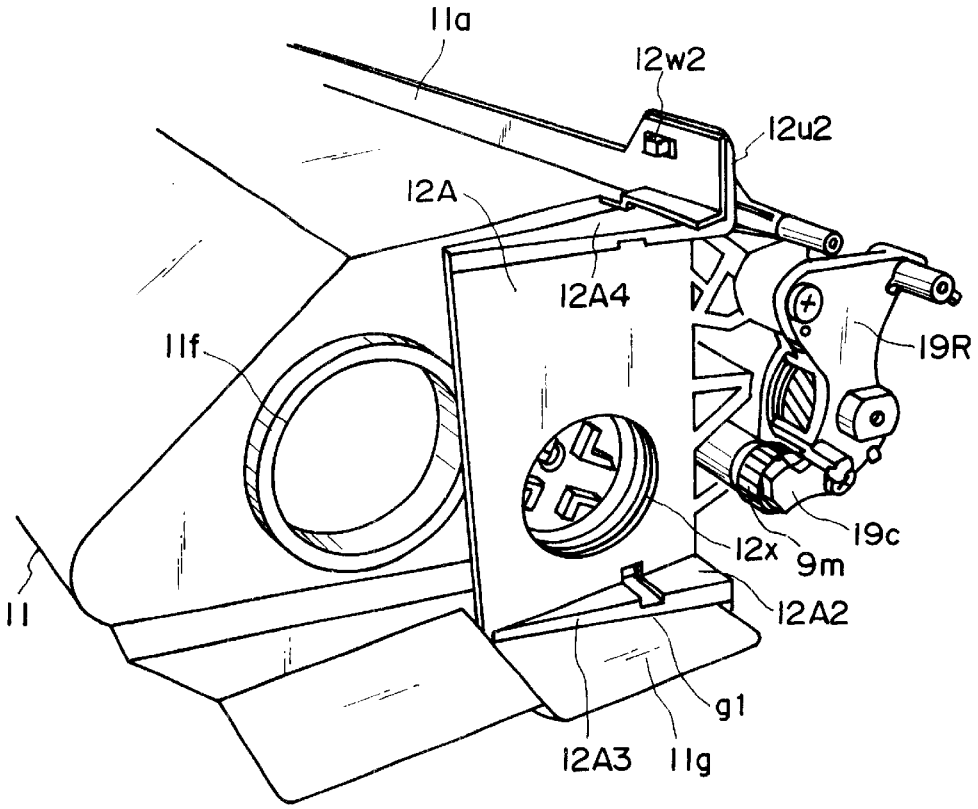
FIG. 16 is a perspective view of the rear portion of the development unit prior to overhaul, as seen from diagonally above the left front.
Figure 17:
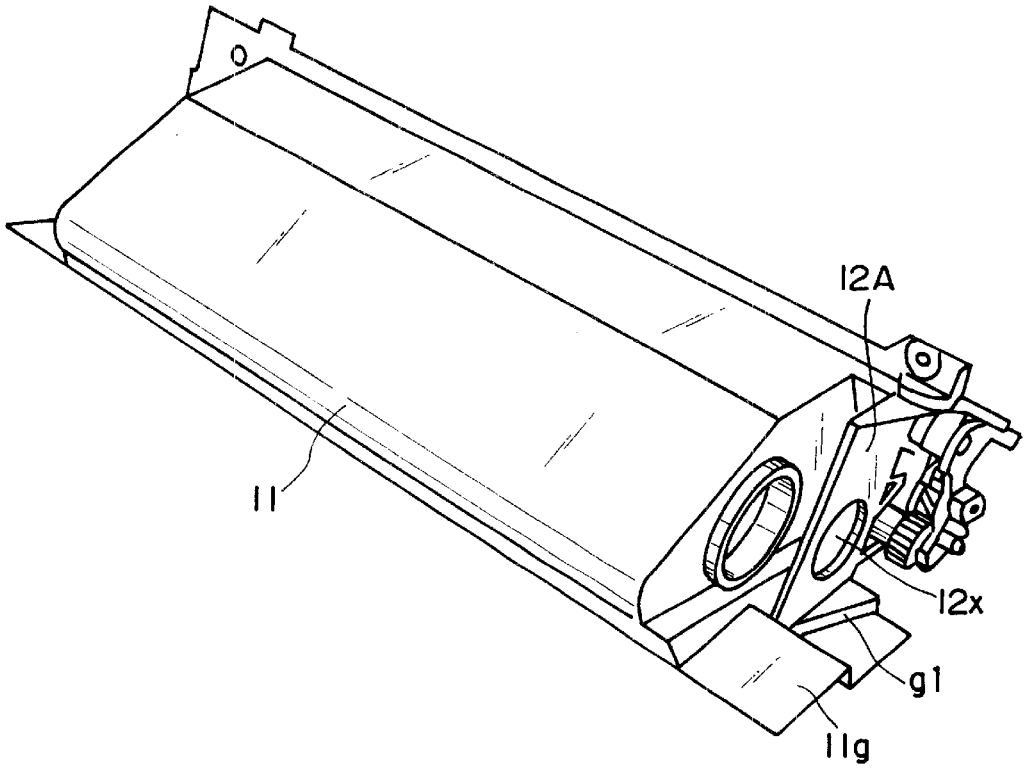
FIG. 17 is a perspective view of the entirety of the development unit, as seen from diagonally above the left front.

Referring to FIG. 16, regarding the joint between the top right portions of the toner holding frame portion 11 and developing means holding frame portion 12, the flange 11*a* of the toner holding frame portion 11, and the flat surface 12*u*1 of the developing means holding frame portion 12, were welded to each other, except for the area around the joggle 12*w*2. In this area, there is a gap equivalent to the thickness of the cover film plate 53, between the toner holding frame portion 11 and developing means holding frame portion 12. The area between this area and the hole 12P is sealed with the elastic seal 56. There is a possibility that if the toner emigrates from the hole 12P and travels past the elastic seal 56, it might come out of the process cartridge B through the adjacencies of the joggle 12*w*2, in which there is the aforementioned gap between the flat surface 11*k* of the toner holding frame portion 11, and the flat surface 12*u*1 of the developing means holding frame portion 12.

At this time, the gap between the toner holding frame portion 11 and developing means holding frame portion 12, in the adjacencies of the joggle 12*w*2, will be described in detail.

Figure 19:
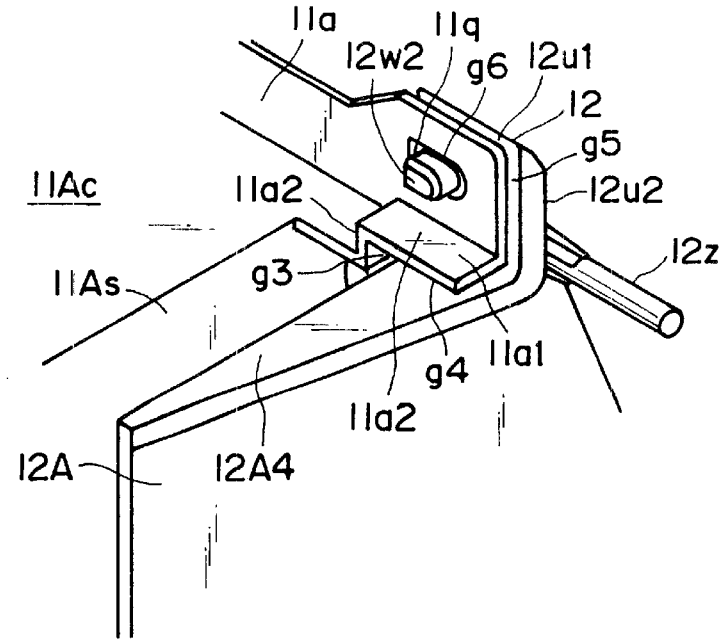
FIG. 19 is a perspective view of the top-right portion of the joint between the toner holding frame portion and developing means holding frame portion, as seen from the same direction as the direction from which the development unit is seen in FIG. 16.

Referring to FIG. 19, the flange 11*a* of the toner holding frame portion 11 extends outward in the longitudinal direction of the process cartridge B, beyond the side plate 11A*s* of the toner holding frame portion 11 having the toner container 11A. This outwardly extending portion of the flange 11*a* is provided with a rib 11*a*1, which is an integral part of the toner holding frame portion 11. The rib 11*a*1 is in the form of a single step of a staircase, and the portion of the rib 11*a*1 comparable to the bottom portion of a step is continuous from the top plate 11Ac of the toner holding frame portion 11. The portion 11*a*2, that is, the portion comparable to the upright portion of a single step, of the rib 11*a*1 vertically extends, holding the gap 3 from the top corner of the side plate 12A of the developing means holding frame portion 12. The portion 11*a*2, that is, the portion comparable to the top portion of a step, of the rib 11*a*1 extends in parallel to the triangular top flange 12A4, that is, a part of the top portion of the side plate 12A of the developing means holding frame portion 12, holding a gap g4. In addition, there is a gap g5 between the flange 11*a* of the toner holding frame portion 11, and the flat surface 12*u*1 of the developing means holding frame portion 12, in the immediate area around the joggle 12*w*2.

Figure 20:
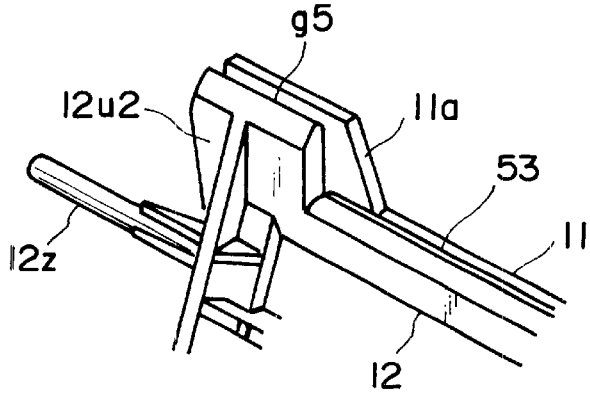
FIG. 20 is a perspective view of the same portion of the joint as the one illustrated in FIG. 19, as seen from the direction opposite to the direction from which that joint portion is seen.

FIG. 20 is a perspective view of the same portion of the process cartridge B as that in FIG. 19, as seen from the opposite direction. The flange 12*u*2 of the developing means holding frame portion 12, on the flat surface 12*u*1 on which a joggle 12*w*2 is provided, is perpendicular to the triangular top flange 12A4 illustrated in FIG. 19. The aforementioned gap g5 leads to the outside, along the edge of flange 12*u*2 which surrounds the joggle 12*w*2. This gap g5 is approximately the same as the thickness of the cover film plate 53. There is gap g6 between the joggle 12*w*2, and the wall of the elongated hole 11*q* of the toner holding frame portion 11. This gap g6 is directly connected to the gap g5.

Figure 21:
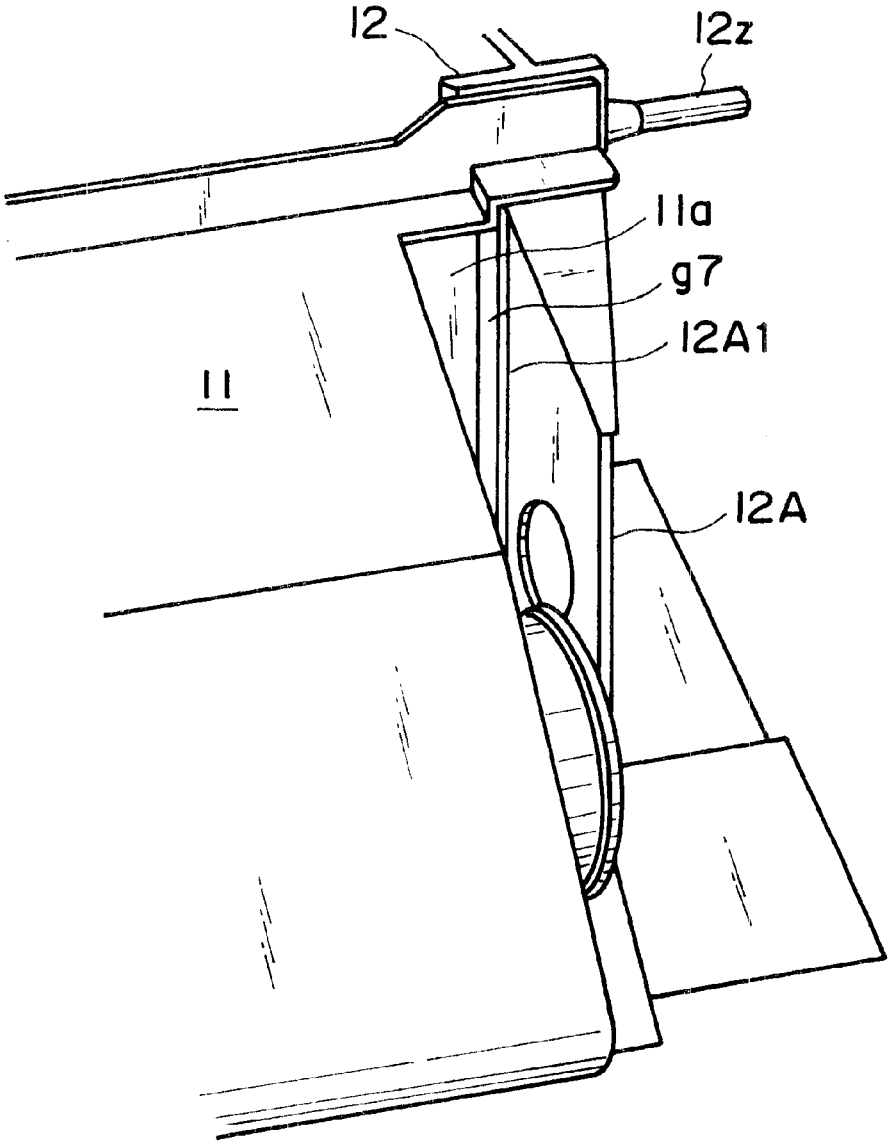
FIG. 21 is a perspective view of the inward side of the right side plate of the developing means holding frame portion prior to overhaul.

Referring to FIG. 21, the side plate 12A of the developing means holding frame portion 12 is positioned at one of the longitudinal ends of the process cartridge B and extends rearward in perpendicular to the longitudinal direction of the process cartridge B as seen from the front side of the hole 12P of the developing means holding frame portion 12. As the toner holding frame portion 11 and developing means holding frame portion 12 are joined to each other, the edge of the flange 11*a* comes almost in contact with the base portion of the side plate 12A of the drum flange portion 12, creating a straight gap g7. This gap g7 extends along the elastic seal 56 (FIG. 13) pasted to the developing means holding frame portion 12. It is connected to the bottom gap g1 which was mentioned first.

The above described gaps g1–g7 which open outward at the joint between the toner holding frame portion 11 and developing means holding frame portion 12 are connected among themselves. More specifically, the gaps g1 and g2 are connected to each other, and the gaps g3, g4, g5 and g6 are connected along themselves. Further, one end of the gap g7 is connected to the gap g2, and the other end is connected to the gap g3.

The gaps g1–g7 are sealed at their outward openings with the use of sealers SB. The states of the sealed portions of the process cartridge B are shown in FIGS. 22–25. The sealers SB used for this purpose are such sealers that are fluid but high enough in viscosity to be coated to seal the gap g1–g7. In fact, the gaps g1–g7 are sealed with a plurality of sealers SB different in fluidity; sealers different in fluidity are selected according to the area to which sealers are applied, the size of the area to which sealers are applied, or the like factors.

When sealing the joint portions corresponding to the corners, or "bends", of the developing means holding frame portion 12 (development roller holding frame portion) at its longitudinal ends, a sealer higher in fluidity is used. The bend of the developing means holding frame portion 12 means where the side plate 12A meets the flat surface 12*u* at the longitudinal ends of the developing means holding frame portion 12. At each bend of the developing means holding frame portion 12, the shorter edge, that is, the edge perpendicular to the longitudinal direction of the process cartridge B, of the toner holding frame portion 11, is positioned almost in contact with the inward surface of the bend of the developing means holding frame portion 12. This portion of the joint is where the gap g7 (FIG. 21) opens outward as has been already stated. The reason for the use of sealer with higher fluidity is that the gap between the side plate 11A*s*1 of the toner holding frame portion 11 and the side plate 12A of the developing means holding frame portion 12, that is, the gap g7, is too narrow for a coating nozzle to be inserted, and therefore, a sealer must be flowed into the gap g7 from its top end, with the gap g7 slanted. As for the criterion, in terms of fluidity, for a sealer to the suitable in the context of the description given above regarding a sealer, its viscosity is desired to be approximately 25 poises (g/cm.s).

When sealing other gaps g1–g6 between the toner holding frame portion 11 and developing means holding frame portion 12, sealers SB lower in fluidity are used. The criterion for a sealer to be considered lower in fluidity is that the viscosity of the sealer is such that it rarely occurs that the sealer oozes downward due to self-weight even if any of the gaps g1–g6, to which the sealer has been applied, is vertically positioned immediately after the application.

Where the sealers are applied are the portions of the joint between the toner holding frame portion 11 and developing means holding frame portion 12, at which the frame portions 11 and 12 were welded to each other. Therefore, after the sealing of the gaps g1–g7, all the sealers applied to the gaps g1–g7 are continuous.

The portions of the joint between the toner holding frame portions 11 and 12, at which the frame portions 11 and 12 were welded to each other, are the portions of the joint between the toner holding frame portion 11 and 12, immediately next to the right-hand end of the triangular ridge 12*v*, where the flange 11*a* of the toner holding frame portion 11 and flange 12*u*2 of the developing means holding frame portion 12 overlap with each other. All that is necessary to completely seal between the toner holding frame portion 11 and developing means frame portion 12 is to seal in a straight line between the corresponding longitudinal ends of the two triangular ridges 12*v*. This, however, is impossible because the areas connecting between the corresponding longitudinal ends of the two triangular ridges 12*v* are on the inward side of the process cartridge B.

The sealers SB are coated using a coating apparatus. A coating apparatus may be a manual dispenser, or an automatic coating apparatus having a robotic arm capable of causing the coating nozzle to follow a predetermined path.

The sealers SB are hardenable polymers, or thermoplastic polymers. Examples of the hardenable polymers are siliconized adhesives, and examples of the thermoplastic polymers are hot-melt plastics.

Figure 31:
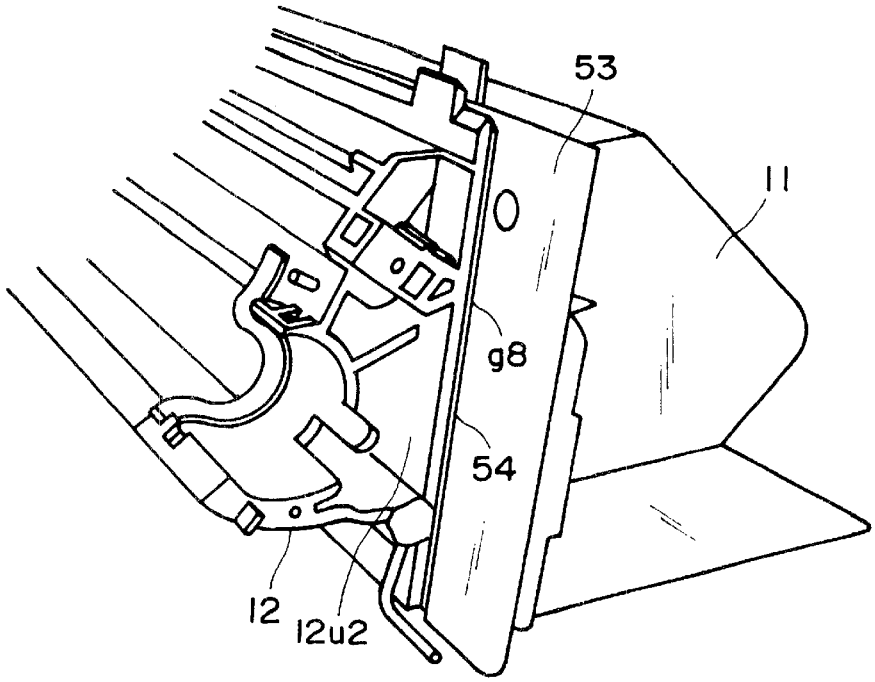
FIG. 31 is a perspective view of the left portion of the joint between the toner holding frame portion and developing means holding frame portion.
Figure 32:
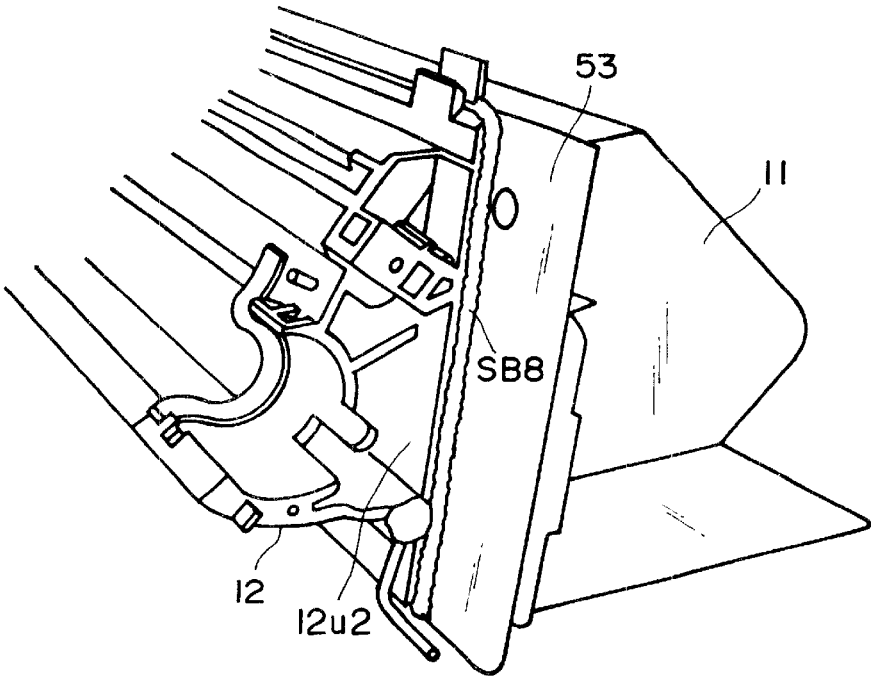
FIG. 32 is a perspective view of the left portion of the joint between the toner holding frame portion and developing means holding frame portion after the application of sealing agent.

A portion of the joint between the toner holding frame portion 11 and developing means holding frame portion 12, where the toner holding frame portion 11 and developing means holding frame portion 12 were not welded to each other, also exists on the other longitudinal end of the process cartridge B, and the gaps between the toner holding frame portion 11 and developing means holding frame portion 12 at this end must also be sealed. Referring to FIG. 31 at this end, the developing means holding frame portion 12 was welded to the film cover plate 53, only between the top and bottom edges of the developing means holding frame portion 12, and the exposed portion of the surface of the cover film plate 53 in FIG. 31. In other words, the developing means holding frame portion 12 and cover film plate 53 were not welded to each other, across the area between the top and bottom edges of the process cartridge B; instead, the gap, that is, a gap g8, between the developing means holding frame portion 12 and cover film plate 53 was sealed with the elastic seal 54 (FIG. 13). This elastic seal 54 is formed of elastic material such as felt, and therefore, there is a possibility that the toner within the process cartridge B could leak through the interface between the elastic seal 54, that is, a piece of felt, and the surface of the toner holding frame portion 11. In consideration of such a possibility, the sealer SB8 is applied to the opening of this gap g8. The details of the method for applying the sealer SB8 are the same as those described regarding the sealing of the gaps between the other longitudinal ends of the toner holding frame portion 11 and developing means holding frame portion 12; the sealer SB8 is applied to the gap g8 illustrated in FIG. 31.

Figure 22:
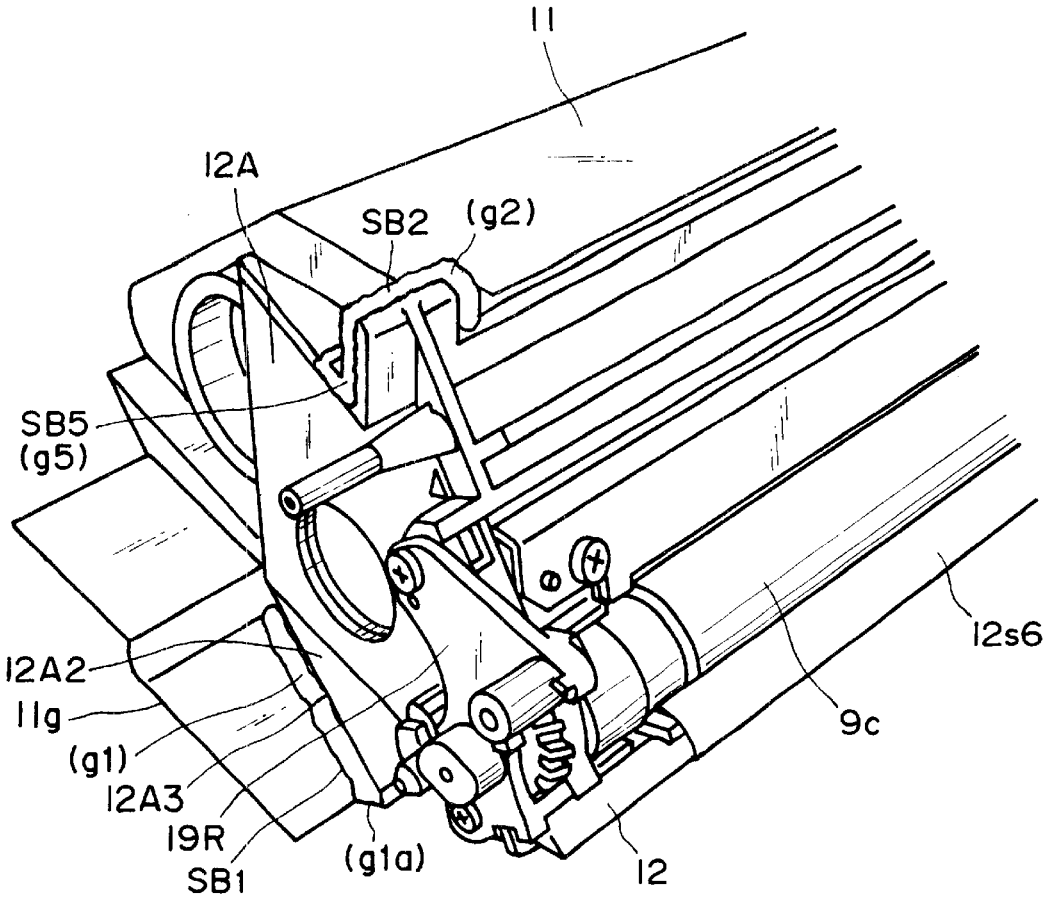
FIG. 22 is a perspective view of the front portion of the development unit after the application of sealer and the attachment of a "blow-by" prevention backup seal, as seen from diagonally above the right front (this drawing corresponds to FIG. 15).

After the application of a sealer SB1 to the gap g1, in FIGS. 15 and 16, between the flange portion 11*g* of the toner holding frame portion 11, and the bottom flange portion 12A2 of the side plate 12A of the developing means holding frame portion 12, the sealer SB1 appears as illustrated in FIG. 22.

Figure 23:
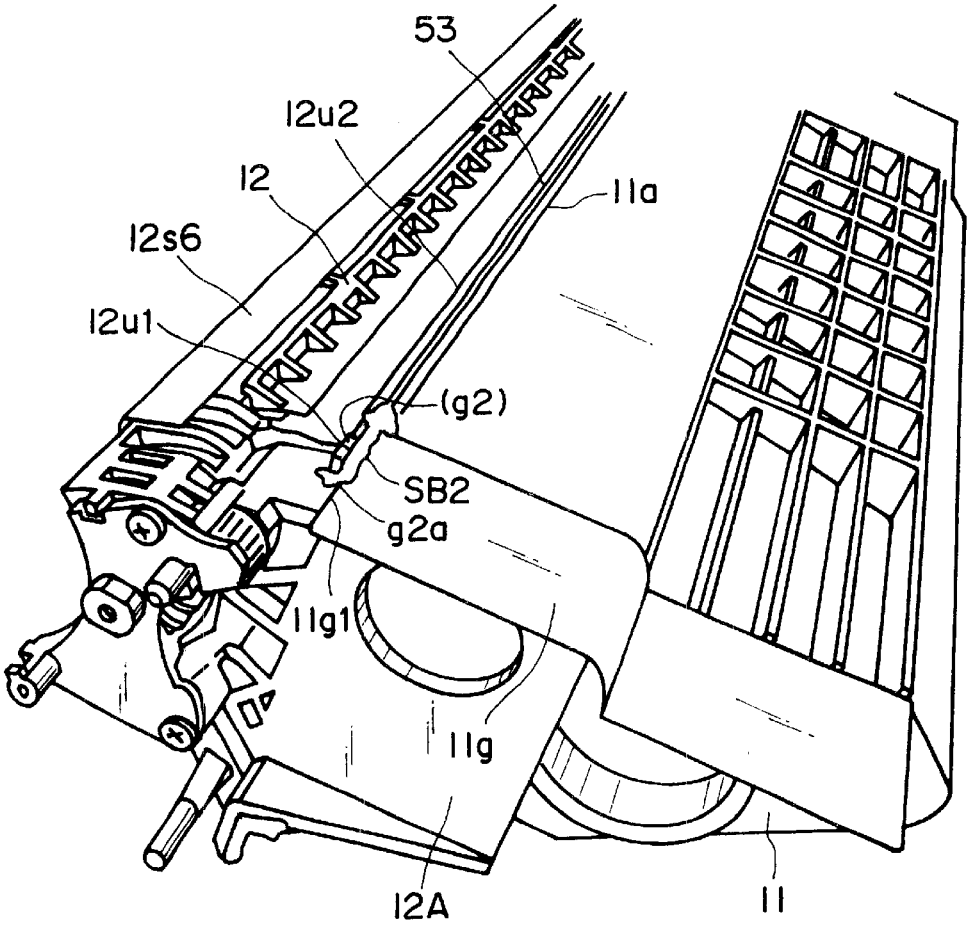
FIG. 23 is a perspective view of the rear portion of the development unit after the application of sealer and the attachment of the "blow-by" prevention backup seal, as seen from below the left front (this drawing corresponds to FIG. 18).

After the application of a sealer SB2 to the gap g2, in FIG. 18, between the edge 11*g*1 of the bottom flange 11*g* of the toner holding frame portion 11, and the flat surface 12*u*1 of the developing means holding frame portion 12, the sealer SB2 appears as shown in FIG. 23. This sealer SB2 is continuous with the sealer SB1. The sealer SB2 has been applied across the opening of the gap g2, where the cover film plate 53 is exposed.

Figure 24:
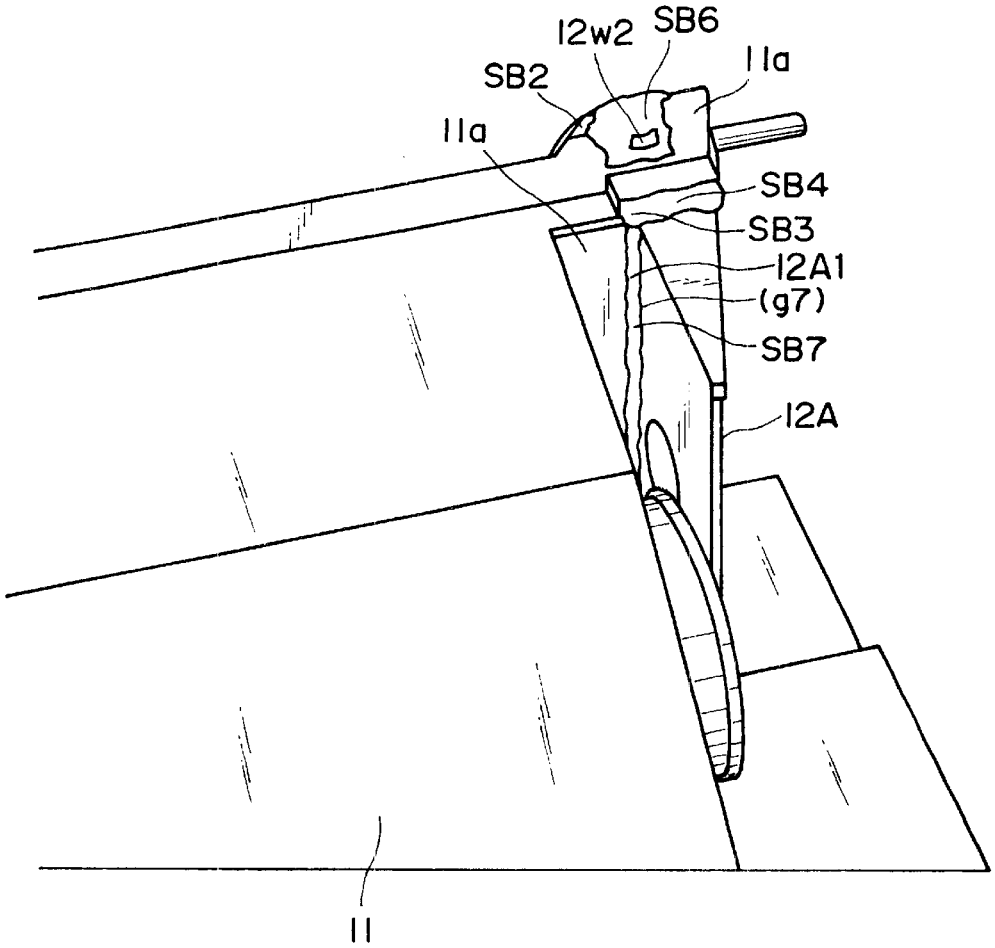
FIG. 24 is a perspective view of the inward side of the side plate of the developing means holding frame portion after the application of seal (this drawing corresponds to FIG. 21).

After the application of a sealer SB3 to the gap g3, in FIG. 19, between the stepped portion 11*a*2 of the longitudinal end portion of the toner holding frame portion 11, and the base portion of the top flange portion 12A3, that is, the bend portion of the top portion of the side plate 12A of the developing means holding frame portion 12, the sealer SB3 appears as shown in FIG. 24.

Figure 25:
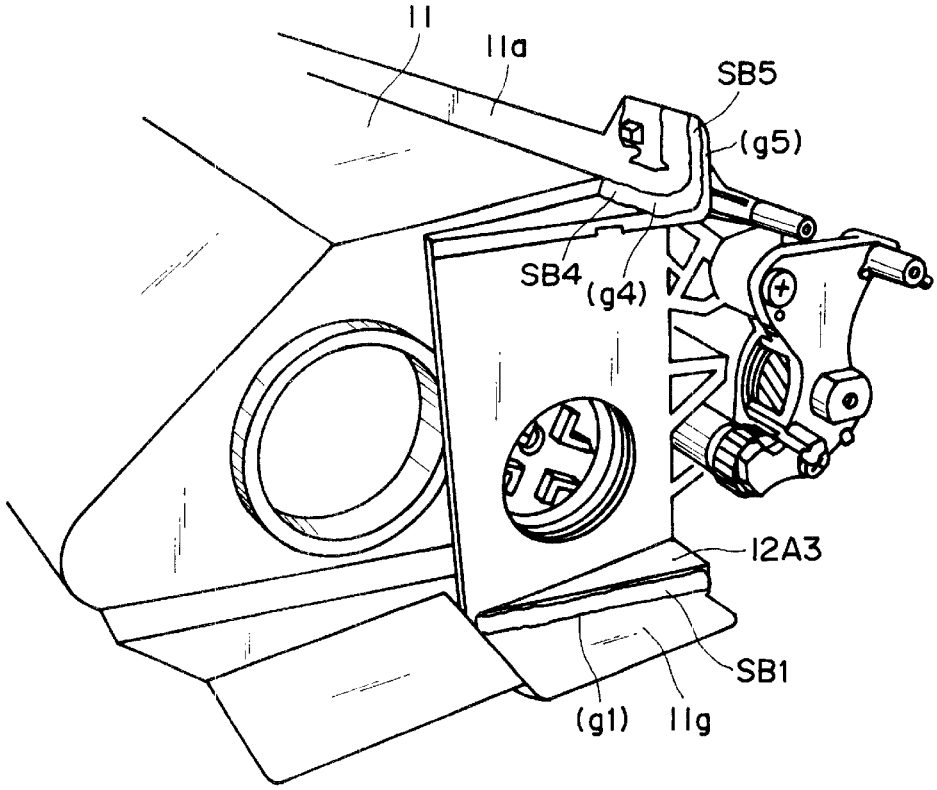
FIG. 25 is a perspective view of the front portion of the development unit after the application of seal, as seen from diagonally above the left front (this drawing corresponds to FIG. 16).

After the application of a sealer SB4 to the gap g4, in FIG. 19, between the rib 11*a*1 of the toner holding frame portion 11, which is continuous with the flange 11*a*, and the top flange portion 12A4 of the side plate 12A of the developing means holding frame portion 12, the sealer SB4 appears as shown in FIG. 25.

Figure 29:
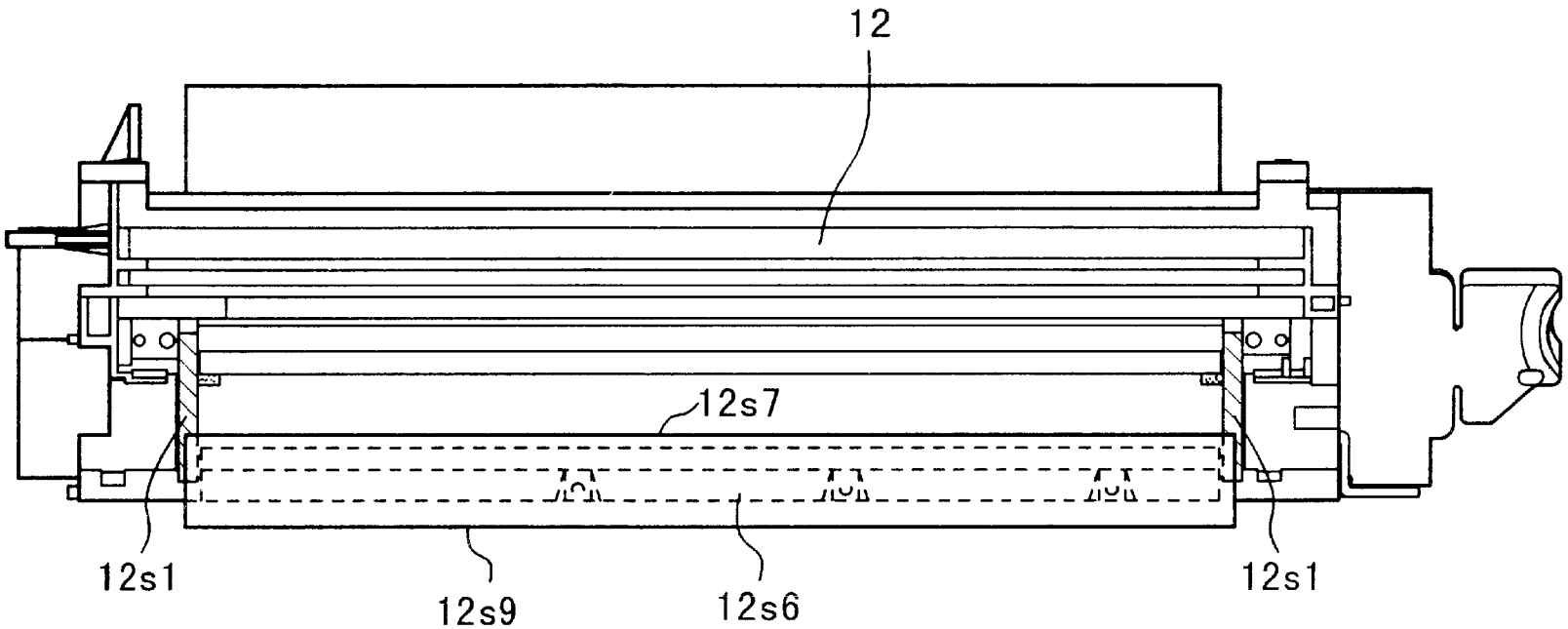
FIG. 29 is a front view of the frame portion of the development unit, from which the development roller and development blade have been removed, and to which the "blow-by" prevention backup seal is being applied.

After the application of a sealer sB5 to the gap g5, in FIGS. 19 and 29, between the top portion of the longitudinal end of the flange 11*a* of the toner holding frame portion 11, and the flat surface 12*u*1 of the flange portion 12*u*2 of the developing means holding frame portion 12, the sealer SB5 appears as shown in FIGS. 22, and 25.

After the application of a sealer SB6 to the gap g6, in FIG. 19, between the internal surface of the elongated hole 11*q* of the toner holding frame portion 11, and the side wall of the joggle 12*w*2, the sealer SB6 appears as shown in FIG. 24.

As the toner holding frame portion 11 and developing means holding frame portion 12 are joined with each other, the gap g7, in FIG. 21, is formed between the vertical edge of the flange 11*a* of the toner holding frame portion 11, located at the longitudinal end of the toner holding frame portion 11, and the bend 12A1, that is, the base portion of the side plate 12A of the developing means holding frame portion 12. The opening portion of the gap g7 looks like a groove, and is filled with a sealer SB7 as shown in FIG. 24. This opening portion of the gap g7 is approximately 1 mm in width, and filling this opening portion of the gap g7 with the sealer SB7 seals the gap g7. After the application of the sealer SB7, the sealer SB7 is continuous with the sealer SB2 and SB3. An example of the sealer SB7 is a siliconized bond which is high in fluidity, that is, low in viscosity. This is due to the fact that it is difficult to place a sealer coating nozzle into the gap g7, into which the sealer SB7 must be applied.

After the application of the sealers SB1, SB2 -SB7-SB3, SB4, SB5 and SB6, the sealers are continuous. Therefore, the toner which leaks from between the seal 56 and cover film plate 53 is blocked by the sealers SB1–SB7, being prevented from leaking further outward. The toner which leaks from between the seal 54 and cover film 53, is blocked by the sealer SB8, being prevented from leaking further outward.

{Sealing of Interface Between Developing Means Frame Portion and Development Roller}

As for the seals placed in the adjacencies of the development blade 9*d*, the seal 12*s* which extends in the longitudinal direction of the process cartridge B is placed between the metallic blade plate 9*d*1 of the development blade 9*d*, and the developing means holding frame portion 12, remaining compressed between them, and the seal 12*s*1 is placed at each longitudinal end of the development blade 9*d*, remaining partially compressed by the metallic blade plate 9*d*1. Further, the blade 9*d*2 formed of urethane rubber remains pressed upon the development roller 9*c*, sealing the interface between the development roller 9*c* and the development blade 9*d*.

As for the seals placed in the adjacencies of the development roller 9*c*, the two seals 12*s*1 are placed in contact with the peripheral surfaces of the longitudinal ends of the development roller 9*c*, one for one, and the urethane rubber blade 9*d*2. The urethane blade portion 9*d*2 of the development blade 9*d* is in contact with the generatrix portion of the development roller 9*c*.

The longitudinal ends of the urethane rubber 9*d*2 are next to the corresponding seals 12*s*1, and are partially in contact with the development roller 9*c* due to the presence of the pressure applied to them by the sponge seals 12*s*4. The sponge seal 12*s*4 is in contact with the seal 12*s*1, having been pasted to the developing means holding frame portion 12. The sponge seal 12*s*4 is in contact with the urethane rubber 9*d*2, on the side opposite to the side in contact with the development roller 9*c*, due to its resiliency.

When overhauling the development unit D, in order to prevent toner from leaking from between a "blow-by" prevention seal 12*s*2, that is, an original seal having been attached to the developing means holding frame portion 12 in advance, and the development roller 9*c*, a backup sheet is added as a seal for backing up the "blow-by" prevention seal 12*s*2.

This additional "blow-by" prevention seal 12*s*6 as a backup seal for the "blow-by" prevention seal 12*s*2 (original seal) is attached after the removal of at least the development roller unit G after the separation of the development unit D and cleaning unit C. However, operational efficiency will be much better if the development blade 9*d* is removed prior to the attachment of the seal 12*s*6. The steps for disassembling the process cartridge B up to this point have been already described, and will be not be repeated here.

Figure 27:
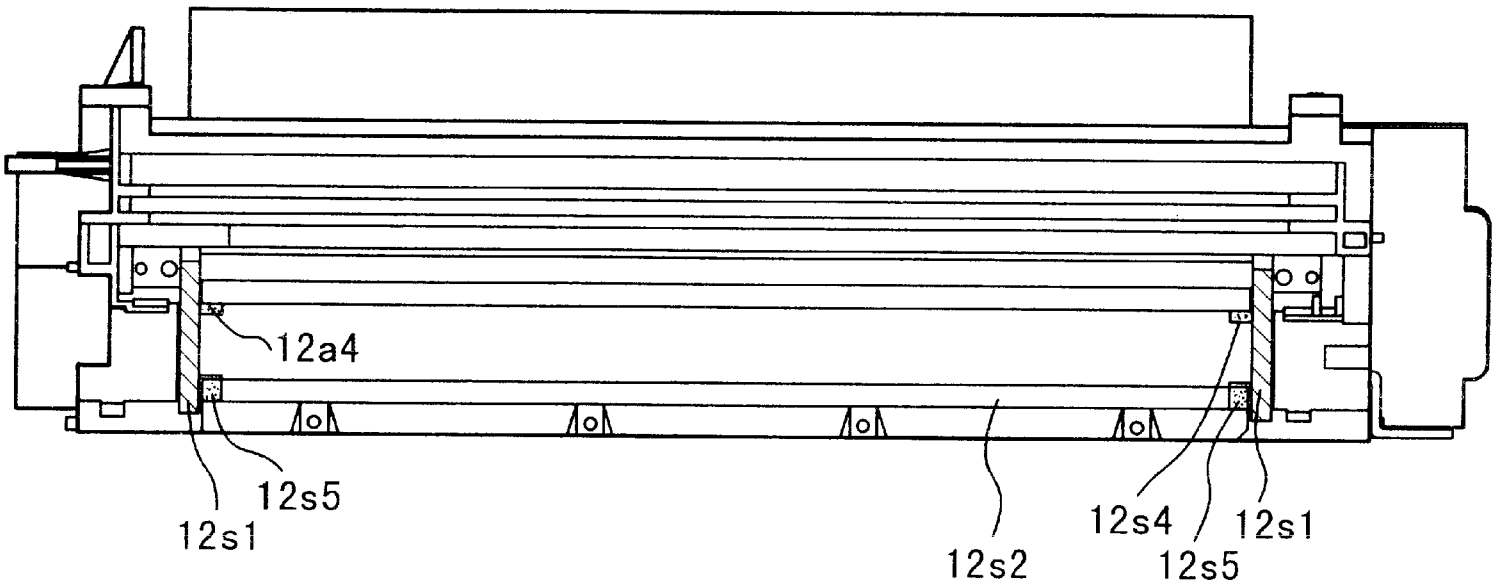
FIG. 27 is a front view of the frame portion of the development unit, from which the development roller and development blade have been removed.

FIG. 27 is a front view of the development unit D, from which development roller unit G and gear box 9*q* have been removed. The arms 19R and 19L have also been removed to remove the development roller unit G.

Figure 26:
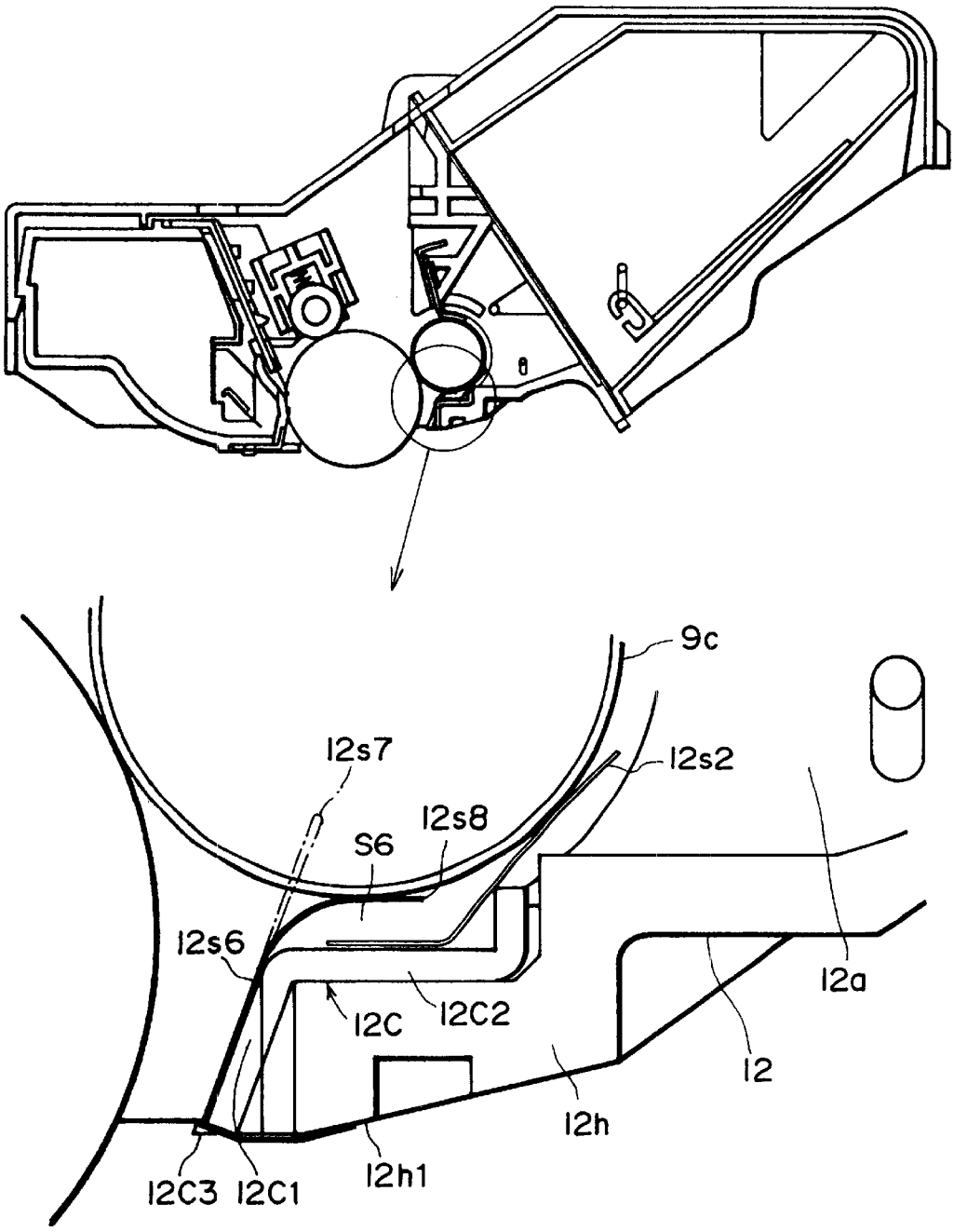
FIG. 26 is a vertical sectional view of the portion of the development unit, in which the "blow-by" prevention seal has been placed.

FIG. 26 is a combination of a vertical sectional view of the process cartridge B, and an enlarged sectional view of the "blow-by" prevention seal and its adjacencies in the development unit, after the installation of the "blow-by" prevention seal, at a plane perpendicular to the longitudinal direction of the process cartridge B. The developing means holding frame portion 12 is provided with a reinforcing member 12C, the cross section of which looks like a slightly deformed letter Z, and which is fixed to the mandible-like bottom portion 12*h* of the developing mean holding frame portion 12. This reinforcing member 12C extends in the longitudinal direction of the process cartridge B, and its longitudinal ends are in contact with the corresponding seals 12*s*1 at the longitudinal ends of the process cartridge B. One side of the "blow-by" prevention seal 12*s*2, with respect to the widthwise direction of the process cartridge B, is pasted to the web portion of the 12C2 of the reinforcing member 12C, across the entire length of the web portion 12C2, whereas the other side, which is parallel to the development roller 9*c*, is placed tangential to the peripheral surface of the development roller 9*c*. The "blow-by" prevention seal 21*s*2 is long enough for its ends to almost reach the corresponding seals 12*s*1.

Referring to FIG. 27, the "blow-by" prevention seal 12*s*2 is in contact with the development roller 9*c* due to the presence of the pressure from the sponge seals 12*s*5. Each sponge seal 12*s*5 is pasted to the developing means holding frame portion 12, and is in contact with the corresponding seal 12*s*1; the sponge 12*s*5 is in contact with the corresponding "blow-by" prevention seal 12*s*2, on the side opposite to the side in contact with the development roller 9*c*, due to its own resilience.

{Steps of Attaching Backup Seal}

The "blow-by" prevention backup seal 12*s*6 is approximately 50 $\mu$m in thickness, and is formed of a sheet of elastic substance such as polyethyleneterephthalate (PET). One surface of the "blow-by" prevention backup seal 12s6 is covered with double-sided adhesive tape adhered thereto.

The "blow-by" prevention backup seal 12s6 is long enough for its longitudinal end portions to partially overlap with the corresponding seals 12s1 (end seals).

Figure 28:
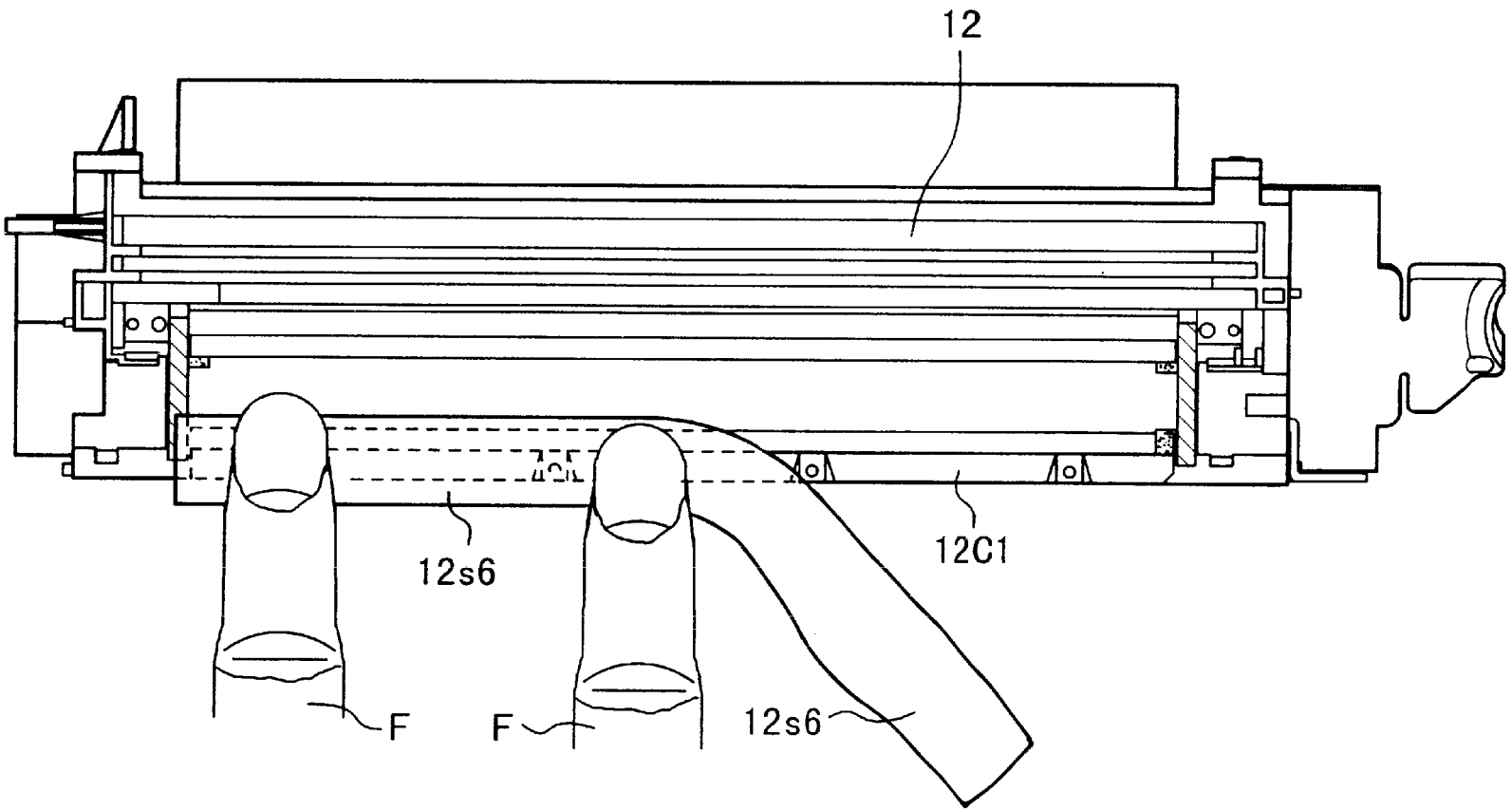
FIG. 28 is a front view of the frame portion of the development unit, from which the development roller and development blade have been removed, and to which the "blow-by" prevention backup seal is being attached.
Figure 30:
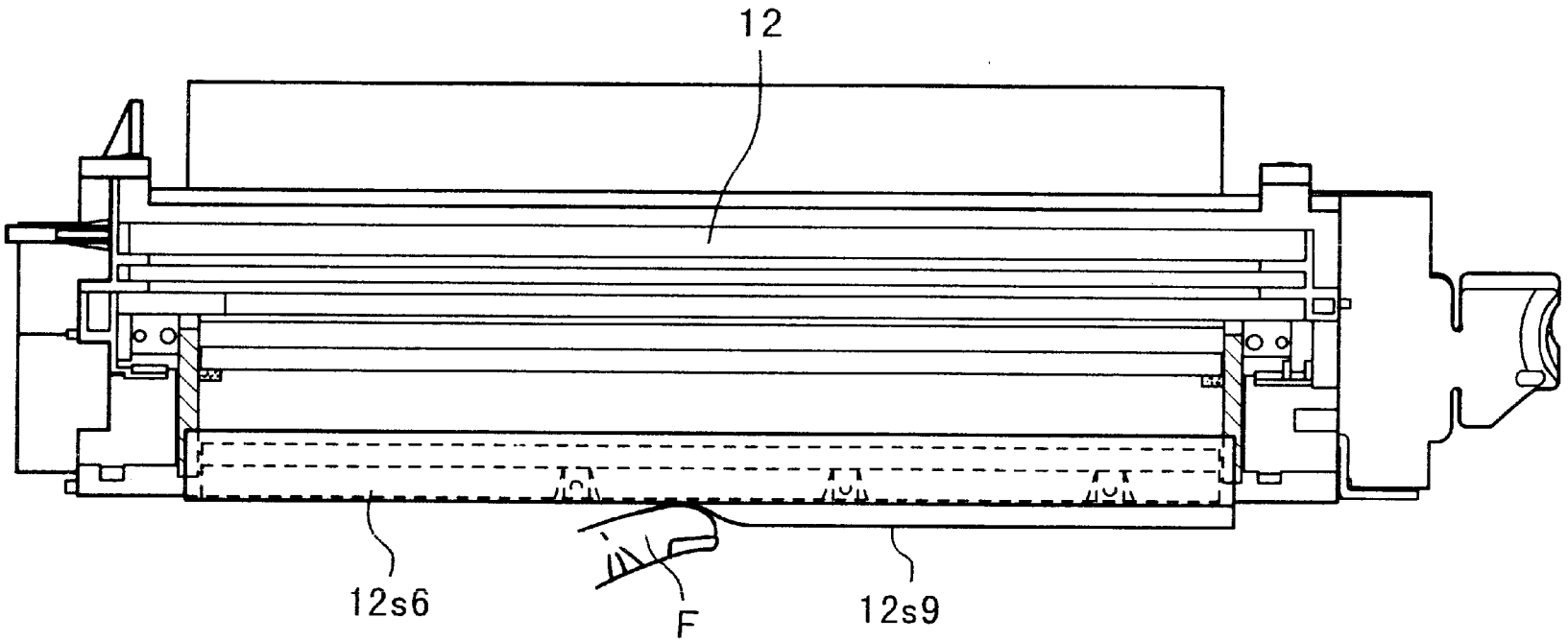
FIG. 30 is a front view of the frame portion of the development unit, from which the development roller and development blade have been removed, and to which the "blow-by" prevention backup seal is being applied.

Referring to FIG. 28, this "blow-by" prevention backup seal 12s6 is pasted to the bottom flange 12C1 of the reinforcing metallic plate 12C using fingers F. After the pasting of the "blow-by" prevention backup seal 12s6, the developing means holding frame portion 12 looks as illustrated in FIG. 29. In other words, the "blow-by" prevention backup seal 12s6 remains flat, extending (portions 12s7 and 12s9) beyond the top and bottom edges of the bottom flange 12C1 of the flat reinforcing metallic plate 12C. The portion 12s9 is bent toward the back side of the bottom edge of the bottom flange 12C1 using the finger F as shown in FIG. 30. As a result, the portion 12s9 is pasted to the downwardly facing surface 12C3 of the reinforcing metallic plate 12C and the downwardly facing surface 12h1 of the mandible-like portion 12h.

FIG. 23 is perspective view of the rear portion of the development unit after the application of the sealer, as seen from below the left front, and FIG. 26 is a vertical sectional view of the adjacencies of the mandible-like portion 12h and development roller 9c. It should be noted here that FIG. 23 is a given to illustrate the "blow-by" prevention backup seal 12s6, and the "blow-by" prevention backup seal 12s6 is pasted after the application of the sealer. Prior to the mounting of the development roller 9c, the "blow-by" prevention backup seal 12s6 extends straight in parallel to the outward surface of the bottom flange 12C1 of the reinforcing metallic plate 12C, as represented by the portion designated by a referential code 12s7 in FIG. 26.

After the mounting of the development roller 9c, the "blow-by" prevention backup seal 12s6 remains pressing upon the peripheral surface of the development roller 9c in such a manner that the dimension of the contact area between the two components in terms of the direction of the circumference of the development roller 9c remains constant at a certain value. When this seal 12s6 remains pressing on the development roller 9c, the tip portion 12s8 of the seal 12s6 is not in contact with the development roller 9c.

With the above described structural arrangement in place, as the toner leaks outward from between the original "blow-by" prevention seal 12s2 and development roller 9c, it enters a space S6 (FIG. 26). Since the space S6 is not directly affected by the toner pressure within the development chamber 12a, the space S6 reduces such pressure that causes the toner to penetrate between the original seal 12s2 and development roller 9c, assisting the "blow-by" prevention backup seal 12s6 in keeping the interface between itself and development roller 9c sealed.

{Assembling of Development Unit}

After the sealers SB1–SB8 are applied, and the "blow-by" prevention backup seal 12s6 is attached, the toner container 11A is refilled with toner. Then, the rest of the components are reassembled. All that is necessary to reassemble the process cartridge B from this point on is to simply follow in reverse the above described steps for disassembling the process cartridge B. In other words, first, the development blade 9d is attached by fixing the metallic blade plate 9d1 to the flat blade mount 12i of the developing means holding frame portion 12 with the use of screws as shown in FIG. 11.

Next, the development roller unit G is assembled through such processes as the process in which the development roller 9c is fitted with the development roller bearings 9j; the process in which the development roller 9c is fitted in the developing means holding frame portion 12; the process in which the development roller 9c is fitted with the development roller gear 9k; and the like. Thereafter, the unit G is set in the developing means holding frame portion 12 in such a manner that the unit G covers the hole 12P and also that the longitudinal end portions of the development roller 9c make contact with the corresponding toner leakage prevention elastic seals 12s1 (end seals). During these processes, the end portion of each development roller bearing 9j is inserted into the corresponding groove 12p of the developing means holding frame portion 12, and the gear box 9q is attached to the side plate 12A of the developing means holding frame portion 12.

Next, the arms 19R and 19L are inserted into the longitudinal ends of the developing means holding frame portion 12, and are fixed to the developing means holding frame portion 12 with the use of screws while holding both development roller bearings 9j in the corresponding roughly semicylindrical portions 9a.

Incidentally, prior to the mounting of the development blade 9d and development roller 9c, the toner particles adhering to them are removed using such a method as blowing air upon them while vacuuming the air away, and then, the components are examined to determine whether or not they are reusable. The component which fails to meet a predetermined performance standard is replaced with a brand-new one as necessary. However, if it becomes apparent, during an overhauling process, or through a statistical analysis or the like carried out during the component development, that is highly probable that a certain component will need to be replaced, replacing this component with a brand-new one without examining it may result in improvement in operational efficiency.

{Toner Filling Process}

Figure 33:
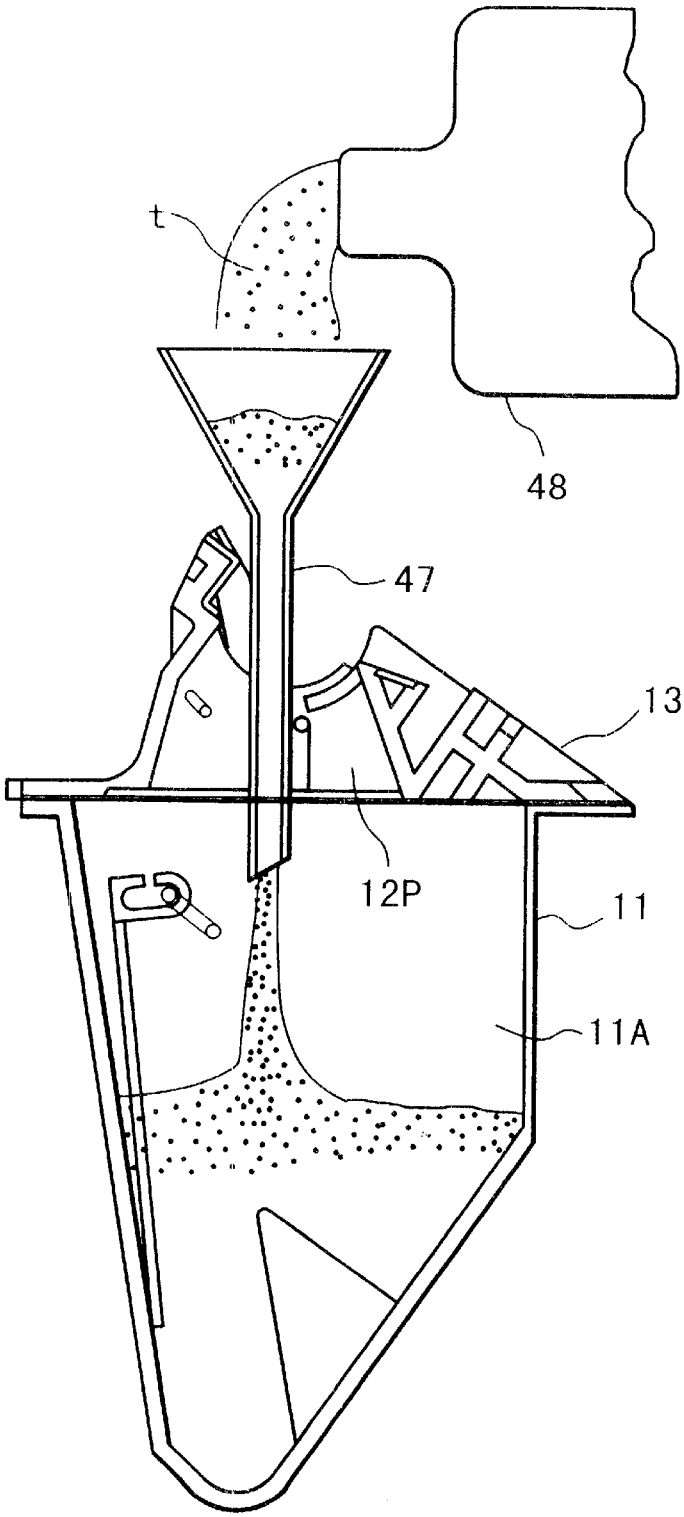
FIG. 33 is a vertical sectional view of the toner holding frame portion which is being replenished with toner.

Next, the toner container 11A is refilled with toner. Referring to FIG. 33, toner is filled into the toner holding frame portion 11 while holding the combination of the toner holding frame portion 11 and developing means holding frame portion 12 in a manner to cause the opening of the hole 12P to face upward that is, in a manner to position the toner container 11A on the bottom side. Through the opening of the hole 12P, the end portion of a funnel 47 is inserted, and toner t is poured into the funnel 47 from a toner bottle 48. Incidentally, the provision of the main body of the funnel 47 with a weight or volumetric feeder equipped with an auger can improve the toner filling efficiency.

{Process in which Development Unit is United with Cleaning Unit, and Cover is Attached}

Next, referring to FIG. 8, the connecting pin 22 having been inserted in the side plate 13s (left side) of the cleaning unit C is inserted into the hole 20L of the arm 19L, and the development unit D and cleaning unit C are combined with each other in such a manner that the rotational axle 20R projecting from the arm 19R fits into the slot 21R of the side plate 13s (right side) of the cleaning unit C. When the connecting pin 22 has been pulled out with the use of a radio pliers or the like during the disassembling of the process cartridge B, the rotational axle 20R of the development unit D is first fitted into the aforementioned slot 21R, and then, the connecting pin 22 is pressed through the hole 21L of the cleaning unit C in such a manner that the end of the connecting pin 22 slides into the hole 20L of the arm 19L.

Lastly, the combination of the development unit D and cleaning unit C is fitted with the cartridge cover 15, and the cartridge cover 15 is fixed to the cleaning unit C with the use of the small screw 15d and pin 15c, following in reverse the disassembling steps.

The process in which the "blow-by" prevention backup seal is attached can be summarized as follows.

(1) In a method for overhauling the process cartridge B which is removably mountable in the apparatus main assembly 14, and comprises: the cleaning unit C, or the first unit, which supports the photosensitive drum 7; and the development unit D, or the second unit, having the developing means holding frame portion 12 which supports the development roller 9*c* and the toner holding frame portion 11 for storing the toner used for development by the development roller 9*c*, the two units being connected in such a manner that they are allowed to pivot relative to each other, (a) a unit separation step in which the first and second units are separated from each other;

(b) a development roller removal step in which the development roller 9*c* in the separated second unit is removed from the second unit; and (c) a backup seal attachment step in which, in order to prevent toner from leaking from between the development roller 9*c* and developing means holding frame portion 12, the seal 12*s*6, which is an additional seal, is attached to the developing means holding frame portion 12, along the "blow-by" prevention seal 12*s*2, which is the original seal attached to the developing means holding frame portion 12 along the longitudinal edge of the developing means holding frame portion 12, are carried out.

The portion of the developing means holding frame portion 12, to which the "blow-by" prevention backup seal 12*s*6 is attached, is on the outward side of the developing means holding frame portion 12 with respect to the original blow-by prevention seal 12*s*2.

In the step in which the "blow-by" prevention backup seal 12*s*6, that is, an additional seal, is attached to the developing means holding frame portion 12, the "blow-by" prevention backup seal 12*s*6 is pasted to the developing means holding frame portion 12 in such a manner that the inward longitudinal edge of the "blow-by" prevention backup seal 12*s*6 extends over both the developing means holding frame portion 12 and the reinforcing metallic plate 12*c* attached to the developing means holding frame portion 12.

Also in the step in which the "blow-by" prevention backup seal 12*s*6, that is, an additional seal, is attached to the developing means holding frame portion 12, the "blow-by" prevention backup seal 12*s*6 is attached to the developing means holding frame portion 12 in a such a manner that the "blow-by" prevention backup seal 12*s*6 remains in contact with the development roller 9*c*, on the upstream side with respect to the "blow-by" prevention seal 12*s*2, or the original "blow-by" prevention seal, in terms of the direction in which the peripheral surface of the development roller 9*c* is moved by the rotation of the development roller 9*c*.

The developer refilling step is caused out after the step in which the "blow-by" prevention backup seal 12*s*6 as an additional seal is attached.

The development roller mounted in the developing means holding frame portion 12 in the development roller attachment step is a brand-new development roller or a recycled development roller 9*c*.

The overhauling of the process cartridge B is carried out without resealing the developer releasing opening 11*i* through which the development roller 9*c* is supplied with the toner stored in the toner container 11A.

{Overhauling of Cleaning Unit}

While overhauling the development unit, the separated cleaning unit C is also overhauled.

Figure 34:
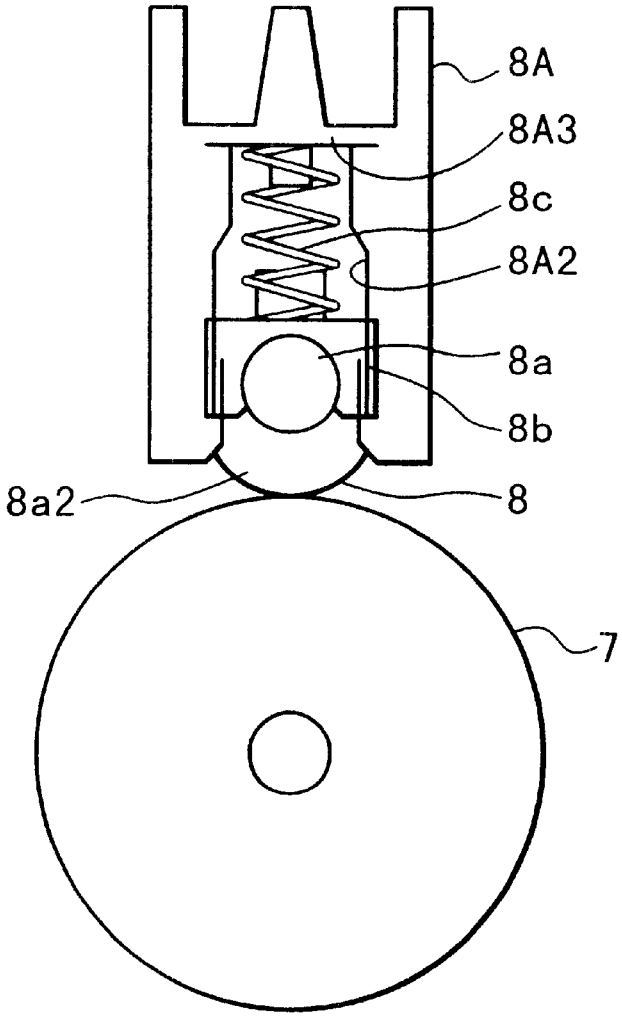
FIG. 34 is a front view of a charging unit.

FIG. 8 shows the photosensitive drum 7, charge roller 8, and cleaning means holding frame portion 13. The cleaning blade 10*a* attached to the cleaning means frame portion 13 is not visible. FIG. 9 is a perspective view of the cleaning unit C in the disassembled state. FIG. 34 shows the structure used for supporting the charge roller 8 by the cleaning means holding frame portion 13.

Referring to FIG. 9, the photosensitive drum 7 comprises: the hollow aluminum cylinder 7*d*, the peripheral surface of which is coated with a photosensitive layer; the flanges 7*j* attached to one end of the photosensitive drum 7; and the flange 7*k* attached to the other end. As for the method for attaching the flanges 7*j* and 7*k*, they are inserted into the corresponding ends of the photosensitive drum 7, and fixed thereto by gluing, crimping, or the like. The flange 7*j* has the drum gear 7*b*. The flange 7*k* has the transfer roller driving gear 7*n*. The drum shaft 7*a* (only left side is shown in drawing; right side is the same), which has been put through the center holes 7*j*1 and 7*k*1 of the flanges 7*j* and 7*k*, respectively, is attached to the supporting plates 13*c* by crimping. The supporting plates 13*c* have been attached to the cleaning means holding frame portion 13. As the process cartridge B is mounted into the apparatus main assembly 14, the drum gear 7*b* meshes with an unillustrated driving gear of the image forming apparatus main assembly 14, and the transfer roller gear 7*n* meshes with an unillustrated gear fixed to the transfer roller 4. After the joining of the cleaning unit C and development unit D, the drum gear 7*b* and the development roller gear 9*k* of the development roller 9*c* are in mesh with each other.

As has been described before, the charging means is attached as the charging unit E to the cleaning means holding frame portion 13. Referring to FIGS. 9 and 34, the charger roller 8 is made of up the metallic shaft 8*a*, and the elastic member 8*a*2, that is, a rubber roller with medium electrical resistance, formed around the shaft 8*a*. The shaft 8*a* protrudes from both ends of the charge roller 8.

Referring to FIG. 34, each charge roller bearing 8*b* is slidably fitted in the guide groove 8A2, the center line of which coincides with the line connecting the centers of the charge roller 8 and photosensitive drum 7. The guide groove 8A2 is a part of the cleaning means container 13 (cleaning means holding frame portion). The shaft 8*a* of the charge roller 8 is rotationally fitted in the charge roller gearing 8*b*. A compression coil spring 8*c* placed, in the compressed state, between a spring seat 8A3 located at one end of the guide groove 8A2, and the bearing 8*b*, presses the charge roller 8*b* toward the photosensitive drum 7. As a result, the charge roller 8 remains pressed upon the photosensitive drum 7. The charge roller 8 rotates following the rotation of the photosensitive drum 7. The compression coil spring 8*c* is held by the bearing 8*b*.

The charge roller 8 is electrically connected to a high voltage power source of the apparatus main assembly 14. More specifically, the metallic shaft 8*a* of the charge roller 8 is placed in contact with an unillustrated electrode which is extended outward of the process cartridge B. The outward end of this unillustrated electrode constitutes an external charge bias contact point 120, which is connected to a contact connected to a high voltage power source of the image forming apparatus main assembly 14.

Referring to FIG. 9, the cleaning blade 10*a* is made up of an elastic blade 10*a*1, which is placed in contact with the generatrix portion of the photosensitive drum 7, and a metallic blade plate 10*a*2 to which the elastic blade 10*a*1 is fixed. Also referring to FIG. 9, the cleaning blade 10*a* is provided with two notches, one at each longitudinal end, and the metallic blade plate 10*a*2 is provided with two holes 10*a*3, one at each longitudinal end. The cleaning blade 10*a* is fixed to the cleaning means holding frame portion 13; unillustrated small screws are put through the holes 10*a*3 of the metallic blade plate 10*a*2, and screwed into the cleaning means holding frame portion 13, with the projections (unillustrated) of the cleaning means holding frame portion 13 fitted in the notches 10*a*3 of the metallic blade plate 10*a*2.

Regarding the above description, the process for removing the photosensitive drum 7 and charge roller 8 will be described.

Referring to FIGS. 5 and 6, first, the small screws 13*b* which are firmly holding the supporting plate 13*c* to the cleaning means holding frame portion 13, are removed, and the supporting plate 13*c* is moved outward in the longitudinal direction of the process cartridge B. Then, the drum shaft 7*b* is pulled out of the center holes 7*j*1 and 7*k*1 of the flange 7*j* and 7*k*, respectively, and the holes 13*s*1 of the side plates 13*s* of the cleaning means holding frame portion 13.

Then, the photosensitive drum 7 is removed from the cleaning means holding frame portion 13; the photosensitive drum 7 is moved from between the side plates 13*s* of the cleaning means holding frame portion 13 in the widthwise direction of the process cartridge B.

The charge roller unit E can be removed from the cleaning means holding frame portion 13 by pulling out the fasteners 13*h* from the holes 13*s*2 of the side plates 13*s* of the cleaning means holding frame portion 13; the fastener 13*h* can be pulled out of the hole 13*s*2 by pulling the fastener 13*h* while squeezing the pair of snap-fit claws of the fastener 13*h* in a manner to cause them to come closer to each other, with the use of a radio pliers. After the removal of the fasteners 13*h*, the charge unit E is lifted on the right side, and is pulled rightward, so that the joggle (unillustrated) on the left end surface of the charging means holding frame portion 8A comes out of the hole 13*s*3 of the side plate 13*s* of the cleaning means holding frame portion 13.

As the above described procedure is carried out, an opening G (FIG. 36) is created between the cleaning blade 10*a* and a scooping sheet 10*d*. This opening G extends in the longitudinal direction of the process cartridge B across virtually the entire range.

After the removal of the charge roller unit E, the charge roller 8 is moved perpendicular to its shaft, in parallel to the cleaning means holding frame portion 13, while sliding the bearings 8*b* outward in the guide grooves 8A1. As a result, the bearings 8*b* come out of the guide grooves 8A1, remaining attached to the charge roller 8. Next, the bearings 8*b* are pulled off from the shaft 8*a*, and the compression coil springs 8*c* are removed.

After removal, the photosensitive drum 7, charge roller 8, bearings 8*b*, and compression coil springs 8*b* are examined to determine if they can be reused. If they are reusable, they are assembled into the cleaning means holding frame portion 13 when reassembling the process cartridge B. If they are not fit for reuse, they are replaced with brand-new ones. The service life of the photosensitive drum 7 is substantially longer than those of the other components of the process cartridge B, and therefore, it is usual that the photosensitive drum 7 of a toner depleted process cartridge is reusable as it is.

After the photosensitive drum 7, charge roller 8, bearing 8*c*, and the like are removed from the cleaning means holding frame portion 13, the waste toner which has accumulated in the cleaning means holding frame portion 13 is removed.

Next, referring to FIGS. 35, 36 and 37, the cleaning of the cleaning means holding frame portion 13, that is, the removal of the waste toner which has accumulated in the cleaning means holding frame portion 13, will be described.

Figure 35:
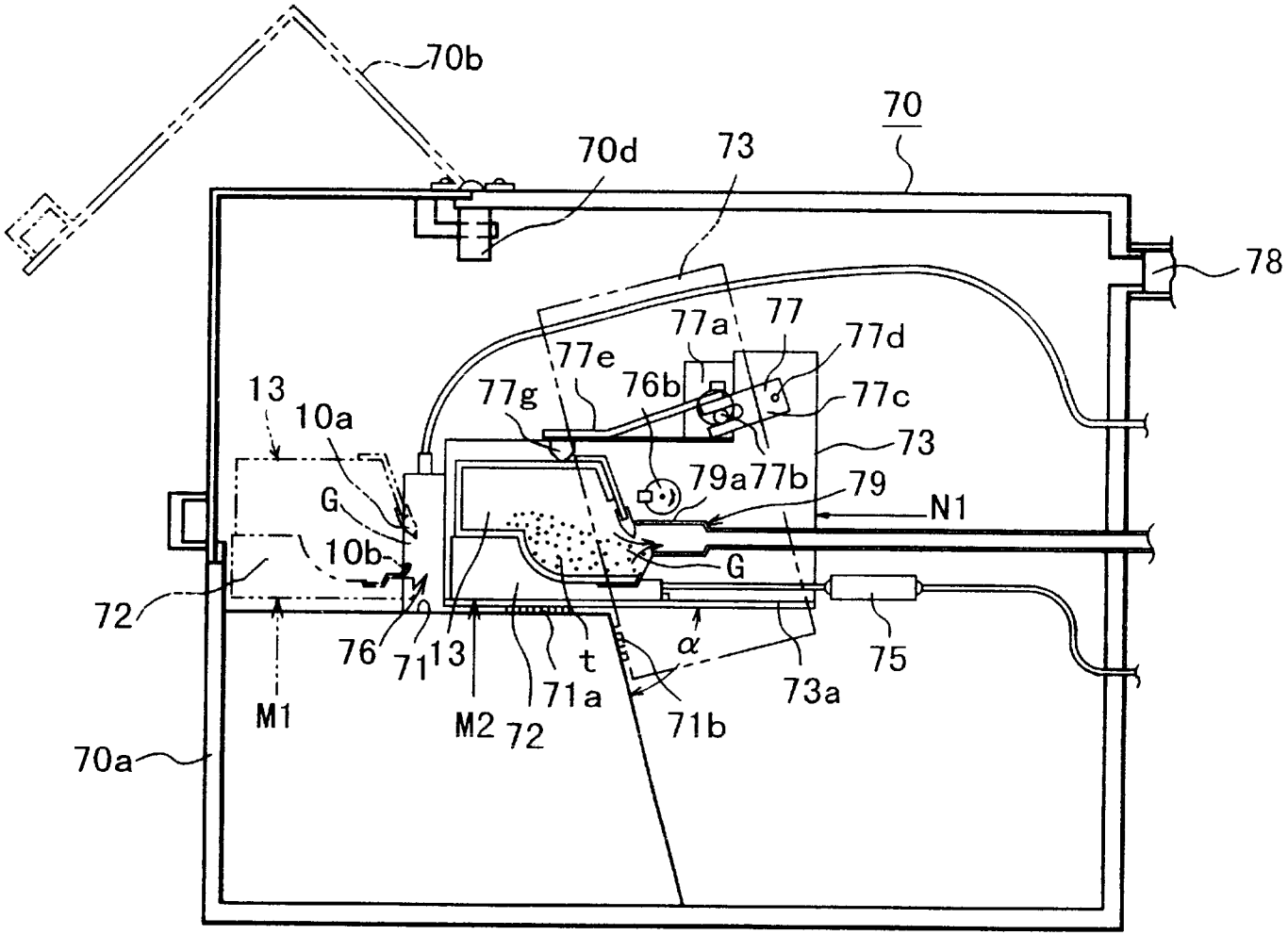
FIG. 35 is a vertical sectional view of a cleaning apparatus for removing the waste toner.

FIG. 35 shows an apparatus 70 for cleaning the cleaning means holding frame portion 13. In order to clean the cleaning means holding frame portion 13, the cleaning means holding frame portion 13 is placed in the sealed housing 70*a* of this cleaning apparatus 70, and the waste toner within the cleaning means holding frame portion 13 is vacuumed by a vacuuming apparatus while the cleaning means holding frame portion 13 is jolted by a jolting apparatus 77 held by an oscillating apparatus 73. The oscillating apparatus 73 is an apparatus for oscillating the cleaning means holding frame portion 13 about a shaft 76*b*.

Figure 36:
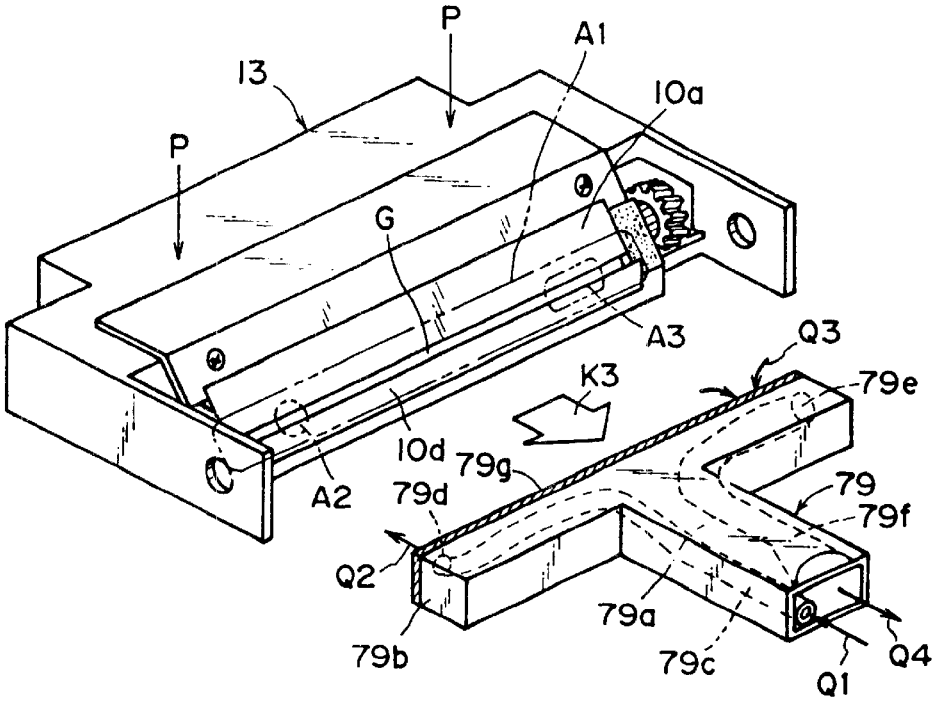
FIG. 36 is a perspective view of a toner vacuuming apparatus.

FIG. 36 shows the details of the air block 79*a* of the vacuuming apparatus 79. Virtually the entirety of the air block 79*a* is hollow. The contact surface 79*g* of the air block 79*a*, which is paced airtightly in contact with the cleaning means holding frame portion 13 in a manner to cover the opening G of the cleaning means holding frame portion 13 is virtually entirely covered with a seal 79*b* formed of rubbery substance, except for the blowing opening 9*d* and suctioning opening 79*e*. The air block 79*a* contains an air sending tube 79*c* for blowing air into the cleaning means holding frame portion 13, and the air outlet 79*d* of the air sending tube 79*b* is in the aforementioned contact surface 79*g*, being adjacent to one of the longitudinal ends of the aforementioned contact surface 79*g*. The air block 79*a* also contains the suctioning tube 79*f*, and the air inlet 79*e* of the suctioning tube 79*f* is located also in the aforementioned contact surface 79*g*, being adjacent to the other longitudinal end of the contact surface 79*g*. The air block 79*a* is structured so that as the cleaning means holding frame portion 13 set at the cleaning position M2 is moved in the direction indicated by an arrow mark K3 by a cleaning means holding frame portion holding portion 72 (hereinafter, "holder"), which will be described later, the contact surface 79*g* provided with the air outlet 79*d* and air inlet 79*e* comes into contact with the cleaning blade 10*a* and scooping sheet 10*d* in a manner to completely cover the opening G between the cleaning blade 10*a* and scooping sheet 10*d*. Referring to FIG. 36, the areas A1, A2 and A3 of the cleaning means holding frame portion 13, the locations of which correspond to that of the opening G and are indicated by double-dot chain lines in FIG. 36, are the area to be sealed, the area through which air is blown in, and the area through which air is suctioned out. These areas A1, A2 and A3 correspond to the contact surface 79*g*, air outlet 79*d*, and air inlet 79*e* of the air block 78*a*. The vacuuming apparatus 79 is structured so that the compressed air Q1 supplied from the base side of the air sending tube 79*c* is sent from the air outlet 79*d* airtightly connected to the air inlet A2, into the cleaning means holding frame portion 13 placed airtightly in contact with the air block 79*a*, through the opening G (arrow mark Q2), and as air is blown in, the waste toner within the cleaning means holding frame portion 13 is rendered airborne, and suctioned out, along with the air within the cleaning means holding frame portion 13, through the air inlet 79*e* airtightly connected to the air outlet A3 (arrow mark Q3), to be further suctioned toward the base side (arrow mark Q4).

The toner which leaks out of the cleaning means holding frame portion 13 and air block 79*a* is vacuumed, along with ambient air, through an ambient air suctioning opening 78, by an auxiliary vacuuming apparatus (unillustrated), as shown in FIG. 35.

Next, a method for cleaning the cleaning means holding frame portion 13, and the operation of the cleaning apparatus 70, will be described in detail with reference to FIG. 35, which shows the structure of the cleaning apparatus 70, and FIG. 37, which is the flow chart of the operation of the cleaning apparatus 70, while referring also to FIG. 36 as necessary.

First, the cleaning apparatus 70 (vacuum cleaner) is turned on (S1). Then, the cleaning means holding frame portion 13, or the object to be cleaned, is placed on the top surface of the holder 72 set at the home position M1 (S2). Next, a cover 70*b* is closed (S3). The closing of the cover 70*b* is detected by a sensor 70*d* (door switch) (S4), and the air cylinder of an unillustrated clamping apparatus is turned on (S5) to apply pressure upon the top surface of the cleaning means holding frame portion 13.

As a result, the cleaning means holding frame portion 13 is clamped to the predetermined position of the holder 72 (S6). Next, an air cylinder 75, the piston rod of which is directly connected to the holder 72, is turned on (S7), causing the holder 72 to slide on a slide base 71 from the home position M1 to the cleaning position M2 within the oscillating apparatus 73 (S8). As a result, the fringe area of the opening G is placed airtightly in contact with the contact surface 79*g* of the vacuuming apparatus 79 (FIG. 36). Next, a motor 77*a* is turned on (S9), driving the jolting apparatus 77; the pin 77*b* of a crank fixed to the shaft of the motor 77*a* oscillates the yoke 77*c* about the pin 77*d* which supports the yoke 77*c*. As a result, a point P (FIG. 3) on the top surface of the cleaning means holding frame portion 13 is stricken in a vibratory manner by a striker 77*g* fixed to the tip of the arm 77*c*, that is, a leaf spring, fixed to the yoke 77*c* (S10). Consequently, the waste toner adhering to the internal surface of the cleaning means holding frame portion 13 is shake down to be easily moved. Next, a rotary actuator 76 is activated (S11), causing the pivotable table 73*a* of the oscillating apparatus 73 to reciprocally pivot through an angle of $\alpha$ (0–80 deg.), one time, about an axis 76*b* (connected to the shaft of the rotary actuator 76 by a pair of helical gears) which pivotally supports the pivotable table 73*a* (S12). The angle of the pivotable table 73*a* is controlled by stoppers 71*a* and 71*b*, the positions of which are adjustable. Next, the pressure control valve (unillustrated) of the vacuuming apparatus 79 is opened (S13, S14), and compressed air is blown into the cleaning means holding frame portion 13 from the air outlet 79*d* (FIG. 36), through the opening G, while suctioning the air within the cleaning means holding frame portion 13, along with the waste toner, from the air inlet 79*e*, through the opening G. This process is continued for an appropriate length of time.

Next, the pivotable table 73*a* is reciprocally pivoted once (S15). Then, the rotary actuator 76 is turned off (S16), and after it is confirmed that the pivotable table 73 is horizontally positioned (horizontal position N1) (S17), the motor 77*a* is turned off (S18, S19), completing the vibratory striking of the cleaning means holding frame portion 13 by the jolting apparatus 77. Next, the compressed air control valve is closed (S20, S21), and the air cylinder is pressured in the returning direction (S22), causing the holder 72, which has been at the cleaning position M2, to return to the home position M1 (S23). Then, the air cylinder for the unillustrated clamp is turned off (S24), unclamping the cleaning means holding frame portion 13 from the holder 72 (S25). Next, the cover 70*b* is opened (S26), and the cleaning means holding frame portion 13 is taken out of the housing 70*a* (S27), completing the cleaning of the cleaning means holding frame portion 13.

Figures 37, 37A:
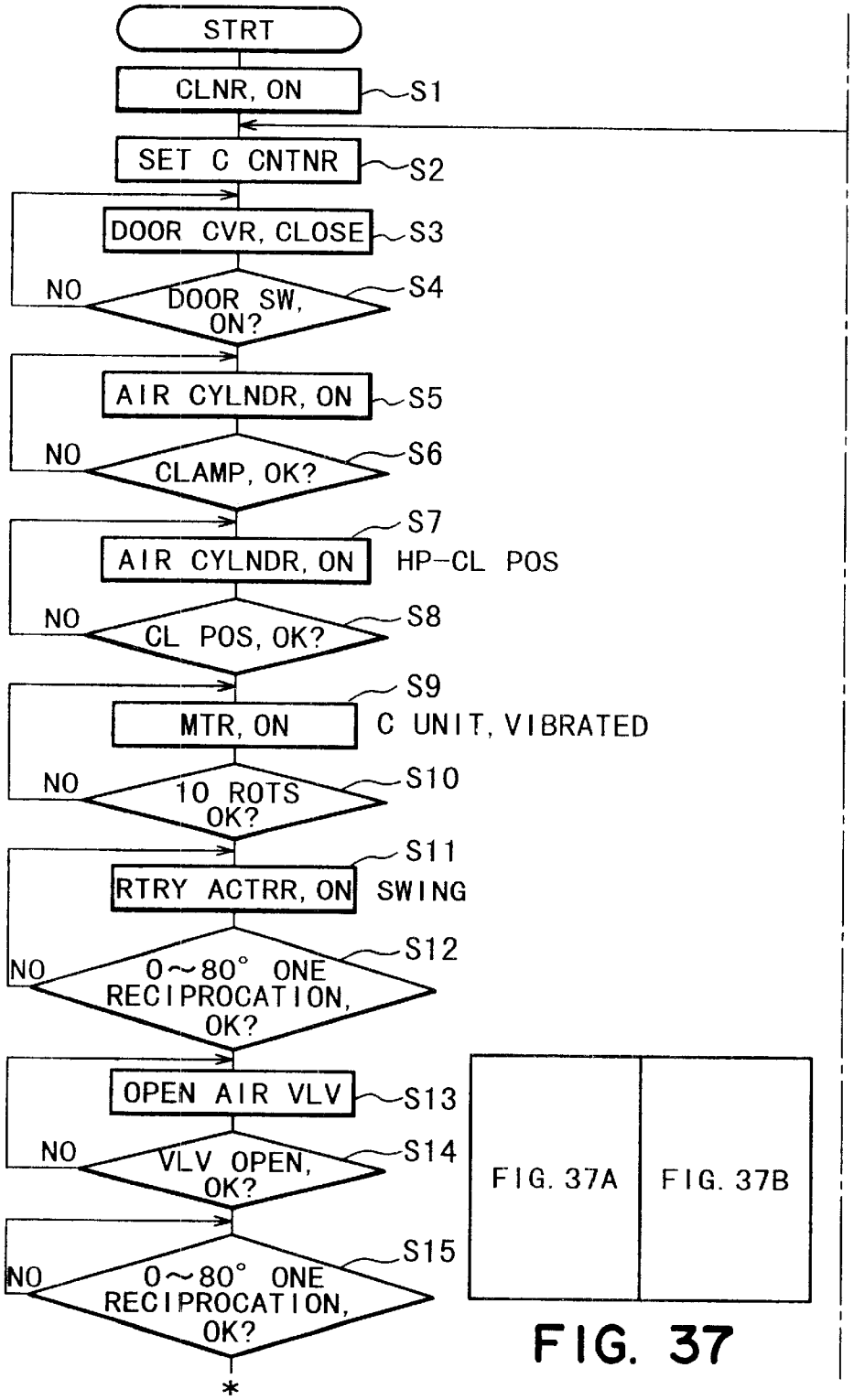
FIGS. 37A and 37B together are a flow chart of the waste toner removing process.
Figure 37B:
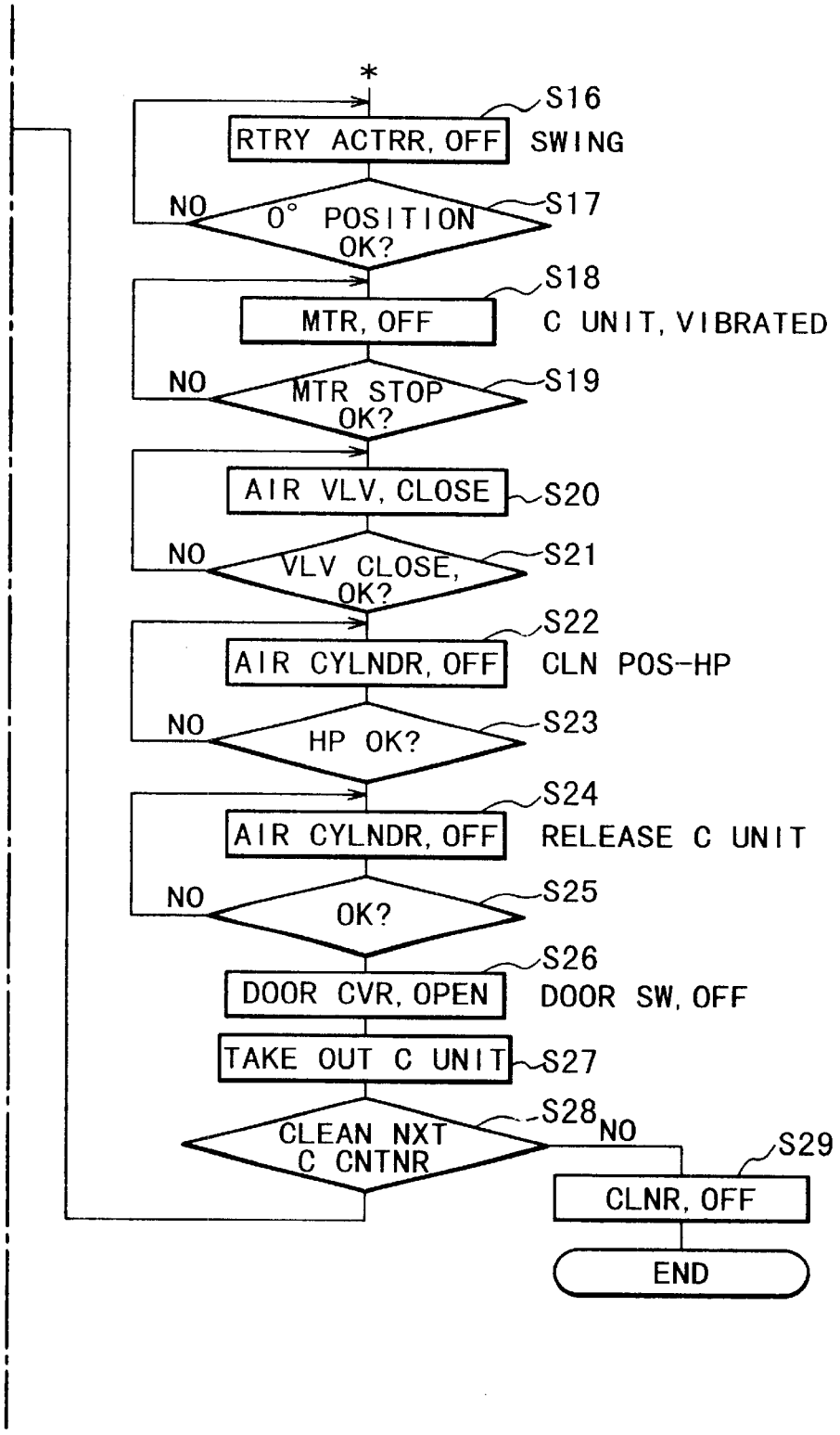

During the period from S9 to S18 of the flow chart, in FIG. 37, for the above described cleaning process, the striking of the cleaning means frame portion 13 by the jolting apparatus 77 is continued along with the pivoting of the cleaning means holding frame portion 13 and suctioning of the waste toner. Therefore, the waste toner adhering to the internal surface or the like of the cleaning means holding frame portion 13 is shaken down by the striking of the cleaning means holding frame portion 13, and is smoothly moved toward the opening G, being kicked up in the air by the compressed air blown out of the air outlet 79*d*, and is suctioned through the air inlet 79*e*. These continuous and simultaneous actions assure that the waste toner within the cleaning means holding frame portion 13 is entirely extracted without leaving any toner.

After the completion of the toner extraction, the cleaning blade 10*a* is removed from the cleaning means holding frame portion 13 by removing the unillustrated small screws which were screwed into the cleaning means holding frame portion 13 through the metallic blade PLATE 10*a*2 of the cleaning blade 10*a*. Then, the scooping sheet 10*d* is peeled away from the cleaning means holding frame portion 13. Then, the cleaning means holding frame portion 13 is cleaned by blowing compressed air into the cleaning means holding frame portion 13 while suctioning the air out of the cleaning means holding frame portion 13. Thereafter, a brand-new scooping sheet 10*d* is pasted to the cleaning means holding frame portion 13. Next, a brand-new cleaning blade 10*a* is placed in the cleaning means holding frame portion 13 in such a manner that the unillustrated positioning projections of the cleaning means holding frame portion 13 fit in the notches 10*a*3 of the cleaning blade 10. Then, unillustrated small screws are screwed into the cleaning means holding frame portion 13 through the holes 10*a*3 of the metallic blade plate 10*a*3.

Next, the charge roller 8, the shaft 8*a* of which has been fitted with the bearings 8*b* to which the compression coil spring 8*c* has been attached, is attached to the charging means holding frame portion 8A, completing the charging unit E. More specifically, the bearings 8*b* are fitted into the guide grooves 8A1, one for one, holding the charge roller 8 in such a manner that the compression coil spring 8*c* comes to the front side in terms of the bearing insertion direction. The longitudinal ends of the completed charging unit E is fitted in the holes 13*s*2 and 13*s*3 of the side plates 13*s* of the cleaning means holding frame portion 13. Thereafter, the photosensitive drum 7 is fitted between the side plates 13*s* located at the longitudinal ends of the cleaning means holding frame portion 13, aligning the center holes 7*j*1 and 7*k*1 of the flanges 7*j* and 7*k*, respectively, with the holes 13*s*1 of the side plate 13*s* of the cleaning means holding frame portion 13, and then, the drum shaft 7*a* is put through the holes 13*s*1, and holes 7*j*1 and 7*k*1. After the drum shaft 7*a* is put through the holes 13*s*1, it is fixed to the side plats 13*s* by crimping. The drum shaft 7*a* slidably fits in the holes 13*j* and 13*k*. In other words, the assembled photosensitive drum 7 freely rotates around the drum shaft 7*a*. Next, the supporting plates 13*c* are fixed to the cleaning means holding frame portion 13 with the use of the small screws 13*b*.

As described above, according to the present invention, it is possible to provide a simple method for overhauling a process cartridge.

While the invention has been described with reference to the structures disclosed herein, it is not confined to the details set forth and this application is intended to cover such modifications or changes as may come within the purposes of the improvements or the scope of the following claims.

What is claimed is:

1. A method for remanufacturing a process cartridge which is detachably mountable to a main assembly of an electrophotographic image forming apparatus, wherein said process cartridge includes a first unit supporting an electrophotographic photosensitive drum and a second unit, which includes a developing frame supporting a developing roller, a developer accommodating portion for accommodating a developer to be used for development by the developing roller and a developer supply opening for supplying to the developing roller the developer accommodated in the developer accommodating portion, said first unit and second unit being rotatably coupled with each other, said method comprising:

(a) a unit separating step of separating the first unit and the second unit from each other;

(b) a developing roller dismounting step of dismounting the developing roller mounted to the second unit which has been separated by said separation step;

(c) an additional seal mounting step of mounting an additional seal along an original seal previously mounted to the developing frame along a longitudinal direction of the developing frame to prevent leakage of the developer through and between the developing roller and the developing frame;

(d) a developer refilling step of refilling the developer into the developer accommodating portion of the second unit which has been separated by said separation step;

(e) a developing roller remounting step of remounting the developing roller to the second unit which has been separated by said separation step; and (f) a unit re-coupling step of recoupling the first unit and the second unit with each other, by which the process cartridge is remanufactured without remounting a toner seal to the developer supply opening, which was unsealed by removing the original seal upon the start of use of the process cartridge.

2. A method according to claim 1, wherein in said additional seal mounting step, the additional seal is mounted at a position outside the original seal.

3. A method according to claim 1, wherein in said additional seal mounting step, the additional seal is mounted to the developing frame by bonding one lateral end portion of the additional seal over the developing frame and a metal plate mounted to the developing frame.

4. A method according to claim 1 or 2, wherein in said additional seal mounting step, the additional seal is mounted to the developing frame such that it is contacted to the developing roller at a position upstream of the original seal with respect to the rotational direction of the developing roller.

5. A method according to claim 1 or 2, wherein said developer refilling step is carried out after said additional seal mounting step.

6. A method according to claim 1 or 2, wherein in said developing roller remounting step, the developing roller is a fresh or reused developing roller.

7. A method according to claim 1 or 2, further comprising:

a step of dismounting, from the first unit, the electrophotographic photosensitive drum and a cleaning blade for removing the developer remaining on the electrophotographic photosensitive drum, prior to said unit re-coupling step; and a step of removing, from the first unit, a removed developer removed from the electrophotographic photosensitive drum by the cleaning blade.

8. A method according to claim 7, further comprising a step of mounting a fresh or reused electrophotographic photosensitive drum to the first unit after the removed developer is removed from the first unit, and a step of remounting a fresh or reused cleaning blade to the first unit.

9. A method according to claim 1 or 2, further comprising a step of dismounting a cartridge cover covering the first unit and the second unit prior to said unit separating step.

10. A method according to claim 1 or 2, wherein in said unit separating step, the first unit and the second unit are separated from each other by removing a pin mounted to one of engaging portions at opposite ends of the units and by releasing engagement between a groove provided in the first unit at the other engaging portion and a dowel of the second unit.

11. A method for remanufacturing a process cartridge which is detachably mountable to a main assembly of an electrophotographic image forming apparatus, wherein said process cartridge includes a first unit supporting an electrophotographic photosensitive drum and a second unit, which includes a developing frame supporting a developing roller, a developer accommodating portion for accommodating a developer to be used for development by the developing roller and a developer supply opening for supplying to the developing roller the developer accommodated in the developer accommodating portion, said first unit and second unit being rotatably coupled with each other, said method comprising:

(a) a unit separating step of separating the first unit and the second unit from each other;

(b) a developing roller dismounting step of dismounting the developing roller mounted to the second unit which has been separated by said separation step;

(c) an additional seal mounting step of mounting an additional seal along an original seal previously mounted to the developing frame along a longitudinal direction of the developing frame to prevent leakage of the developer through and between the developing roller and the developing frame, wherein the additional seal is mounted at a position outside the original seal, and wherein the additional seal is mounted to the developing frame by bonding one lateral end portion of the additional seal over the developing frame and a metal plate mounted to the developing frame;

(d) a developer refilling step of refilling the developer into the developer accommodating portion of the second unit which has been separated by said separation step;

(e) a developing roller remounting step of remounting the developing roller to the second unit which has been separated by said separation step; and (f) a unit re-coupling step of recoupling the first unit and the second unit with each other, by which the process cartridge is remanufactured without remounting a toner seal to the developer supply opening, which was unsealed by removing the original seal upon start of use of the process cartridge.

12. A method according to claim 11, wherein in said additional seal mounting step, the additional seal is mounted to the developing frame such that it is contacted to the developing roller at a position upstream of the original seal with respect to the rotational direction of the developing roller.

13. A method according to claim 11 or 12, wherein said developer refilling step is carried out after said additional seal mounting step.

14. A method according to claim 11 or 12, wherein in said developing roller remounting step, the developing roller is a fresh or reused developing roller.

15. A method according to claim 11 or 12, further comprising:

a step of dismounting, from the first unit, the electrophotographic photosensitive drum and a cleaning blade for tographic photosensitive drum, prior to said unit re-coupling step; and a step of removing, from the first unit, a removed developer removed from the electrophotographic photosensitive drum by the cleaning blade.

16. A method according to claim 15, further comprising a step of mounting a fresh or reused electrophotographic photosensitive drum to the first unit after the removed developer is removed from the first unit, and a step of remounting a fresh or reused cleaning blade to the first unit.

17. A method according to claim 11 or 12, further comprising a step of dismounting a cartridge cover covering the first unit and the second unit prior to said unit separating step.

18. A method according to claim 11 or 12, wherein in said unit separating step, the first unit and the second unit are separated from each other by removing a pin mounted to one of engaging portions at opposite ends of the units and by releasing engagement between a groove provided in the first unit at the other engaging portion and a dowel of the second unit.

* * * * *

UNITED STATES PATENT AND TRADEMARK OFFICE

CERTIFICATE OF CORRECTION

PATENT NO. : 6,574,445 B2
DATED : June 3, 2003
INVENTOR(S) : Akira Higeta et al.

It is certified that error appears in the above-identified patent and that said Letters Patent is hereby corrected as shown below:

Column 2,
Line 18, “an” (first occurrence) should read -- (c) an --.
Line 34, “used” should read -- use --.

Column 3,
Line 21, “overhaul” should read -- overhaul, --.

Column 4,
Line 46, “printer” should read -- printer) --.

Column 5,
Line 51, “date,” should read -- data, --.

Column 7,
Line 7, “mad” should read -- made --.

Column 8,
Line 3, “unit D are” should read -- unit D and --.

Column 9,
Line 24, “plats” should read -- plates --.

Column 10,
Line 9, “the by” should be deleted.
Line 11, “At” should read -- As --.
Line 12, “the” (1st occurrence) should be deleted.
Line 56, “plate” should read -- plates --.

Column 12,
Line 3, “with” should read -- will --.
Line 10, “from” should read -- from the --.

Column 13,
Line 38, “FIG. 13.” should read -- FIG. 13, --.
Line 47, “9d1a” (1st occurrence) should read -- 9d1a. --.

Column 15,
Line 47, “9d1a” (1st occurrence) should read -- 9d1a. --.

UNITED STATES PATENT AND TRADEMARK OFFICE

CERTIFICATE OF CORRECTION

PATENT NO. : 6,574,445 B2
DATED : June 3, 2003
INVENTOR(S) : Akira Higeta et al.

It is certified that error appears in the above-identified patent and that said Letters Patent is hereby corrected as shown below:

Column 16,
Line 14, “for” should read -- form --.
Line 37, “in” should read -- is --.

Column 20,
Line 66, “has” should read -- has been --.

Column 21,
Line 1, “has” should read -- has been --.

Column 22,
Line 54, “plats15a” should read -- plates 15a --.

Column 23,
Line 64, “development,” should read -- development --.

Column 27,
Line 51, “to the” should read -- to be --.

Column 30,
Line 26, “been already” should read -- already been --.
Line 41, “mean” should read -- means --.

Column 31,
Line 21, “is” should read -- is a --.

Column 37,
Line 30, “shake” should read -- shaken --.

UNITED STATES PATENT AND TRADEMARK OFFICE

CERTIFICATE OF CORRECTION

PATENT NO. : 6,574,445 B2
DATED : June 3, 2003
INVENTOR(S) : Akira Higeta et al.

It is certified that error appears in the above-identified patent and that said Letters Patent is hereby corrected as shown below:

Column 38,
Line 58, "plats" should read -- plates --.

Column 41,
Line 5, "tographic" should read -- removing the developer remaining on the electrophotographic --.

Signed and Sealed this

Third Day of February, 2004

JON W. DUDAS
*Acting Director of the United States Patent and Trademark Office*